US007051496B2

(12) United States Patent
Heilman

(10) Patent No.: US 7,051,496 B2
(45) Date of Patent: May 30, 2006

(54) ENVELOPE AND INSERT TRANSPORT AND INSERTION MACHINE

(75) Inventor: Robin L. Heilman, Willow Spring, NC (US)

(73) Assignee: Bowe Bell + Howell Company, Durham, NC (US)

( * ) Notice: Subject to any disclaimer, the term of this patent is extended or adjusted under 35 U.S.C. 154(b) by 13 days.

(21) Appl. No.: 10/823,789

(22) Filed: Apr. 14, 2004

(65) Prior Publication Data

US 2004/0255561 A1 Dec. 23, 2004

Related U.S. Application Data

(60) Provisional application No. 60/462,319, filed on Apr. 14, 2003.

(51) Int. Cl.
*B65B 43/46* (2006.01)

(52) U.S. Cl. ..... 53/569; 53/284.3; 53/389.1

(58) Field of Classification Search ..... 53/569, 53/284.3, 389.1; 271/247, 246
See application file for complete search history.

(56) References Cited

U.S. PATENT DOCUMENTS 3,278,179 A * 10/1966 Hartel ..... 271/314
3,540,970 A * 11/1970 Huntwork ..... 156/556
4,604,849 A 8/1986 Zemke et al.
4,817,368 A * 4/1989 DePasquale et al. ..... 53/460
4,913,415 A * 4/1990 Weber ..... 271/272
5,102,111 A * 4/1992 Reponty ..... 270/12
5,178,379 A * 1/1993 Edwards et al. ..... 271/189
5,227,854 A * 7/1993 Dastin et al. ..... 399/303
5,244,196 A * 9/1993 Walter et al. ..... 270/46
5,255,498 A * 10/1993 Hotchkiss et al. ..... 53/569
5,255,906 A * 10/1993 Ballard et al. ..... 271/246
5,330,316 A * 7/1994 Buckman et al. ..... 414/790.2
5,414,977 A * 5/1995 Cohen ..... 53/460
5,447,015 A * 9/1995 Belec et al. ..... 53/492
5,457,941 A * 10/1995 Long et al. ..... 53/460
5,533,720 A * 7/1996 Ahl et al. ..... 271/225
5,539,511 A * 7/1996 Wenthe et al. ..... 399/361
5,651,238 A * 7/1997 Belec et al. ..... 53/504
5,660,030 A * 8/1997 Auerbach et al. ..... 53/569
5,706,636 A 1/1998 Eckl
5,934,668 A * 8/1999 Debarber et al. ..... 271/245
5,954,323 A 9/1999 Emigh et al.
5,975,514 A * 11/1999 Emigh et al. ..... 270/58.06
6,155,031 A * 12/2000 Ballestrazzi et al. ..... 53/569
6,168,008 B1 1/2001 Sting et al.
6,199,348 B1 3/2001 Button et al.
6,209,866 B1 * 4/2001 Hosking et al. ..... 271/228

(Continued)

*Primary Examiner*—Stephen F. Gerrity
*Assistant Examiner*—Hemant M. Desai
(74) *Attorney, Agent, or Firm*—McDermott Will & Emery LLP

(57) ABSTRACT

A high-speed envelope transport and insertion machine includes a slip-drive system having a plurality of belts configured to move envelopes along an envelope path at a first speed, an envelope transmission device disposed to input envelopes into the slip-drive system, an envelope stuffing device comprising a registration member and a drive member having a plurality of spaced-apart gripping members disposed to move continously between the slip-drive system and the envelope stuffing device at a second speed less than the first speed. The path of the gripping members and the envelopes crosses within the slip-drive system to permit the gripping member to engage and grip the envelope. The gripping member is configured to release the envelope upon registration of the envelope against the registration member of the envelope stuffing device.

32 Claims, 47 Drawing Sheets

U.S. PATENT DOCUMENTS 6,240,710 B1 6/2001 Button et al.
6,619,650 B1 * 9/2003 Gysin et al. ..... 271/10.01
6,718,740 B1 * 4/2004 Rivenbark et al. ..... 53/569
2004/0201164 A1 * 10/2004 Flickner et al. ..... 271/189

* cited by examiner

ENVELOPE AND INSERT TRANSPORT AND INSERTION MACHINE

CROSS REFERENCE TO RELATED APPLICATIONS

This application claims priority from and is related to U.S. Provisional Application No. 60/462,319, filed Apr. 14, 2003, entitled "ENVELOPE AND INSERT TRANSPORT AND INSERTION MACHINE", by inventor Robin L. Heilman. The contents of the provisional application are hereby incorporated by reference in its entirety.

TECHNICAL FIELD

The technical field of the disclosure relates generally to a high-speed envelope transport and insertion machine.

BACKGROUND ART

One conventional envelope transport and insertion machine includes U.S. Pat. No. 4,604,849 issued on Aug. 12, 1986, and assigned on its face to Bell & Howell, shown in FIG. 1. The entire disclosure of U.S. Pat. No. 4,604,849 is hereby incorporated by reference herein, in its entirety. FIG. 1 shows a stack 36 of envelopes positioned on table 22 at a location where envelopes may be pulled from the bottom of the stack by a feeder mechanism (not shown) and then deposited on an intermittently operating chain drive 26 which carries the envelope to a stuffing location 39. Grippings 38 are attached to the envelope drive chain 26 at periodic locations. As the chain 26 intermittently moves an envelope in direction A to stuffing position 39, the envelope flap is opened by a rotating suction cup assembly 40, which holds the envelope flap in a captured or hold down position. The chain 26 then moves the envelope to its correct stuffing position, where its flap is held down by means of a plate 42 under which the flap extends. Then a pivoted arm 44 moves downward where vacuum sucker cups 46 attach themselves to the back side of the envelope. Next, the pivoted arm 44 raises the sucker cups 46 to hold open one side of the envelope, the flap being held down by plate 42. When the stack of inserts are deposited at stuffing station 66, kickers 50, 52 push the stationary inserts over plate 42 and into the envelope being held open by the suckers 46.

Conventional envelope transport and insertion machines also include, for example, U.S. Pat. No. 5,706,636 issued on Jan. 13, 1998 and assigned on its face to Böwe Systex AG, shown in FIG. 2. The entire disclosure of U.S. Pat. No. 5,706,636 is hereby incorporated by reference herein, in its entirety. In FIG. 2, envelopes 20 are pulled from a stack 1 by a pull-off device 2 and are transferred to a conveyor 5. Conveyor 5 is a revolving toothed belt provided with a plurality of grippings 17 configured to revolve around a horizontal axis. The conveyor 5 forms, with its upper strand 19, a horizontal conveying plane 13. A space between the two conveying planes 12, 13 includes a spreading device 7 for envelopes 20 and a link chain 10 configured to revolve in a vertical conveying plane. The spreading members 9 engage the envelopes along the conveying plane 13 and then raise them into the level of the conveying plane 12 of the conveyor 6 for envelope contents 21.

Another conventional envelope transport and insertion machine includes U.S. Pat. No. 5,954,323 issued on Sep. 21, 1999, and assigned on its face to Bell & Howell Mail Processing Systems, shown in FIGS. 3(*a*)–3(*b*). The entire disclosure of U.S. Pat. No. 5,954,323 is hereby incorporated by reference herein, in its entirety. FIGS. 3(*a*)–3(*b*) show insert packets 63 transported to an insertion station 64. Vacuum cups (not shown) remove an envelope from a stack of envelopes 67 and release it to an envelope conveying mechanism (not shown). As the envelope is conveyed, the envelope is opened by an envelope flap opener and the open flap is engaged and held in an open position by hold-down bar 72 until the envelope reaches the insertion station 64, whereupon an envelope flap gripping pinching foot (not shown) may be driven against the envelope flap to secure the envelope flap against an insertion plate 75 for the insertion process. An envelope opener or puffer (not shown) fills the envelope with air and envelope insertion fingers 79 are inserted to keep the envelope open. With the envelope opener and the insertion fingers holding the envelope fully open, a pusher fork 68 transfers insert package 63 into the envelope. Following insertion, the leading edge of the filled envelope is thereafter gripped by a dog on a chain conveyor (not shown) and transported for continued processing.

Still another conventional envelope transport and insertion machine described in U.S. Pat. No. 6,168,008 issued on Jan. 2, 2001 and assigned on its face to Bell & Howell GmbH of Friedberg, Del., is shown in FIG. 4. The entire disclosure of U.S. Pat. No. 6,168,008 is hereby incorporated by reference herein, in its entirety. In this publication, a handling station includes an intermittently driven, endless, rotating gripping chain 107 having gripping claws 108 mounted thereto. Below the upper reach of the gripping chain 107 are guide elements or cam elements 109 mounted to the frame structure and cam elements cooperate with cam follower fingers 110 of the respective gripping claws 108. During rotation of the gripping chain 107, such that as the cam follower finger 110 passes the fixedly mounted cams or ramps 109, the cam action opens the gripping claws 108 against a spring bias. The gripping claws 108 serve for gripping the leading edge of a respective envelope 90 which is pulled by the respective gripping claw 108 within a guiding channel provided in the region of the gripping chain 107, into a position, in which inserting of the document or the set of documents 105 takes place. In a corresponding position the gripping claw 108 is reopened after the envelope has been filled so that the filled envelope is delivered.

In another conventional envelope transport and insertion machine, described in U.S. Pat. No. 6,199,348 issued on Mar. 13, 2001 and assigned on its face to Bell & Howell Mail and Messaging Technologies Company of Durham, N.C., is shown in FIGS. 5(*a*)–5(*b*). The entire disclosure of U.S. Pat. No. 6,199,348 is hereby incorporated by reference herein, in its entirety. In this publication, the envelope packing assembly 104 comprises a packing prompter 106 for urging each consecutive envelope from the top of the second buffer stack 92 toward a threading means 103 and a packing plate 111. Packing prompter 106 removes an uppermost envelope from the second buffer stack 92 and urges it toward the threading means 103. Packing prompter 106 comprises a first and second roller 112,114. First roller 112 rests atop the second buffer stack 92 to provide the initial force to each envelope 4. The second roller 114 then guides the displaced envelope to the bridge conveyor 138, which comprises two rollers with a belt configured therearound such that envelopes leaving the packing prompter 106 are guided onto threading roller 103.

In still another conventional envelope transport and insertion machine described in U.S. Pat. No. 6,240,710 issued on Jun. 5, 2001 and assigned on its face to Bell & Howell Mail; Messaging Technologies Company of Durham, N.C., is shown in FIGS. 6(*a*)–6(*b*). The entire disclosure of U.S. Pat.

No. 6,240,710 is hereby incorporated by reference herein, in its entirety. An envelope is positioned in a pre-stage area upon deck plate 28 and is then moved out of the pre-stage area by rotation of D-rollers 54. Flipper rollers 58 rotate to bias the flap up ramp 70. The D-rollers 54 move the envelope over stage rollers 62. FIG. 6(*a*) shows that discharge plate 78 is lowered such that the envelope is clamped between stage roller 62 and stage idler roller 61. Rotation of stage roller 62 then moves the envelope up spring guides 68 and onto thread roller 80. FIG. 6(*b*) shows discharge plate 78 is raised to nip the envelope flap between the thread roller 80 and the packing plate 82. Rotation of thread roller 80 thus threads the envelope onto the packing plate 82.

However, despite the advances realized by the aforementioned envelope transport and insertion machines, significant improvements can still be realized in transportation of envelopes from a staging area to an envelope stuffing area at a high rate of speed while maintaining envelope registration during such transport and assuring that the envelope is aligned properly in the stuffing area. Moreover, significant improvements can be realized in the speed at which envelopes are transported and stuffed or filled.

SUMMARY OF THE DISCLOSURE

A high-speed envelope transport and insertion machine includes a slip-drive system comprising an upper drive portion and a lower drive portion, each of the upper drive portion and a lower drive portion comprising a plurality of laterally spaced apart belts disposed about a plurality of pulley elements and at least one driving member to move the plurality of belts of the upper drive portion and lower drive portion at a first speed. An envelope transmission device is disposed to input envelopes into the slip-drive between the plurality of belts of the upper drive portion and lower drive portion. A plurality of gripping members are disposed at intervals along a first drive member comprising a chain or belt disposed to pass between the plurality of laterally spaced apart belts and between the upper drive portion and lower drive portion. The first drive member is driven at a second speed lower than the first speed. Envelopes input into the slip-drive are moved at a speed greater than a speed of the gripping members so that an envelope borne by the slip-drive overtakes a corresponding one of the plurality of gripping members and is registered therein, at which time the gripping member closes to retain the envelope.

In another aspect, a high-speed envelope transport and insertion machine includes a slip-drive system comprising an upper drive portion and a lower drive portion. The upper and lower drive portions comprise a plurality of laterally spaced apart belts disposed about a plurality of pulley elements and at least one driving member to move the plurality of belts of the upper drive portion and lower drive portion at a first speed. An envelope transmission device is disposed to input envelopes into the slip-drive between the plurality of belts of the upper and lower drive portions. A plurality of gripping members are disposed at intervals along a first drive member comprising a chain or belt and are disposed to pass between the plurality of laterally spaced apart belts and between the upper and lower drive portions. The first drive member is driven at a second speed lower than the first speed and is continuously in motion during operation of the high-speed envelope transport and insertion machine. Each of the gripping members comprises a spring-loaded, normally-closed rotatable gripping member jaw configured to open and close while the gripping member is in motion. Envelopes input into the slip-drive are moved at a speed greater than a speed of the gripping members, so that an envelope borne by the slip-drive overtakes a corresponding one of the plurality of gripping members and is registered therein. Upon registration of an envelope within a gripping member, the gripping member closes to retain the envelope.

In yet another aspect, there is provided a high-speed envelope transport and insertion machine including a slip-drive system having a plurality of belts configured to move envelopes along an envelope path at a first speed, an envelope transmission device disposed to input envelopes into the slip-drive system, an envelope stuffing device comprising a registration member and a drive member having a plurality of spaced-apart gripping members disposed to move continously between the slip-drive system and the envelope stuffing device at a second speed less than the first speed. The path of the gripping members and the envelopes crosses within the slip-drive system to permit the gripping member to engage and grip the envelope. The gripping member is configured to release the envelope upon registration of the envelope against the registration member of the envelope stuffing device.

Other aspects and advantages of the present disclosure will become apparent to those skilled in this art from the following description of preferred aspects taken in conjunction with the accompanying drawings. As will be realized, the disclosed concepts are capable of other and different embodiments, and its details are capable of modifications in various obvious respects, all without departing from the spirit thereof. Accordingly, the drawings, disclosed aspects, and description are to be regarded as illustrative in nature, and not as restrictive.

BRIEF DESCRIPTION OF THE DRAWINGS

Features and advantages of disclosed examples herein will be apparent from the following illustrations in which like referenced characters refer to the same parts throughout the various views. The drawings are not necessarily to scale, emphasis instead being placed upon illustrating principles of the disclosed examples.

DETAILED DESCRIPTION

Figure 1:
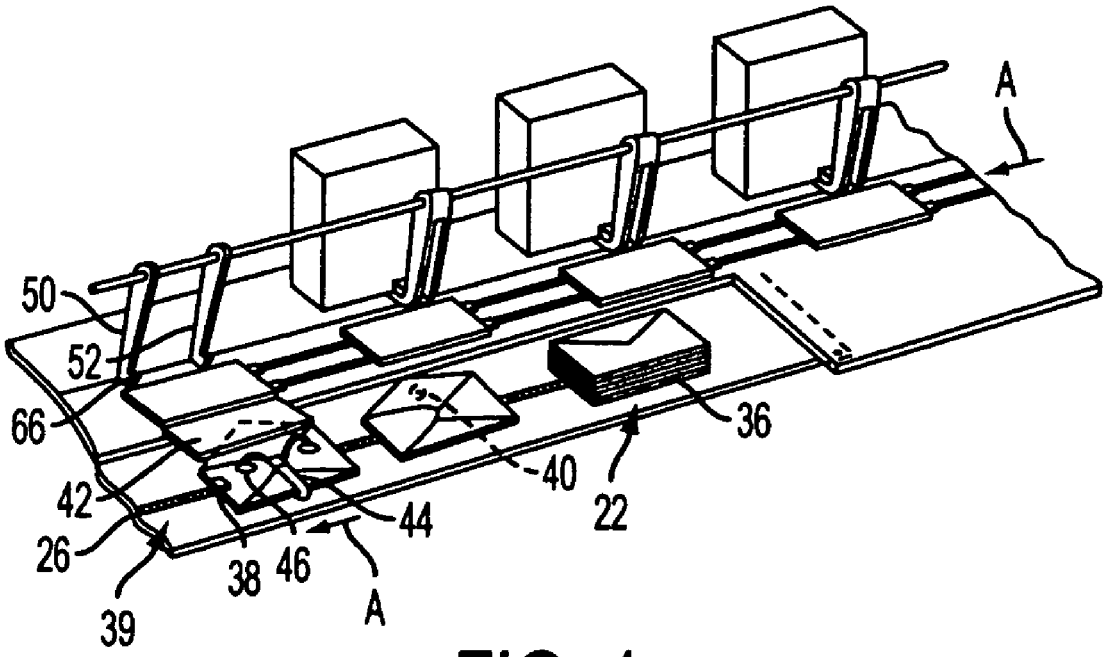
FIG. 1 (BACKGROUND ART)
FIG. 1 is a front perspective view a first conventional envelope transport and insertion machine.
Figure 2:
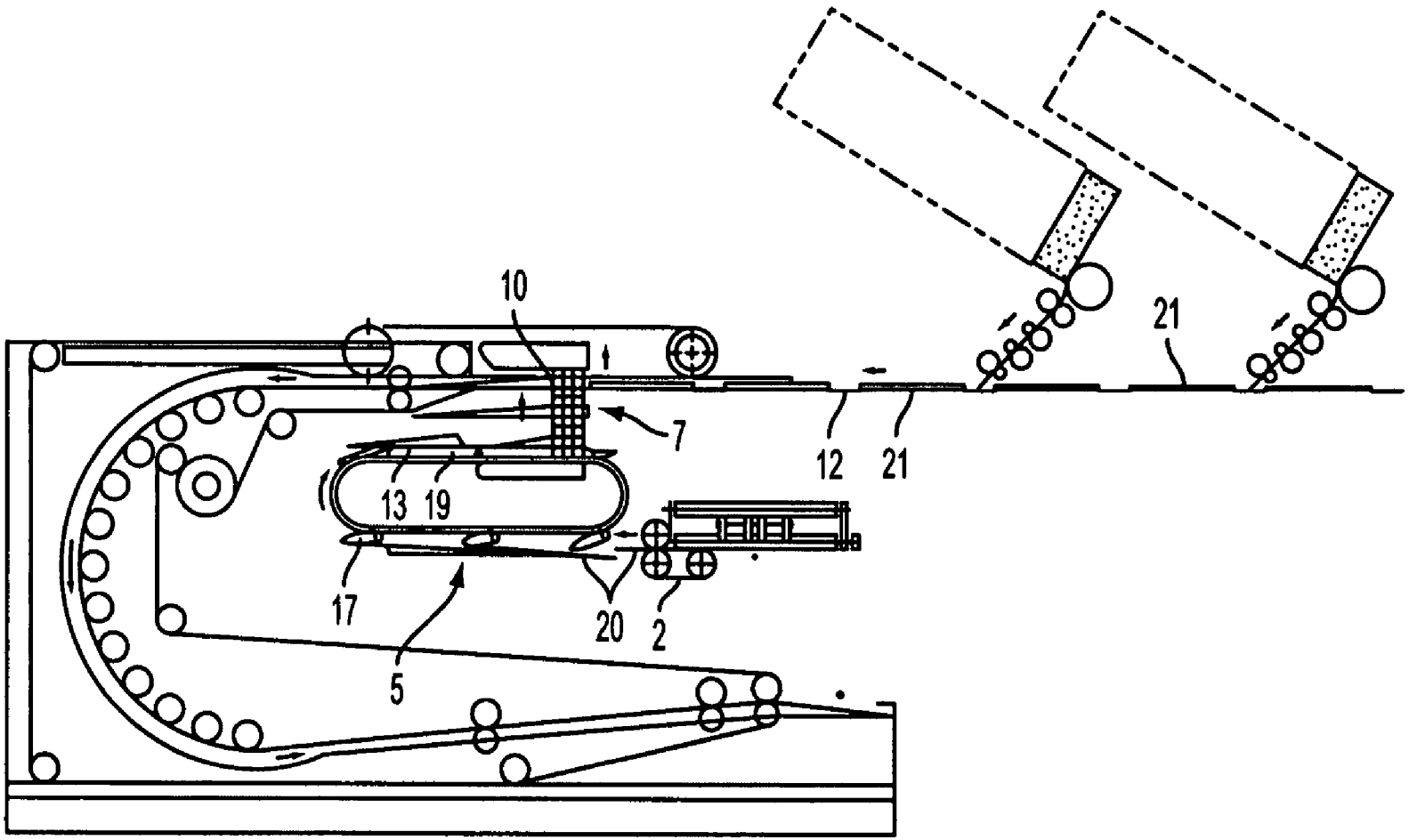
FIG. 2 (BACKGROUND ART)
FIG. 2 is a side view of a second conventional envelope transport and insertion machine.
Figure 3B:
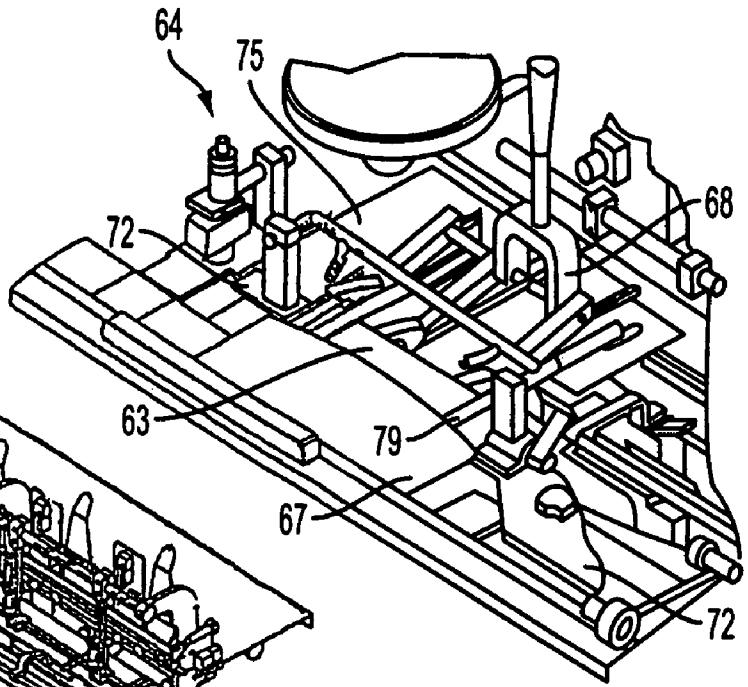
FIG. 3(b) (BACKGROUND ART)
FIGS. 3(*a*)–3(*b*) are front perspective views of a third conventional envelope transport and insertion machine.
Figure 3A:
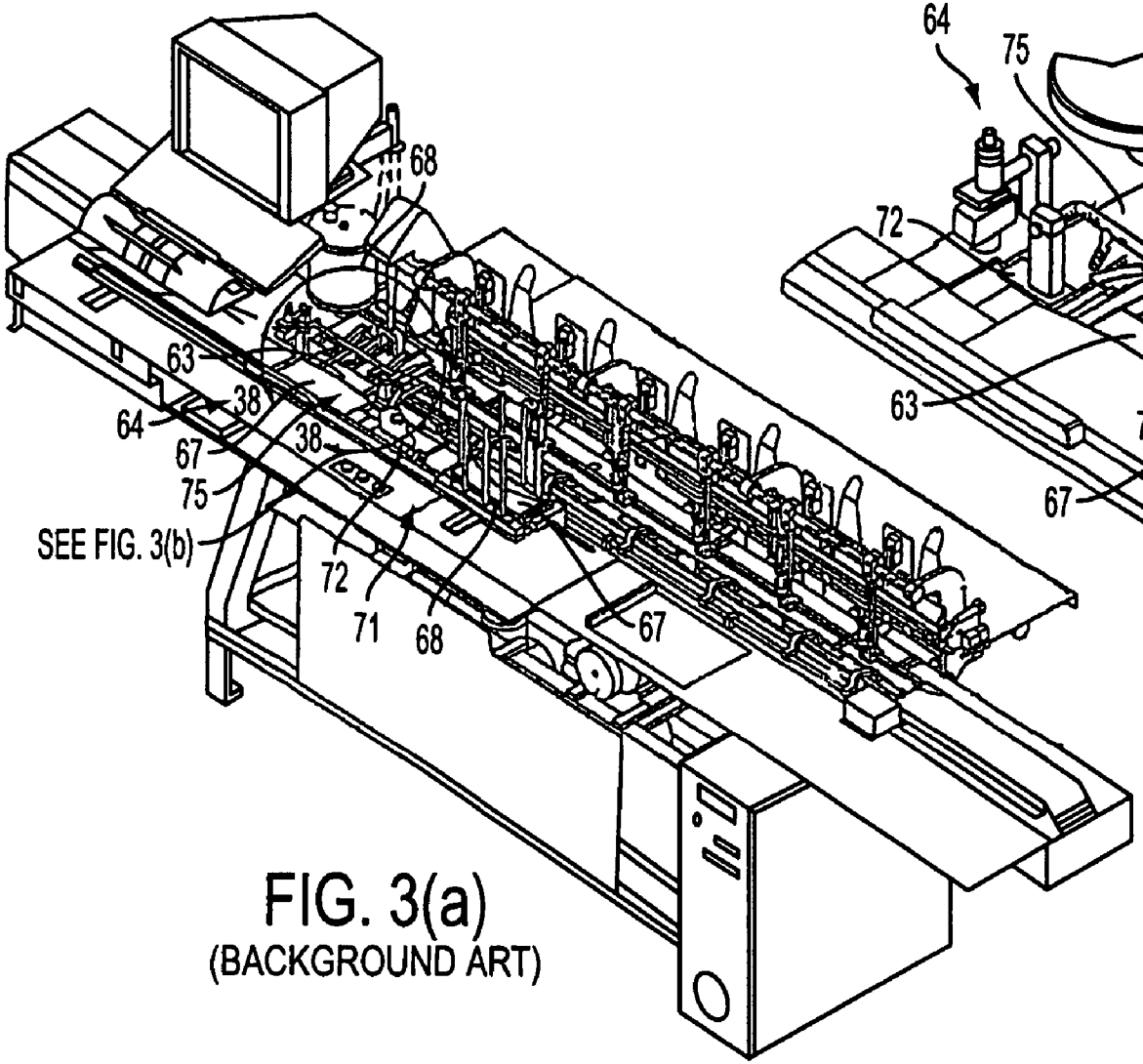
FIG. 3(a) (BACKGROUND ART)
Figure 4:
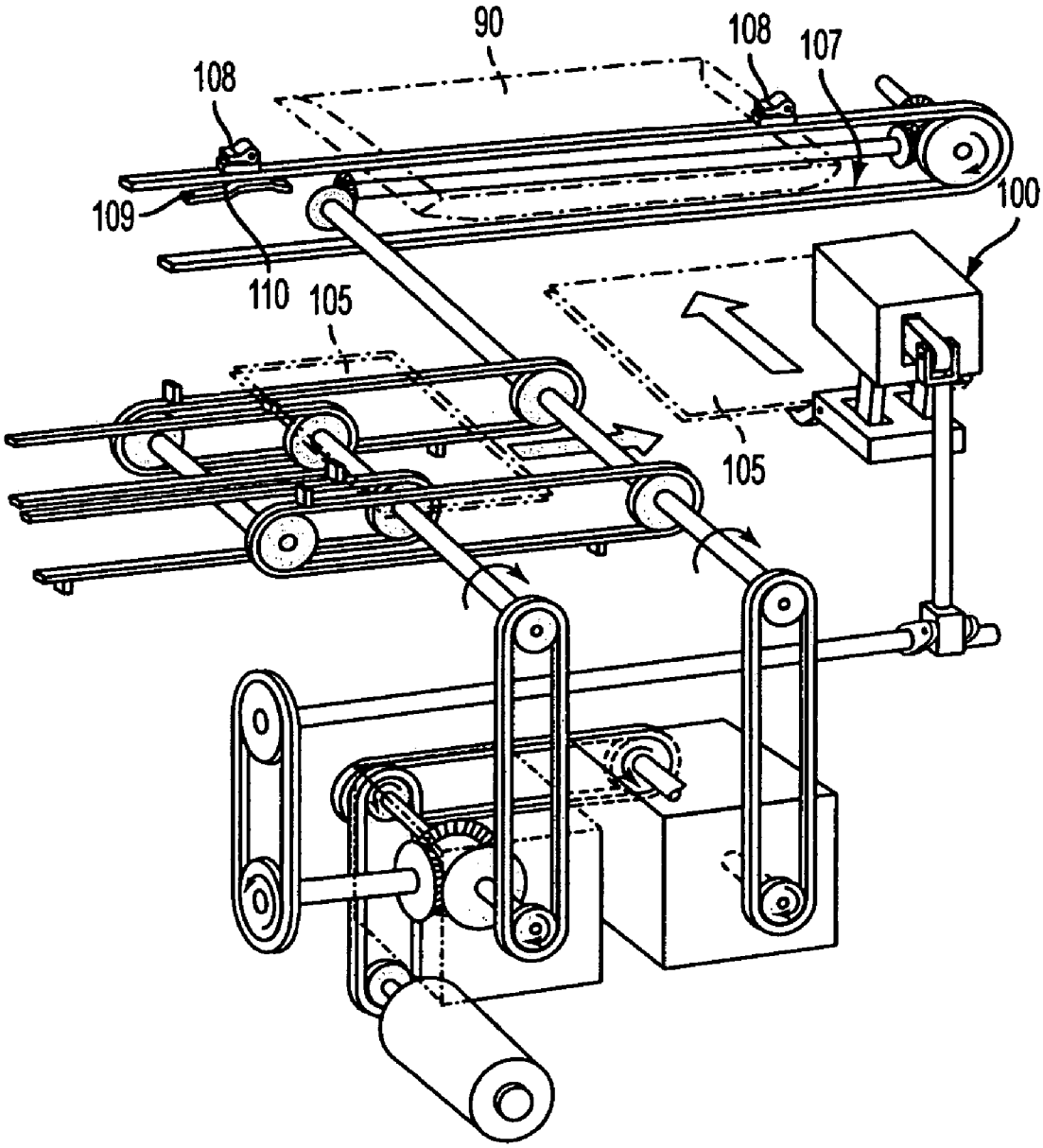
FIG. 4 (BACKGROUND ART)
FIG. 4 is a front perspective view of a fourth conventional envelope transport and insertion machine.
Figure 5A:
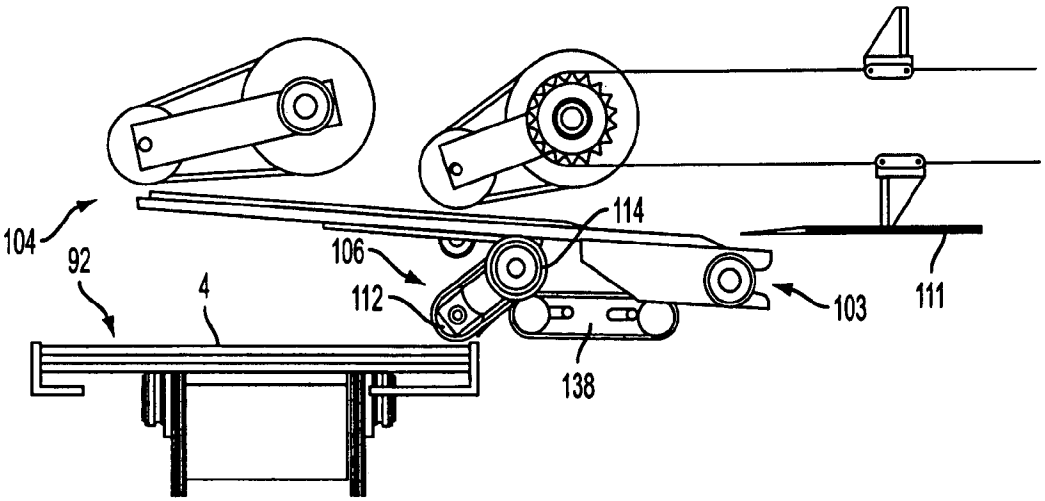
FIG. 5(a) (BACKGROUND ART)
FIGS. 5(*a*)–5(*b*) are side views of a fifth conventional envelope transport and insertion machine.
Figure 5B:
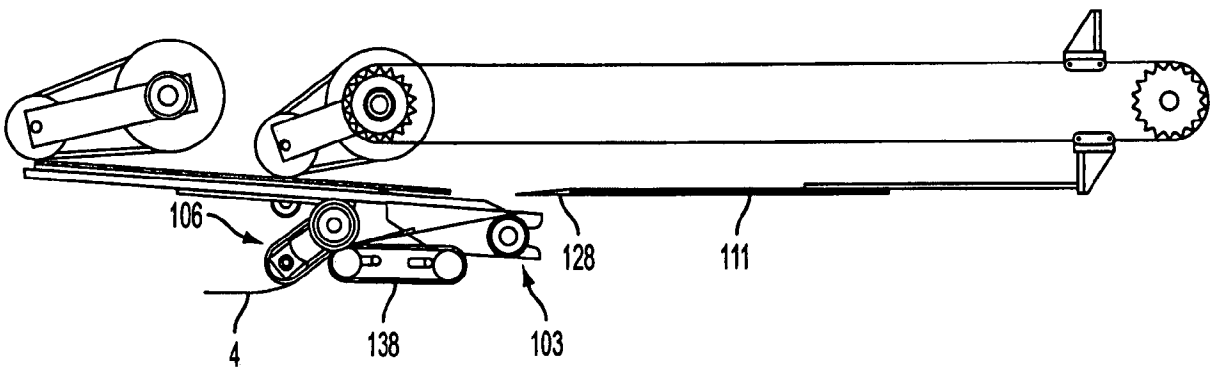
FIG. 5(b) (BACKGROUND ART)
Figure 6A:
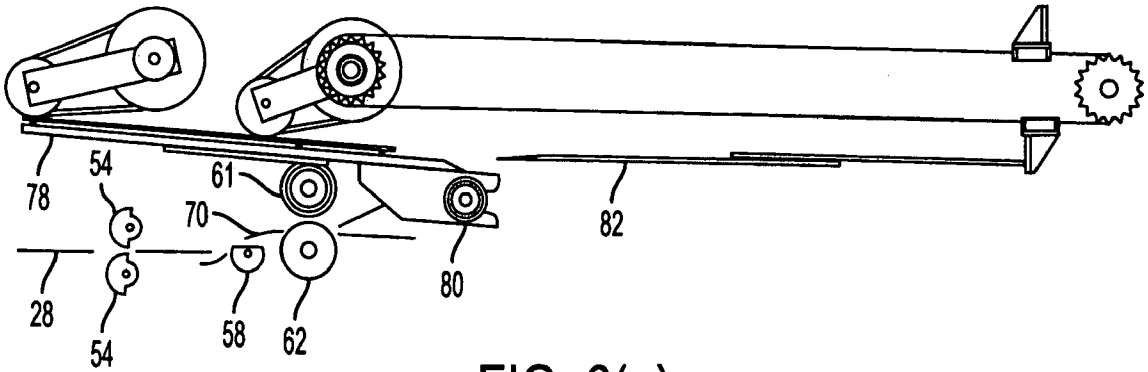
FIG. 6(a) (BACKGROUND ART)
FIGS. 6(*a*)–6(*b*) are side views of a sixth conventional envelope transport and insertion machine.
Figure 6B:
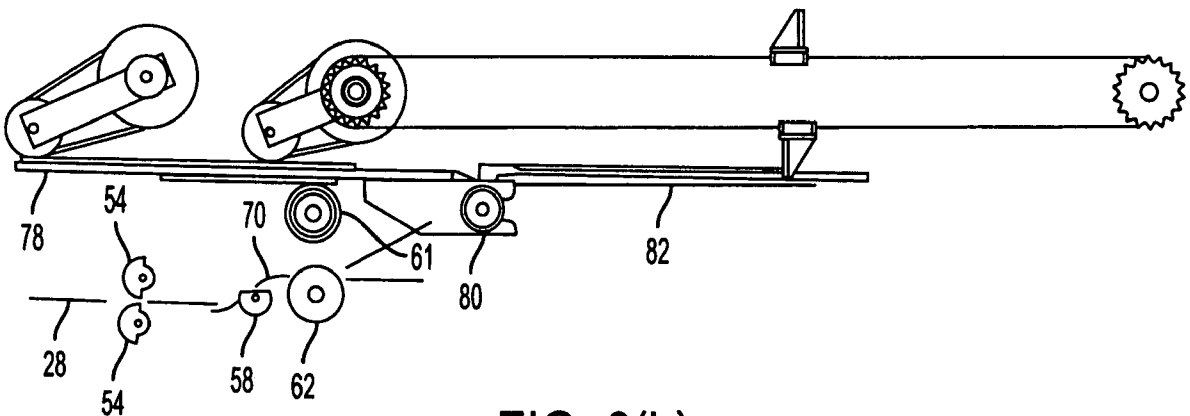
FIG. 6(b) (BACKGROUND ART)
Figure 7:
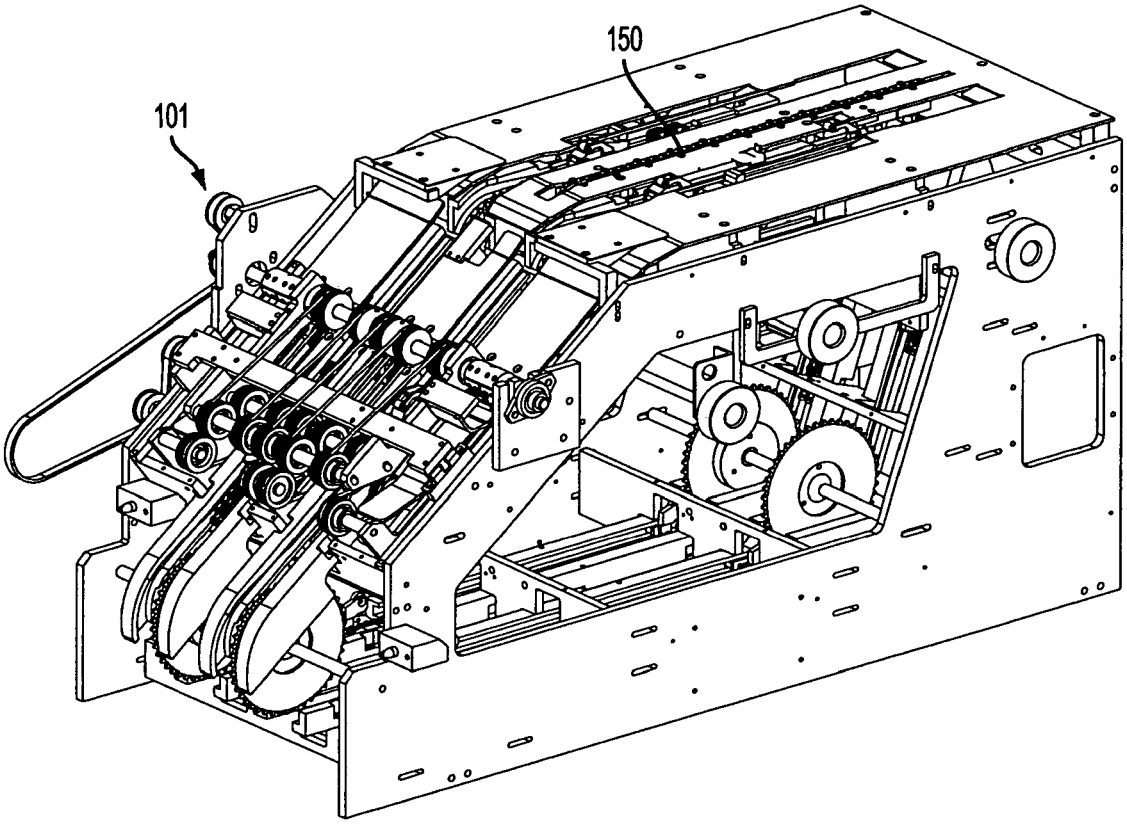
FIG. 7 is a front perspective view of an embodiment of the present concepts.

A general, partially denuded perspective view of a high-speed envelope transport and insertion machine 101, generally showing an envelope stuffing or insertion area 150, in accord with the present concepts is shown in FIG. 7, constituent parts and systems of which are described more fully below. With regard to FIGS. 8 and 9, there is shown a slip-drive system 200, which utilizes belts (e.g., urethane belts) in combination with pulley elements and a driving member to transport an envelope input into the slip-drive at the bottom-left side of the slip-drive, as shown, at a speed greater than a speed of a pair of constantly moving gripping members 250. The slip drive 200 may be configured to maintain a speed of an input envelope, decelerate an input envelope, or accelerate an input envelope. It is merely required that the speed of the envelope within the slip drive 200 be sufficient to overtake a gripping members 250 configured to pass through the slip drive 200 at a predetermined interval. The gripping members 250 are disposed on chain 251 and are configured to open slightly while travelling within the slip drive to receive an envelope carried by the slip drive belts. In one aspect of the present concepts, described more fully below, the slip drive belts are used to accelerate the envelope into the open jaws of the gripping members 250. Once the envelope is registered in the gripping members 250, the gripping members close to hold the envelope.

Figure 8:
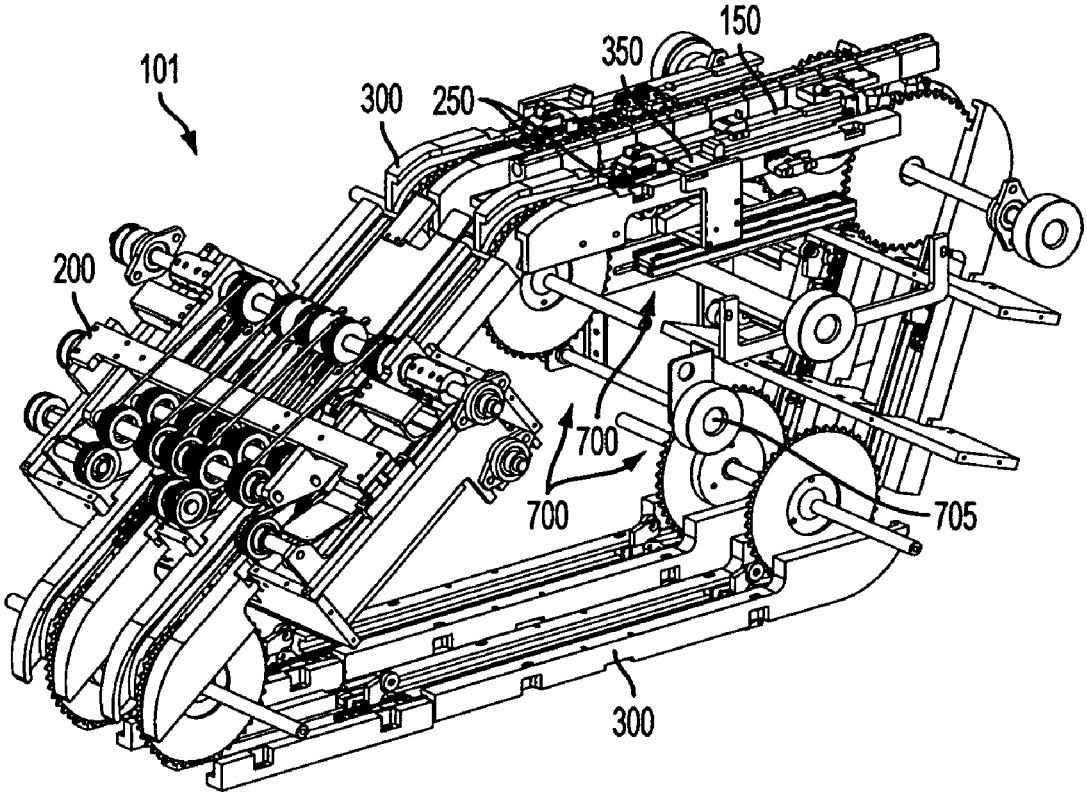
FIG. 8 is a front partially-denuded perspective view of an embodiment of the present concepts.
Figure 9:
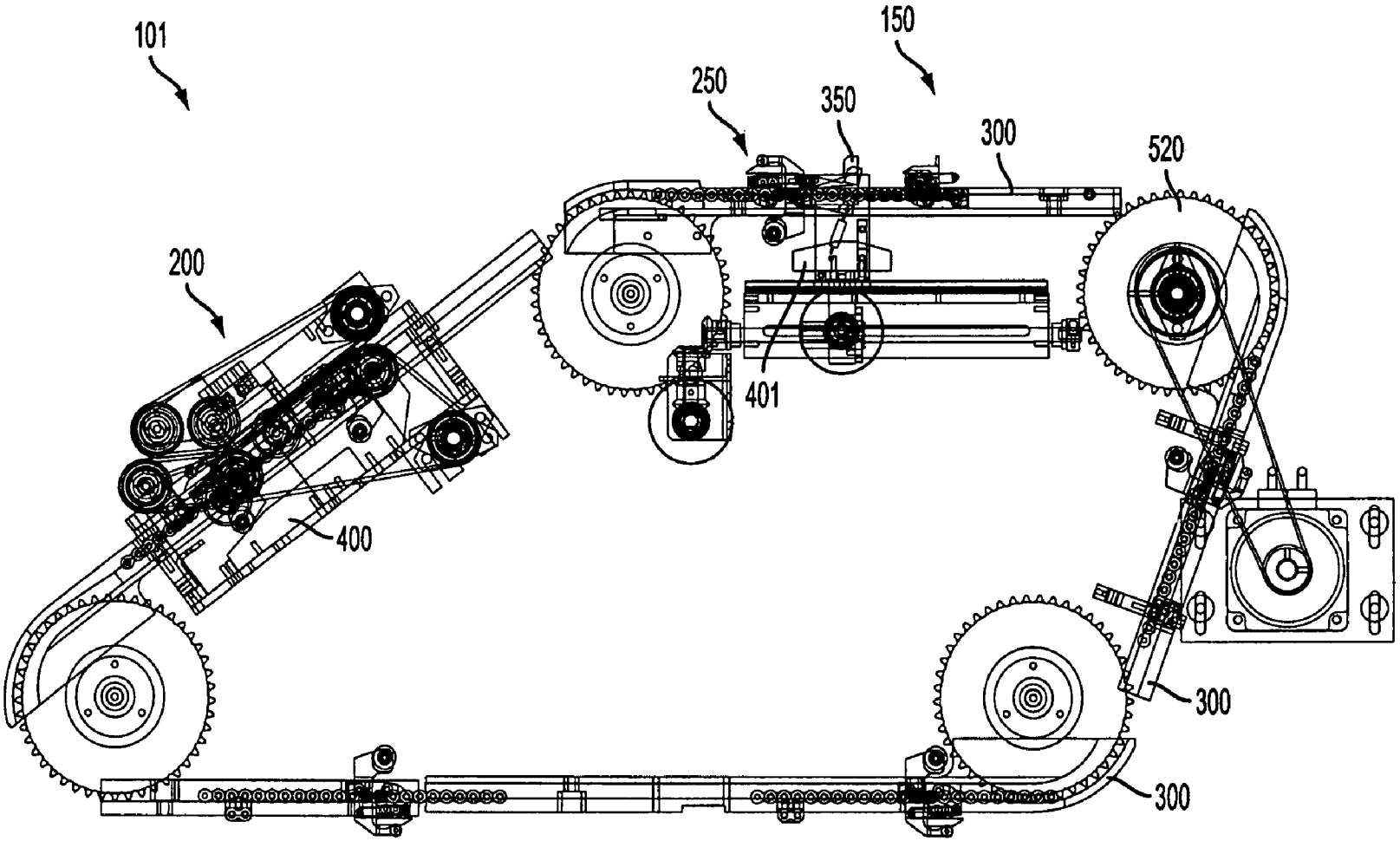
FIG. 9 is a partial side view of an embodiment of the present concepts.

The envelope is then transported by the gripping members 250 to the stuffing area 150, shown in FIGS. 8 and 9. Envelope registration stops 350, activated by the gripping members 250, are biased into the path of the envelope as the gripping members open to release the envelope. The envelope registers against the registration stops 350. The envelope registration stops 350 then drop out of the way of the envelope, allowing the envelope to be moved downstream in the stuffing area 150 to be filled. In general, the present embodiments advantageously utilize sets of two grippings for each envelope so there are two contact points for the envelope to register against. One aspect of the present embodiment of a high-speed envelope transport and insertion machine utilizes five sets of gripping members 250, which allows plural envelopes to be transported at the same time. The gripping members 250 are continuously in motion and designated pairs of grippings open and close simultaneously while in motion.

The gripping members 250, as described herein, are capable of traveling at a rate of up to about 100 inches per second. For a spacing between each set of gripping members of 17.25", the system to reliably handle a range of envelope sizes from 3⅞" to 10" in height at rates up to 18,000 envelopes per hour. Decreasing the spacing between the sets of gripping members and changing the number of sets of grippings permits envelopes up to 6 inches in height to be reliably transported at rates in excess of 25,000 envelopes per hour.

Figure 10:
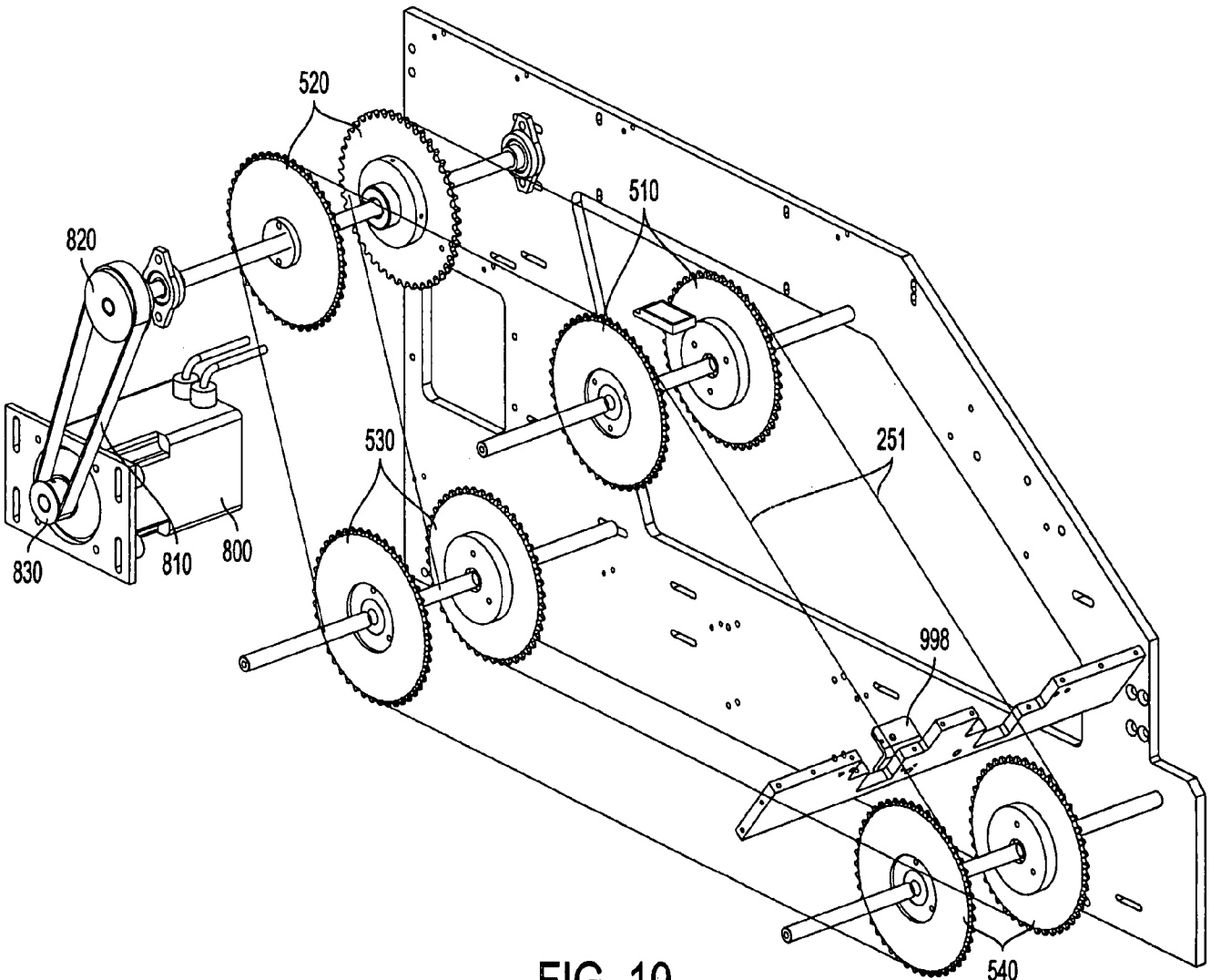
FIG. 10 is a front perspective view of a drive system in accord with the present concepts.

Gripping members 250 are disposed on chain 251, which is in turn disposed around sprockets 510, 520, 530, and 540, as shown in FIG. 10. Motor 800 drives pulleys 830, 820 via belt 810 to drive the shaft about which sprockets 520 are mounted. In one aspect, motor 800 is Compumotor Model No. CM342HJ-112693, manufactured by Parker Hannifin of Cleveland, Ohio, although other conventional motors may be utilized to drive belt 810 and, in turn, chain 251. Belt 810 is, in one aspect, a 5 mm HTD belt disposed around pulleys 820 and 830. In the example, pulleys 820 and 830 are Stock Drive Products Model Nos. A6A25M036NF1510 (57.3 mm pitch diameter) and A6A25M020DF1508 (31.8 mm pitch diameter), respectively. The drive sprockets 520 are, in one aspect, 45T ⅜ pitch sprockets (Manufacturer Part No. 35B45) made by Putnam Precision Molding Inc. Sprockets 510, 530, and 540 are, in one aspect, 45T ⅜ pitch sprockets (Manufacturer Part No. 35645) made from Nylatron GS-51 by Putnam Precision Molding Inc. and possess a pitch diameter of 136.55 mm.

Figure 20A:
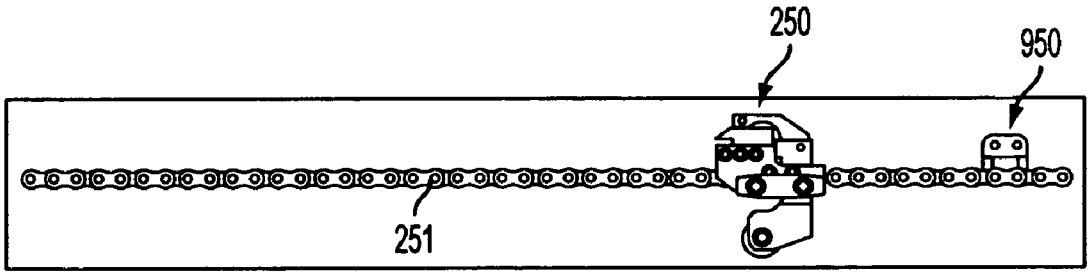
FIGS. 20(*a*)–20(*b*) show side views of left and right chains bearing a gripping member, one of the chains also bearing a position marking device in accord with the present concepts.
Figure 20B:
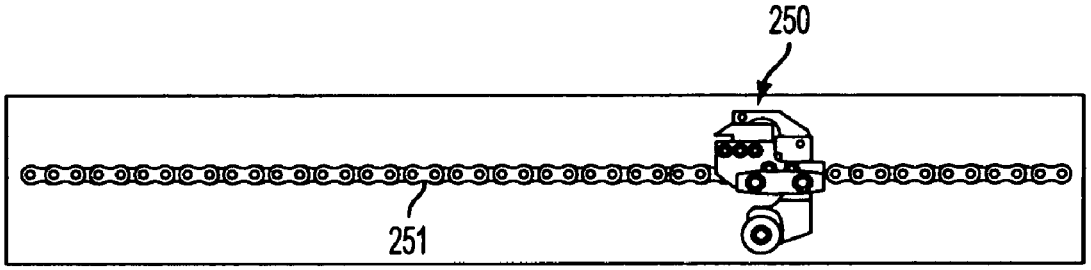

Also shown in FIG. 10 is a homing sensor mount 998. One or more sensors (not shown) may be mounted here or at other positions within the machine. As shown in FIG. 20(*a*), at least one of the drive chains 251 is provided with a sensor elements 950 that is able to be detected by a sensor (not shown) such as, but not limited to, a magnetic sensor, optical sensor, or physical switch mounted on homing sensor mount 998. In the illustrated example, the leading edge of the sensor element 950 is disposed 87.5 mm behind the trailer edge of the gripping member 250. A control system of the high-speed envelope transport and insertion machine 101 is therefore enabled to determine, at any instant, an exact position of the sensor elements 950 relative to the drive chain 251 and the gripping members 250 relative to the sensor elements 950, based on known relations therebetween. A sensor may optionally be provided on both drive chains 251. Optionally, multiple sensor elements 950 may be provided on one or both of the drive chains. Still further, the sensor element(s) 950 may be omitted and, in lieu thereof, the gripping members 250 themselves could comprise a suitable drive chain locating means, such as by interruption of an optical sensor optical path by the passage of a gripping member 250.

In the example provided herein, the axial distance between the sprockets is selected to be 4.64 inches (118 mm). The distance between the sprockets could be varied and could easily range up to about 6.5 inches apart. In the example provided herein, the distance between sprockets was selected to ensure compatibility with systems adjacent stuffing area 150, but is not considered to be limiting on the aspects disclosed herein.

Figure 11:
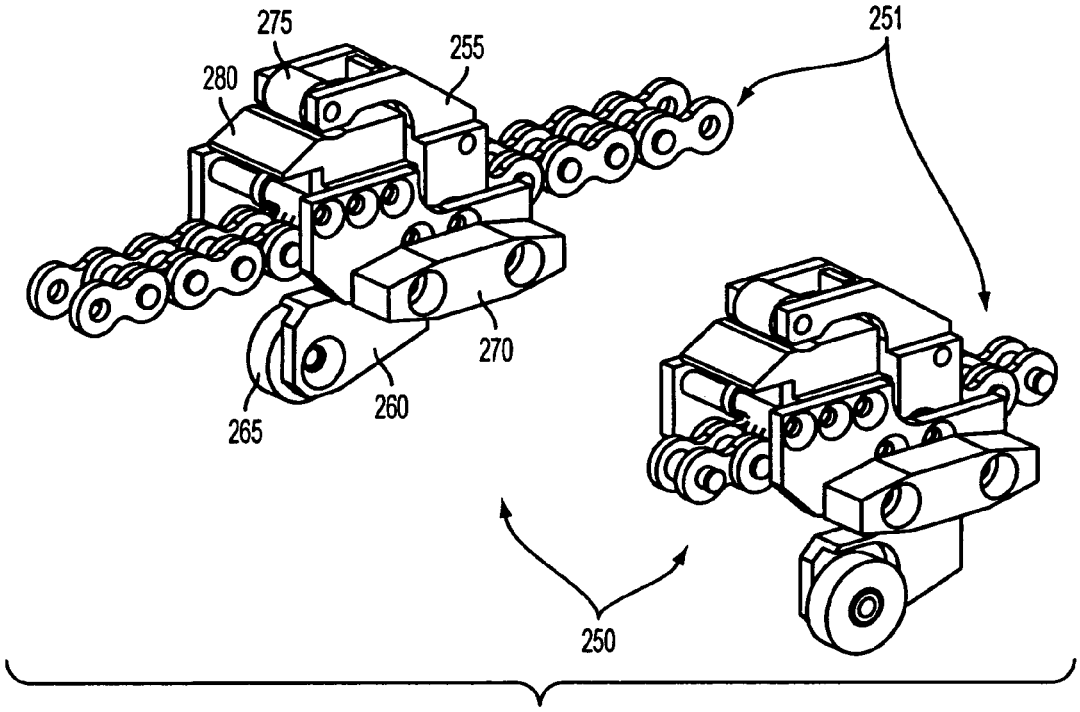
FIG. 11 is a front perspective view of a gripping device in accord with the present concepts.
Figure 12A:
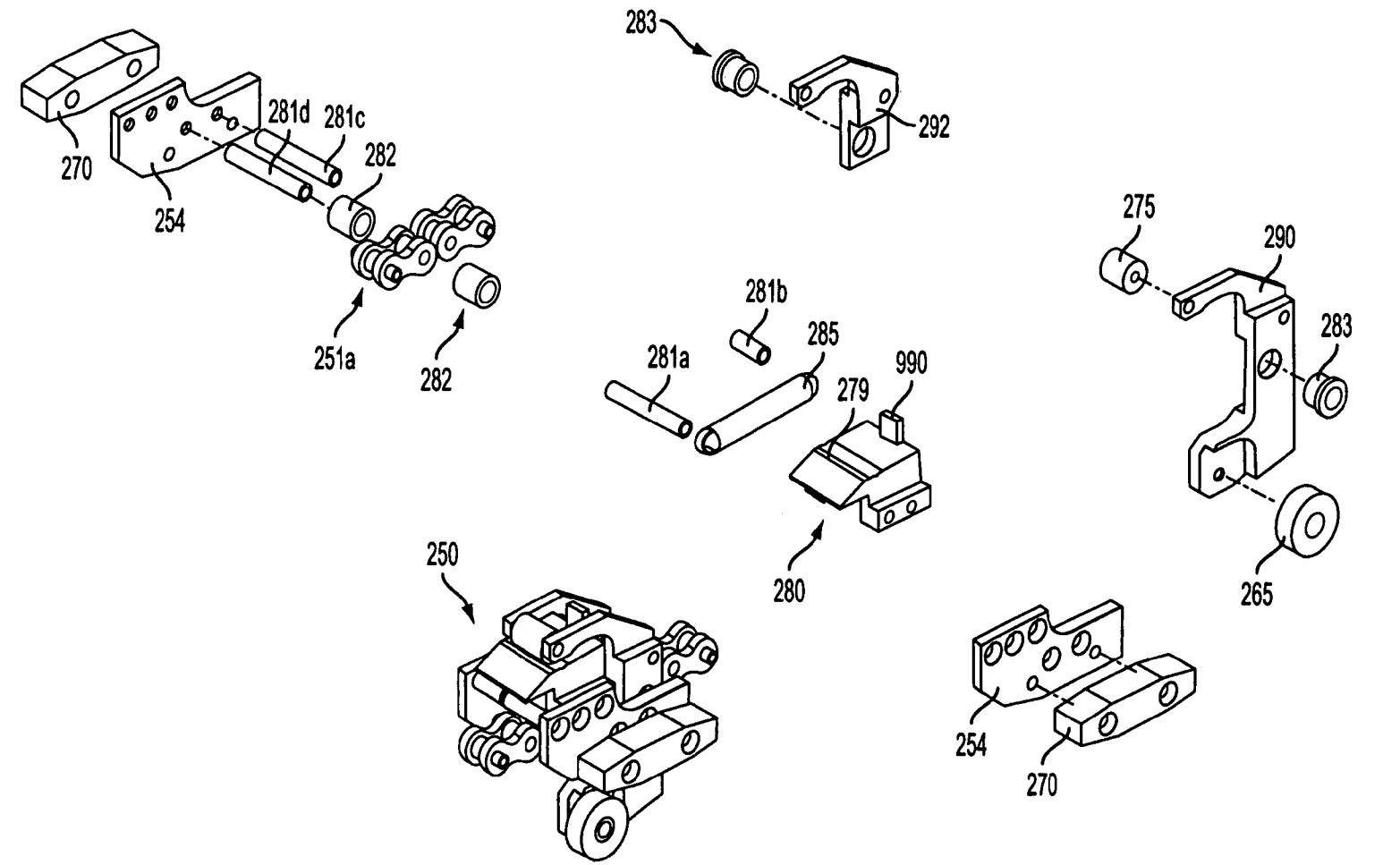
FIGS. 12(*a*)–12(*d*) show front perspective views of a gripping device in various stages of assembly in accord with the present concepts.
Figure 12B:
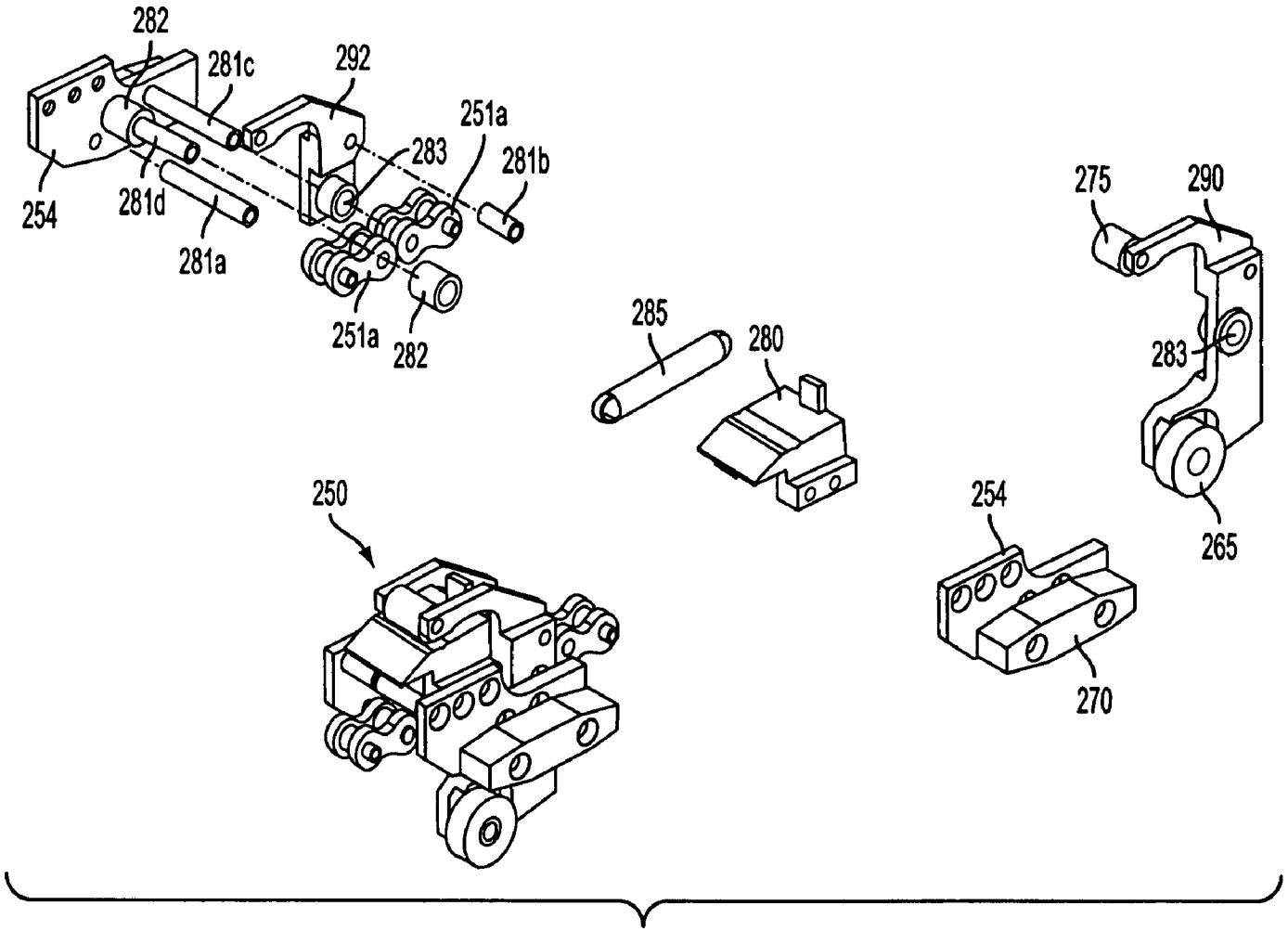
Figure 12C:
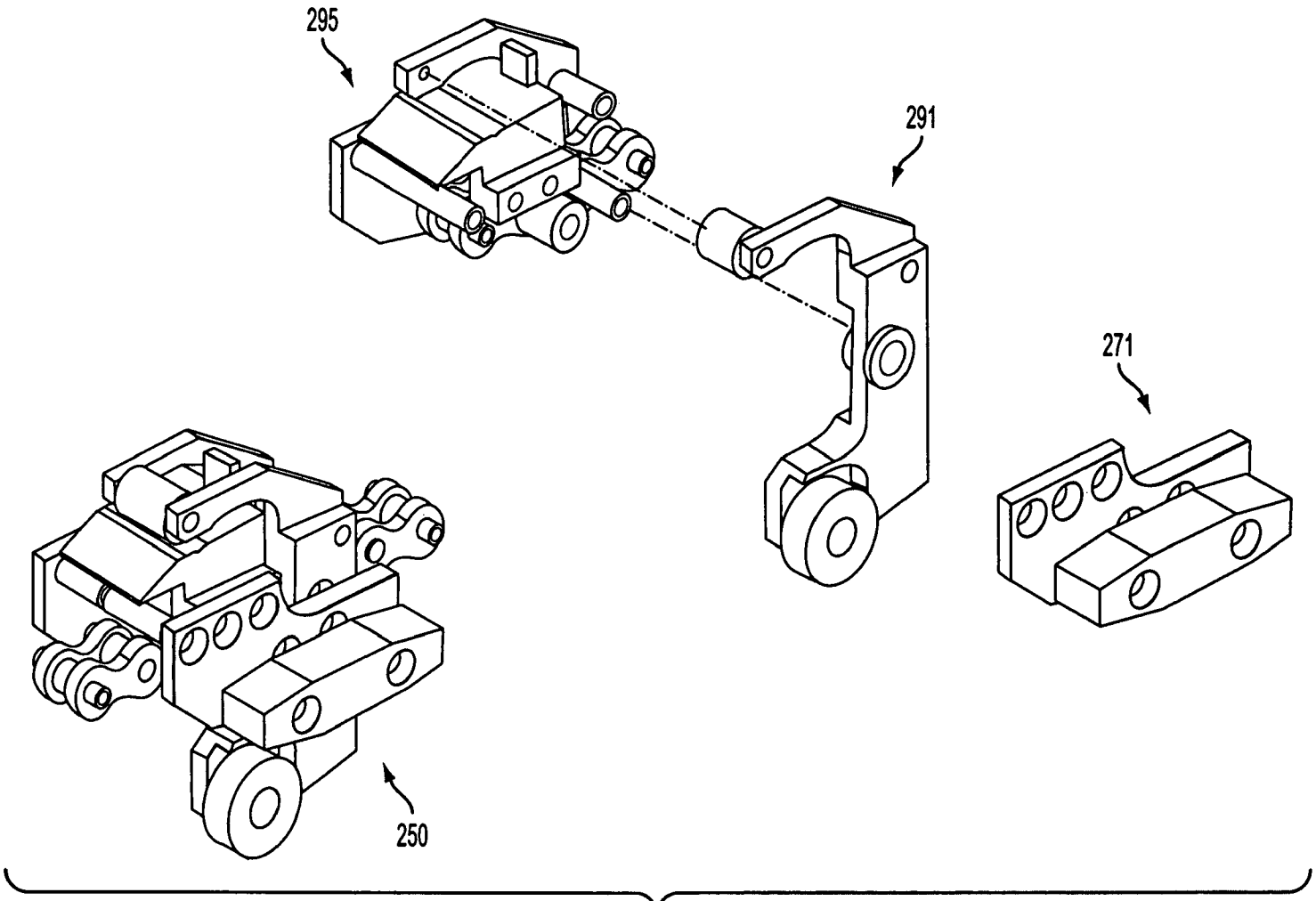
Figure 12D:
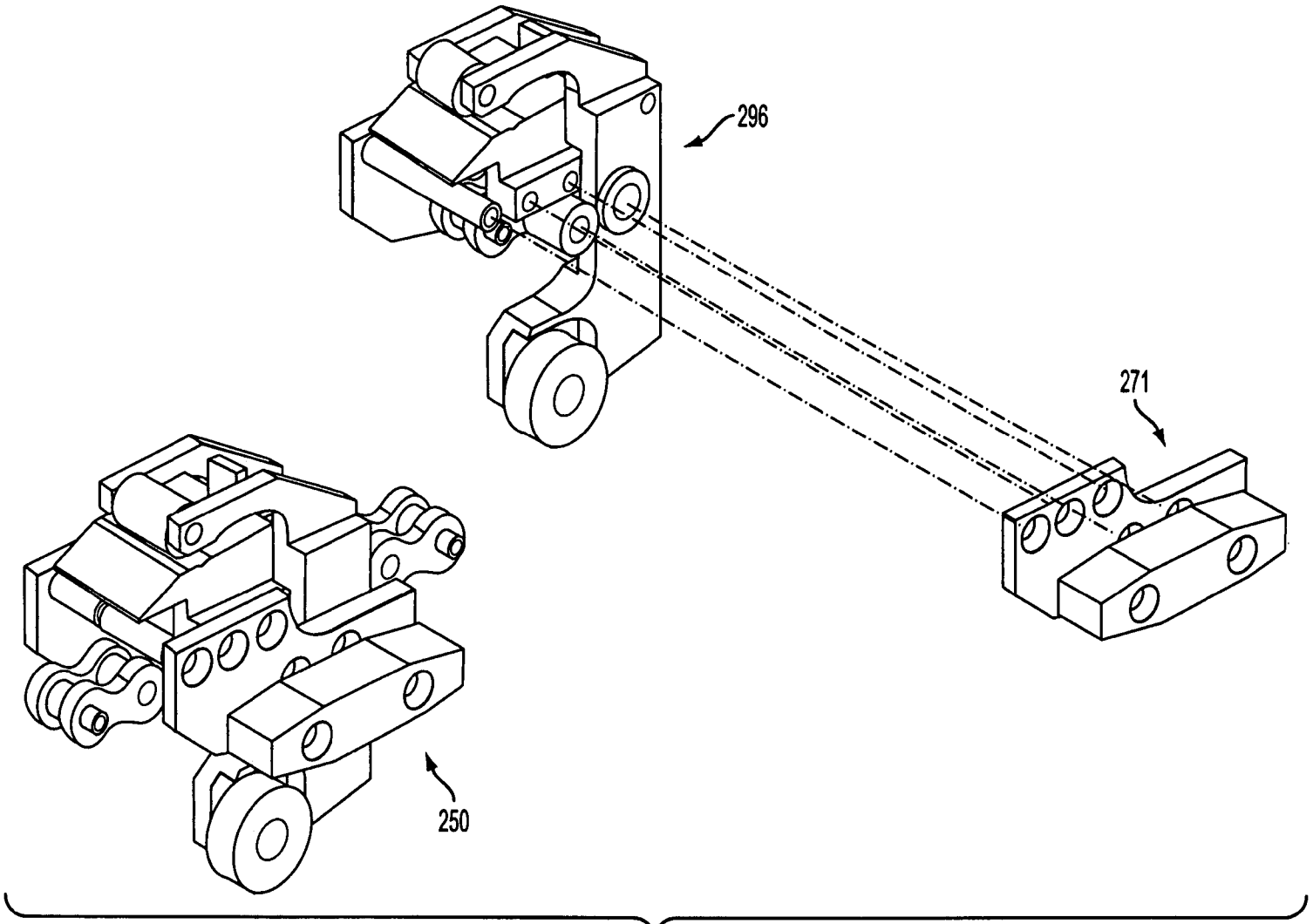

Gripping members 250, shown in FIG. 11 for example, were devised in accord with the present concepts to provide a continuously moving, constant velocity, high speed mechanism that will quickly and reliably open, grab the leading edge of an envelope, transport the envelope and release the envelope in stuffing area 150 that is able to handle a variety of different sized envelopes at speeds up to and even greater than 100 inches per second. In the aforementioned conventional systems, on the other hand, envelopes are acquired using means such as a rotary drum, which is limited to small envelopes only, or gripping members which must stop before they can open.

Gripping member 250 is spring-loaded (see, e.g., spring 285 in FIGS. 12(*a*)–(*d*) and 13) in the closed position to assure a firm grip on the leading edge of an envelope. In one aspect, the spring 285 is a Model # LE-034C-1, manufactured by Lee Spring Co., which possesses a spring constant of 10.8 LB/IN. As configured in the example, spring 285 is 1.00 inches long. When the gripping member 250 is closed the spring is extended 0.44 inches, yielding a force of 4.75 lbs. When the gripping member 250 is open, the spring is extended 0.56 inches, yielding a force of 6.10 lbs.

Gripping member 250 has a seat 280 which may advantageously comprise a hardened steel seat to ensure the gripping member seat will withstand the long-term effects of impact on the seat by the gripping member jaw 255 when it slams shut. A carbon nitride heat treatment to a depth of 0.020–0.025 inches and a hardness of RC 52 provides one satisfactory example. Non-metallic seat materials having a relatively high hardness and durability, such as a urethane seat, may also be used in place of the hardened steel seat.

An example of a gripping member seat 280 is shown in FIGS. 11, 12(*a*)–12(*d*) and 15, for example. In this example, a top-most surface of the gripping member seat 280 is substantially planar, to facilitate receipt of an envelope by the gripping member. A leading edge of the top-most surface is, in the depicted example, chamfered. An upwardly protruding (e.g., 6.5 mm) and rearwardly disposed (23.0 mm from leading edge) envelope stop member 990 is provided to ensure proper registration of an envelope with respect to the gripping member 250. In one aspect thereof, the envelope stop member 990 is centrally placed widthwise and possesses a width of 6.0 mm, although configurations of other shapes and placement are considered equally viable, provided the placement does not interfere with the gripping member jaw 255.

The bottom portion of seat 280 defines a U-shaped cavity. It is within this cavity that a spring 285 is disposed to bias the gripping member jaw 255 toward the seat 280, as is further shown and described below.

An optional forwardly placed depression 279 is centered 11.0 mm from a leading edge of the gripping member 250 and possesses a radius of 5 mm and a depth of about 0.5 mm. Depression 279 corresponds with, in one example, a gripping member jaw shaft 275, which may be made of a hardened steel, such as an AISI-C4140, subjected to a carbon nitride heat treatment to a depth of 0.020–0.025 inches and a hardness of RC 52, although other non-metallic durable materials having a relatively high hardness, such as a urethane, may also be used in place of the hardened steel. In one aspect thereof, shaft 275 has a diameter of 8.00 mm and a width of about 9.1 mm with a central through-hole configured to receive a screw (or one screw from each side), which secures each of side members 290 and 292 to the shaft 275.

The illustrated example of a gripping member jaw 255, shown in FIG. 11, comprises two side members 290, 292, as shown in FIG. 12(*a*). Shaft 275 is disposed between these side members 290, 292 and is rotatably secured therebetween by, for example, a steel shaft having a diameter of about 3.1 mm. Delrin bushings 283 are provided, in one aspect, in a central portion of the side member 290 so as to mate with a corresponding shaft 281*c*, as shown in FIGS. 12(*a*) and 12(*c*). In but one aspect, these bushings 283 may have a 7.00 mm OD and about a 4.2 mm ID with an overall length of about 7.1 mm, inclusive of a 1.00 mm thick outer flange having a diameter of 8.0 mm. The corresponding diameter of the central portion opening in the side member 290 is about 7.0 mm. Shafts 281*c* is, in one aspect, 24.0 mm long and about 4.0 mm in diameter and may comprise a metal, such as a 300 series stainless steel.

Side member 290 also comprises a lower idler portion 260 connected to an idler bearing (e.g., a ball bearing) comprising a rotating element such as a ball or wheel 265 (hereinafter collectively referred to as "idler bearing") as shown in, for example, FIGS. 11, 12(*a*)–12(*d*), 13. In one aspect, idler bearing may comprise Nylatron, although other synthetic or metallic materials may be used. Operation of the idler bearing 265 is described more fully below.

Figure 16:
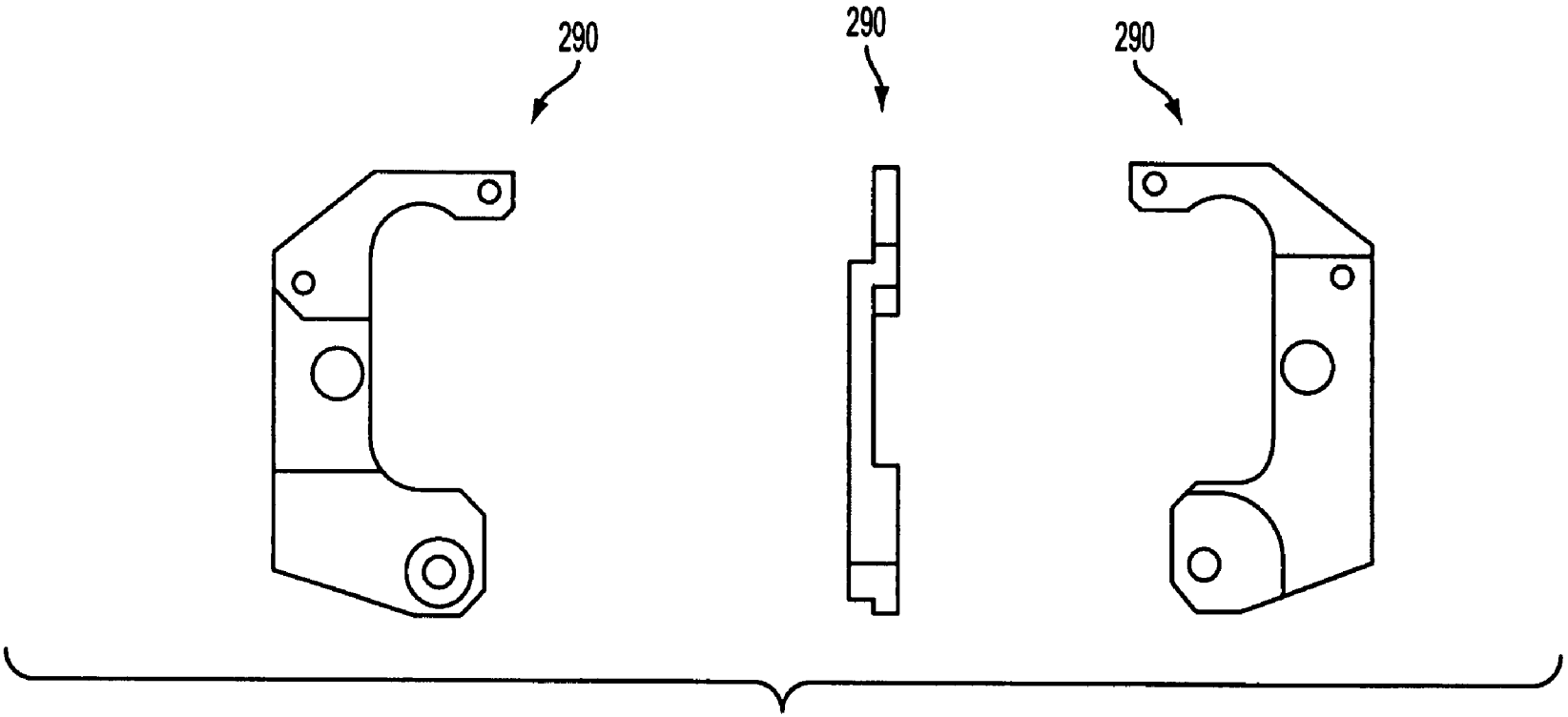
FIG. 16 shows right, left, and top views of still another gripping device component in accord with the present concepts.

Dimensions of an exemplary side member 290 are shown in FIG. 16. This side member 290, standing approximately 58.2 mm tall, comprises an upper jaw portion 255, noted above, and a lower idler portion 260 (see FIGS. 11, 13). In one aspect, the side member 290 comprises steel (e.g., ANSI C-1018) and still more preferably comprises a protective coating, such as a Type 111 electrodeposited zinc coating per ASTM B633.

Figure 14:
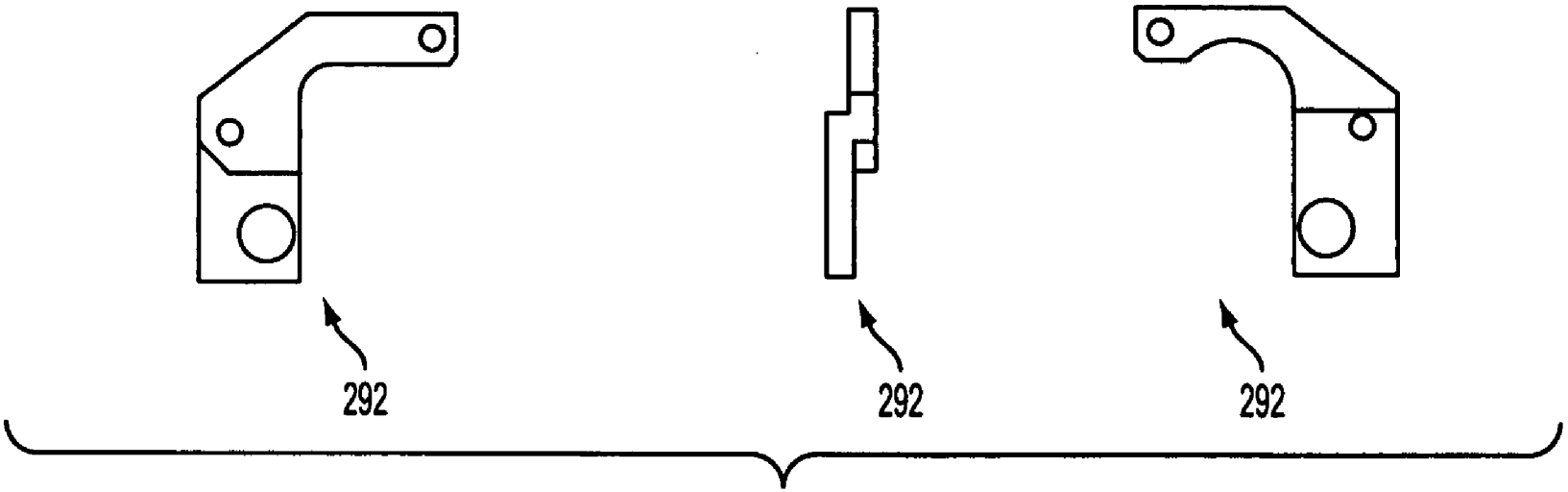
FIG. 14 shows right, left, and top views of a gripping device component in accord with the present concepts.
Figure 15:
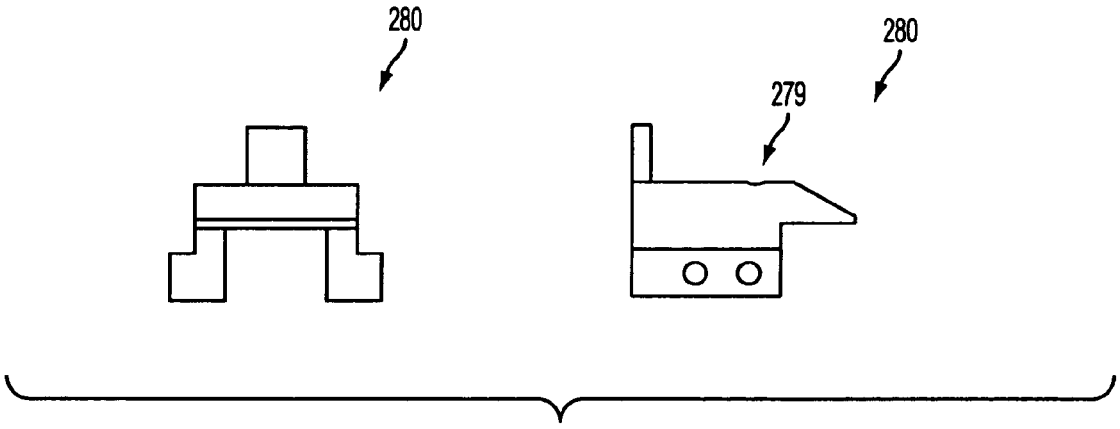
FIG. 15 shows rear and side views of another gripping device component in accord with the present concepts.
Figure 18:
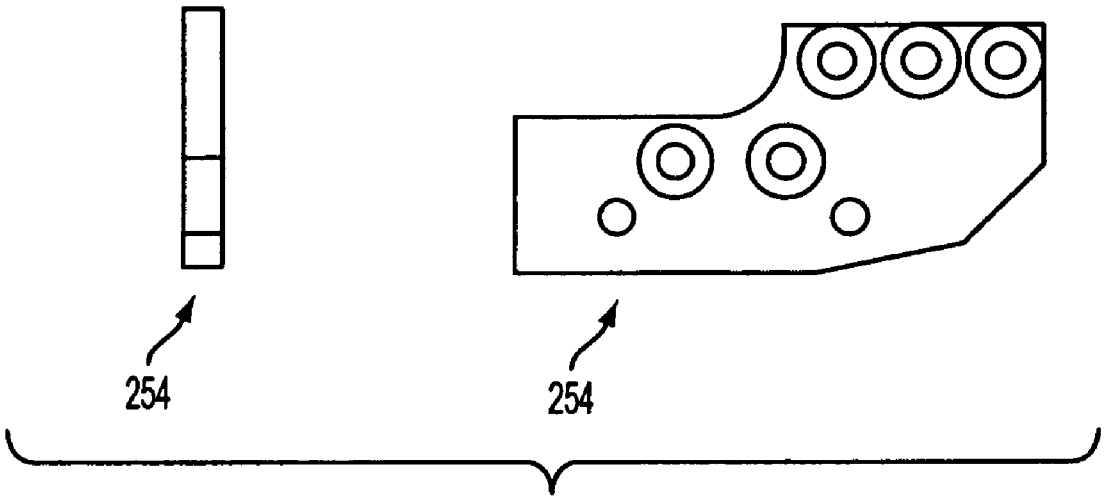
FIG. 18 shows cross-sectional and side views of still yet another gripping device component in accord with the present concepts.
Figure 19:
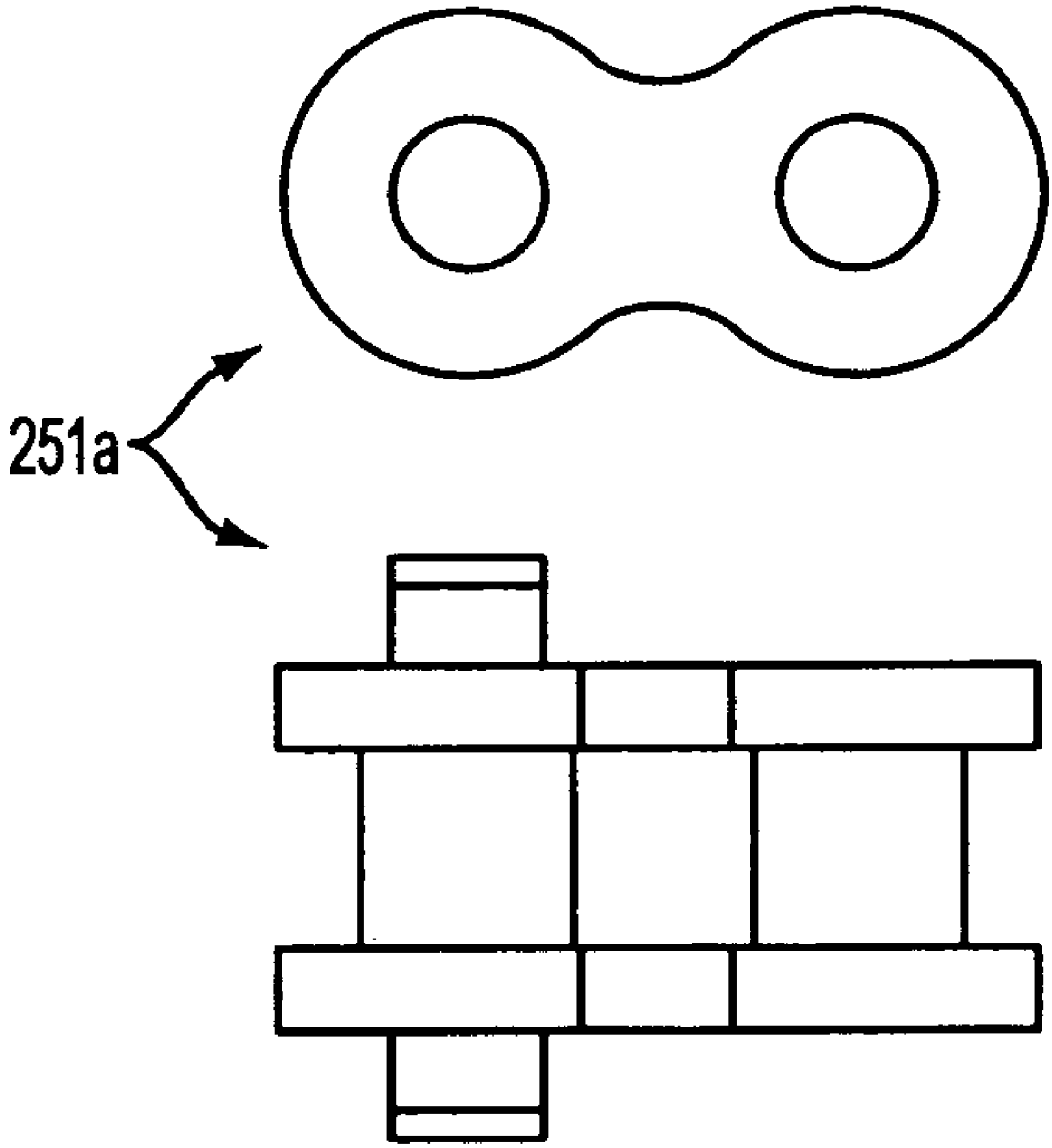
FIG. 19 shows top and side views of a connector chain link in accord with the present concepts.

Dimensions of an exemplary opposing side member 292 are shown in FIG. 14. Side member 292 stands approximately 32.0 mm tall and comprises a 7.0 mm opening in a lower portion thereof configured to receive a bushing 283 of similar configuration to that noted above to facilitate insertion of shaft 281*c* therethrough. As shown in FIGS. 12(*a*)–12(*d*), shaft 281*c* is secured to a side plate 254 into chain link 251*a* and out of an opposite side thereof. Dimensions of an exemplary side plate 254 are shown in FIG. 18. Side plate 254 may comprise an aluminum alloy, such as a 6061-T6 aluminum. Dimensions of a chain link 251*a* in accord with the present concepts are shown in FIG. 19. Chain link 251*a*, as well as the drive chain 251 suitably comprise a plastic (e.g., such as P/N 35RL made by Putnam Precision Molding).

Adjacent shaft 281*c* is provided another shaft 281*d* of similar configuration (e.g., 24.0 mm long and about 4.0 mm in diameter and comprising a metal, such as a 300 series stainless steel). Shaft 281*d* is also secured to a side plate 254 and passed into chain link 251*a* and out of an opposite side thereof, as shown in FIGS. 12(*a*)–12(*b*). However, spacers 282 are provided on either side of the chain link 251*a*. Such spacers are, in one example, 7.6 mm in length and 8.0 mm in diameter with an inner through-hole of about 4.2 mm and may, in one aspect, comprise Delrin.

Figure 17:
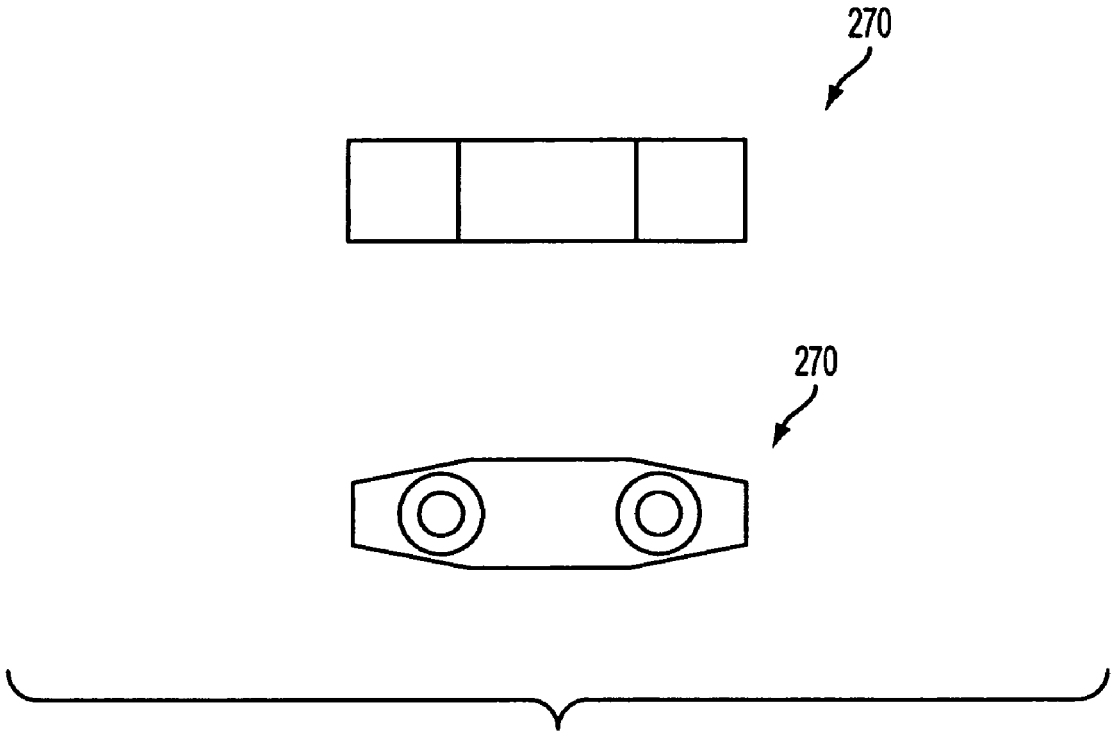
FIG. 17 shows top and side views of yet another gripping device component in accord with the present concepts.

Shaft 281*a* is, as shown in FIG. 12(*a*)–12(*b*) secured as a cross member to the forwardmost openings in side plate 254. Shaft 281*b* is configured, at about 9.1 mm in length and 4.76 mm in diameter, to span between the side member 290 and side member 292 when the assembled first unit 295 (comprising guide block 270, side plate 254, shafts 281 (*a*)–(*d*), spacers 282, chain link 251*a*, side member 292, bushing 283, spring 285, and seat 280) is mated with the assembled second unit 291 (comprising side member 290, bushing 283, shaft 275, and idler roller 265), as shown in FIGS. 12(*b*)–12(*c*) to form a base gripping member 296, shown in FIG. 12(*d*). The bushing 283 of the assembled second unit 291 is inserted over the portion of shaft 281*c* which projects from chain link 251*a*. Assembled third unit 271 (comprising guide block 270 and side plate 254) is then attached to base gripping member 296 to form the present example of a gripping member 250, wherein the gripping member guide blocks 270 are outwardly disposed. Guide blocks 270 are illustrated in more detail in FIG. 17, which shows tapered front and rear portions, each having a length of 8.0 mm and starting height of 5.8 mm and rising to a 20.0 mm plateau at a central portion having a height of about 9.8 mm. The ends of spring 285 are mounted respectively to shaft 281*a* and 281*b*, as shown in the side profile of FIG. 13.

When the system is running at a speed of 18,000 envelopes per hour, the gripping members 250 run at 86.25 inches per second, although the grippings have been endurance tested up to 100 inches per second and gripping member speeds of up to about 125 inches per second have yielded promising results in the configuration represented by, for example, FIGS. 8–12(*d*). Still higher gripping member velocities may be achieved through appropriate selection of the spring force required to keep the gripping members 250 closed as the travel around the sprockets (e.g., 510–540) (e.g., to offset increases in the momentum of the gripping member jaw 255 as it travels around the sprocket). The present example of a gripping member 250 spring 285 (see, e.g., FIG. 12(*a*)) has been shown to work well up to about 125 ips. A stronger spring may be utilized to facilitate achievement of higher gripping member 250 velocities. Guide members 300 may also be required to be reconfigured to help stabilize the gripping members 250 at such higher speeds, particularly areas adjacent the sprockets. Current, the guide members 300 are positioned to provide coverage for approximately 140° of the gripping members 250 travel around the sprockets. This coverage could advantageously be increased to facilitate gripping member 250 travel at higher velocities. Additionally, the rate of change in angle of the gripping members 250 can advantageously be decreased or softened, such as by reconfiguration of the sprockets (e.g., larger diameter) or addition of one or more sprockets to the system. Additional improvements may include reduction and/or balancing of the gripping member 250 mass.

Figure 13:
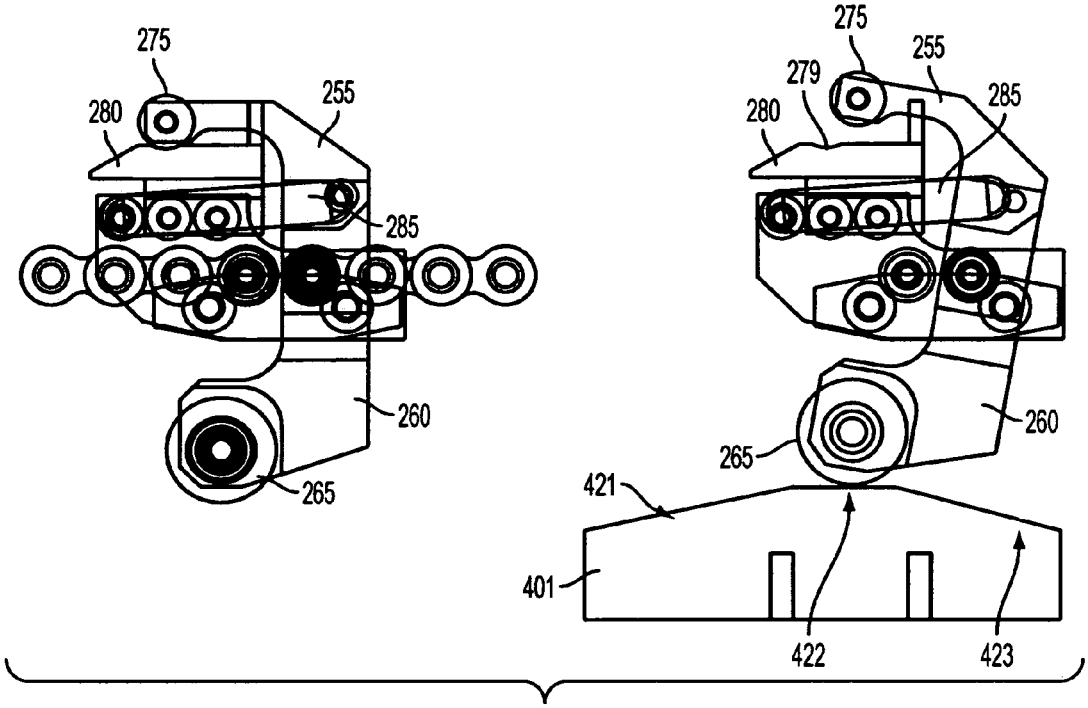
FIG. 13 shows side views of a gripping device in a first state and in a second state in accord with the present concepts.

FIG. 13 shows how the idler bearing 265 attached to the gripping member 250 permits the gripping member 250 to open while in motion. On the left-hand side of FIG. 13, the gripping member 250 jaw 255 is shown in a first position wherein spring 285 biases the gripping member jaw 255 and shaft 275 in a closed position against seat 280. The lower idler portion 260 and idler bearing 265 are also shown to be unhindered. On the right-hand side of FIG. 13, the gripping member jaw 255 is shown in a second position wherein a ramp 401 is adapted to bias the gripping member jaw 255 against the spring force provided by spring 285 to pivot the gripping member jaw upwardly about a pivot point defined by the bushings 283 and shaft 281*c*. This movement of the jaw, up to approximately 15° as configured in the example, permits an envelope to be received within the space between the upper plane of the seat 280, the bottom of the gripping member jaw, and the envelope stop member 990.

As shown in FIG. 13, the ramp 401 advantageously includes an upwardly sloped entry surface 421, a horizontal surface 422, and a downwardly sloped exit surface 423. In correspondence with the states of the gripping member jaw 255, the upwardly sloped entry surface 421 biases the gripping member jaw from a closed position to an open position in a substantially linear fashion. The horizontal surface 422 maintains the gripping member jaw 255 in an open position for a period of time determined by a chain speed and a length of the horizontal portion, and the downwardly sloped exit surface 423 relieves the bias against the idler bearing 265 and permits the spring 285 to return the gripping member jaw from an open position to a closed position in a substantially linear fashion.

In one aspect, ramp 401 has a forward edge height of 13.5 mm, a bottom length of 70.0 mm, and a plateau or upper length 422 (see FIG. 33) of 10.0 mm and height of 20.0 mm. The x-axis or lengthwise distance of the front inclined portion 421 (see FIG. 33) is 30.5 mm and of the rear declined portion is 24.5 mm. Ramp 401 has a width of 12.0 mm. However, the configuration of the ramp 401 surfaces may be freely configured to achieve any desired motion characteristics of the gripping member jaw 255. For example, the angles and lengths of surfaces 421, 422, and 423 may be freely varied, although it is preferred that the first surface that is encountered by the gripping member idler bearing 265 in a direction of travel be a downwardly-sloped surface to facilitate smooth engagement of the gripping member idler bearing with the ramp. On the back-side of the ramp, a downward slope may be provided, such as in ramp 401 shown in FIG. 9, or a sudden drop-off may be provided, such as shown in ramp 400 in FIG. 9. Additionally, curvilinear surfaces could be used to the same effect. In accord with the above example, the gripping member 250 is able to function at significantly higher speeds than previous designs and can open and close while in motion instead of coming to a stop to open.

FIGS. 21–30 depict another of the present concepts, particularly illustrating an apparatus (slip drive 200) and a method of accelerating an envelope into a pair of moving gripping members 250 and of registering the envelope uniformly in each gripping member 250 without buckling or skewing the envelope.

Figure 21:
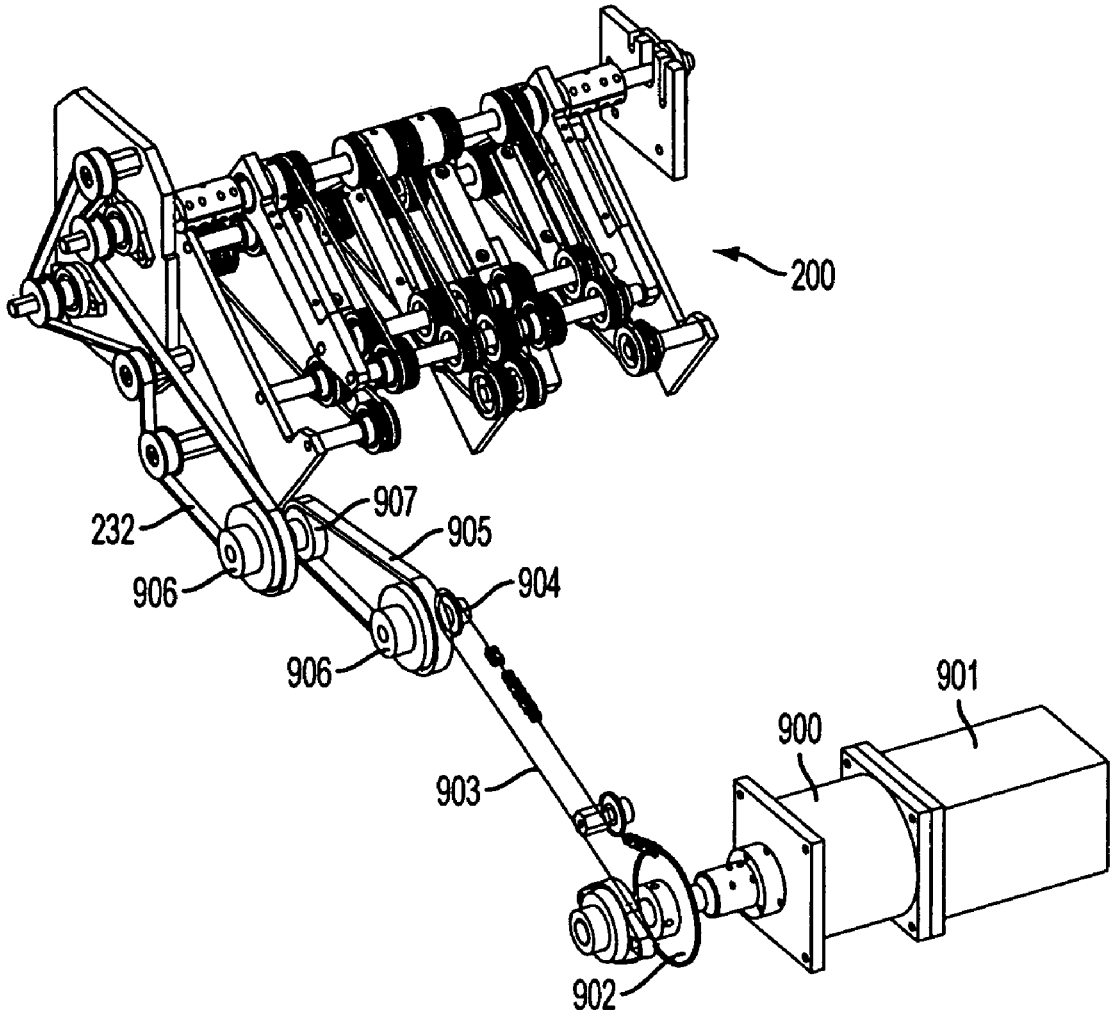
FIG. 21 is a front perspective view of a slip-drive and slip-drive drive system in accord with the present concepts.
Figure 22:
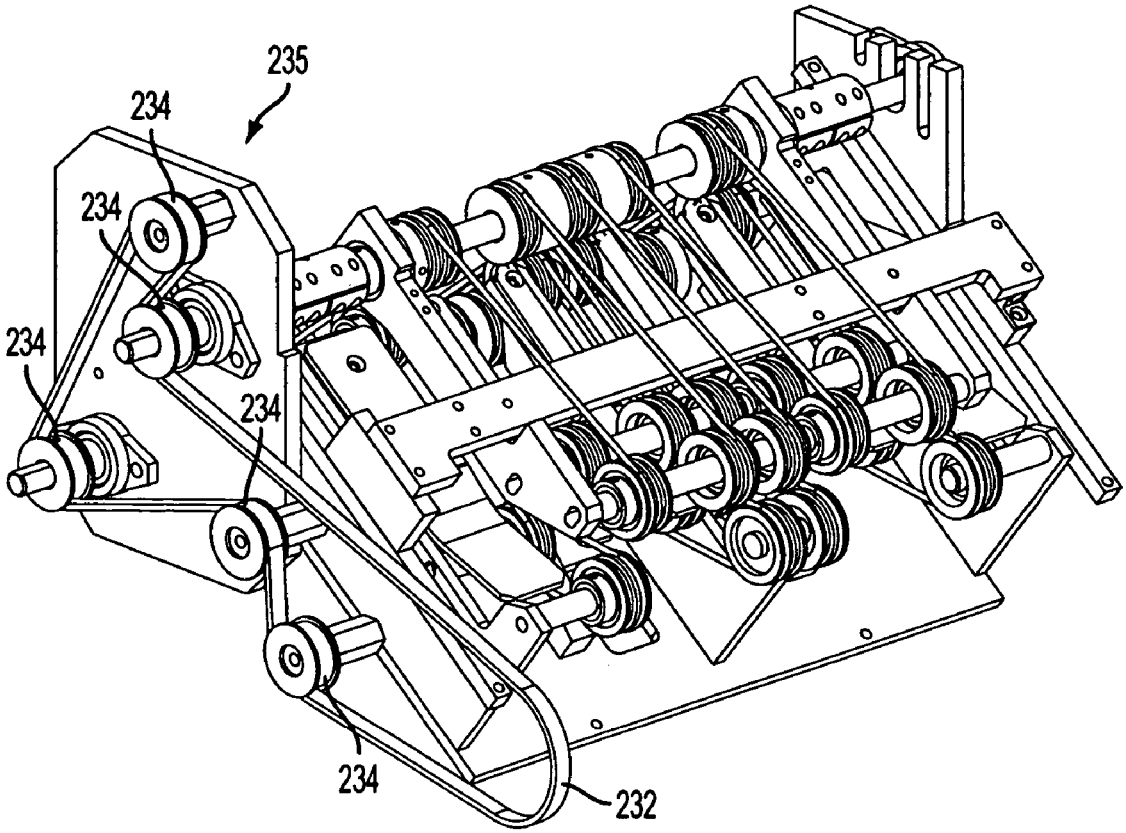
FIG. 22 is a front perspective view of a slip-drive and partial view of a slip-drive drive system in accord with the present concepts.
Figure 23:
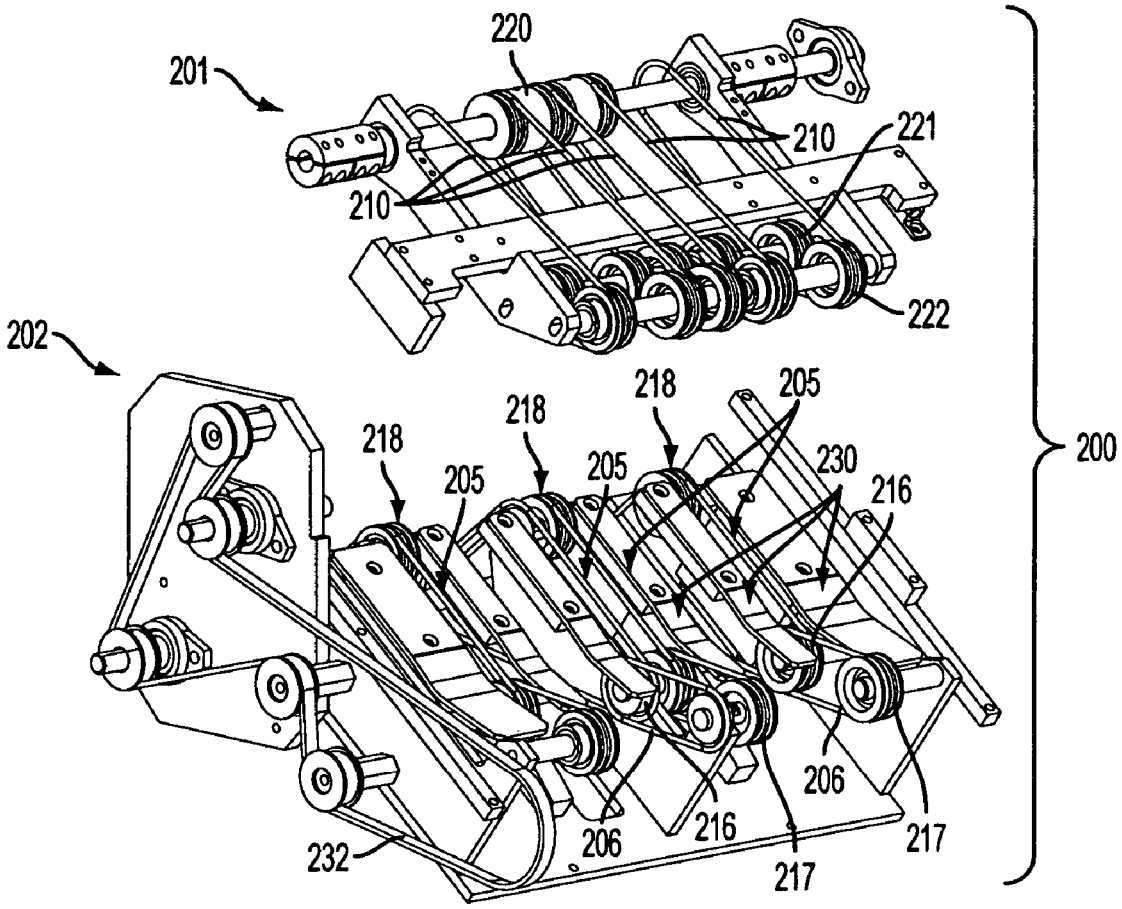
FIG. 23 is a front perspective disassembled view of a slip-drive and partial view of a slip-drive drive system in accord with the present concepts.

As shown in the slip drive 200 example of FIG. 21, a motor 901 and gearhead 900 are used in combination with sprocket 902, chain or belt 903, and sprocket 904 to drive pulley 906 and belt 232 to thereby drive the slip drive 200. This configuration is optional and conveniently utilizes the same motor used to drive other system components, such as main insert drive pins. The slip-drive may also be coupled to a motor devoted thereto. In the illustrated example, motor 901 is a Pacific Scientific motor, Model No. S31 JNNA-HSNC-02 and the gearhead 900 Model No. NE42-15LB manufactured by Bayside. Sprocket 902 has a pitch diameter of 81.6 mm and is manufactured by American Metric Corporation (P/N 22B32). Sprocket 904 has a pitch diameter of 38.48 mm, also manufactured by American Metric Corporation (P/N 22B15). In one aspect, pulleys 906 are 5 mm HTD (high torque drive) timing pulleys having a 70.0 mm pitch diameter manufactured by Stock Drive Products (P/N A6A25M044NF0910) and belts 905, 232 are 5 mm HTD timing belts. Pulleys 907 (FIG. 21) and 234 (FIG. 22) are 5 mm HTD timing pulleys respectively having a 31.8 mm pitch diameter manufactured by Stock Drive Products (P/N A6A25M020DF0908) and belts 905, 232 are 5 mm HTD timing belts.

Figure 25:
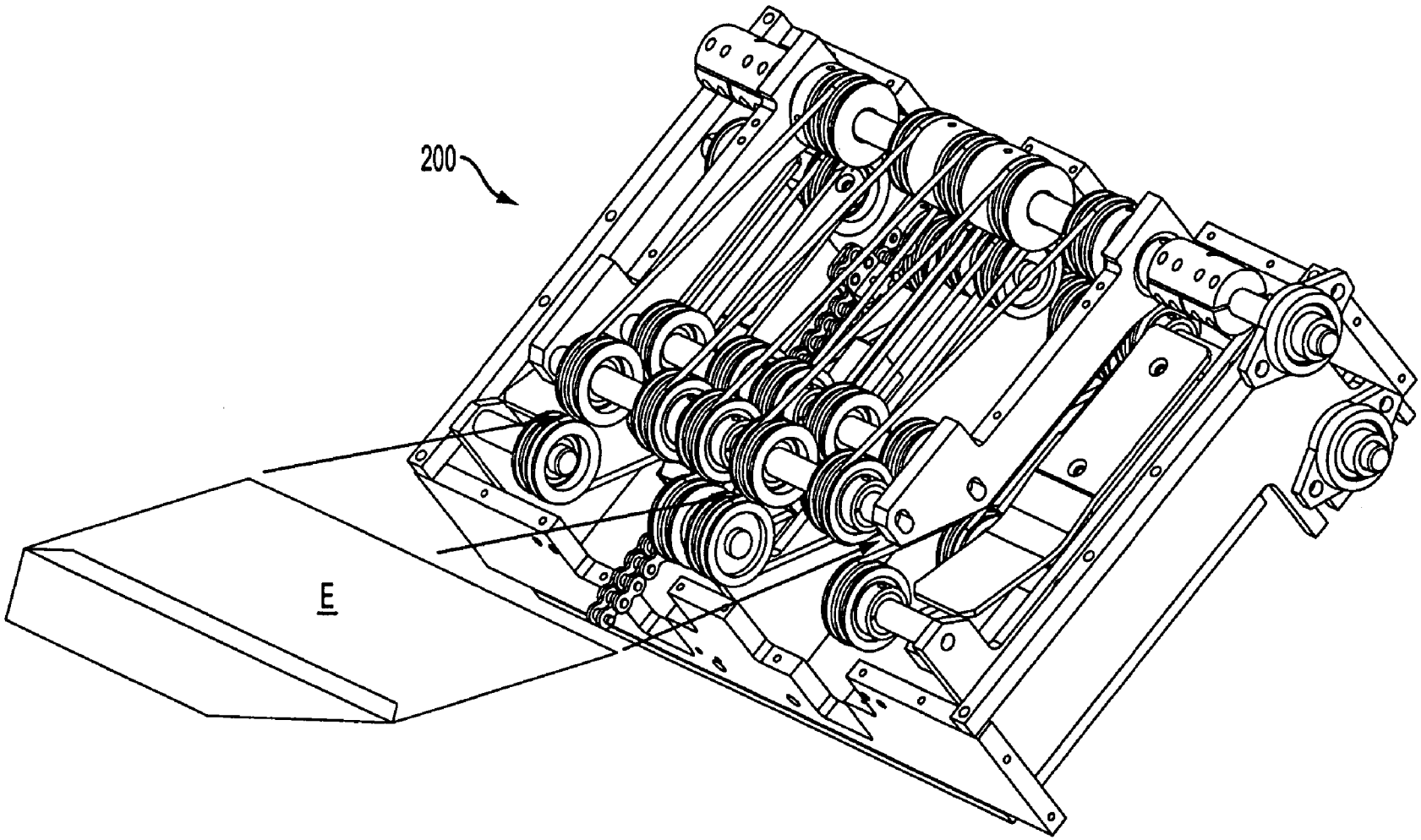
FIG. 25 is an assembled front perspective view of a slip-drive in accord with the view represented by FIG. 24.
Figure 26:
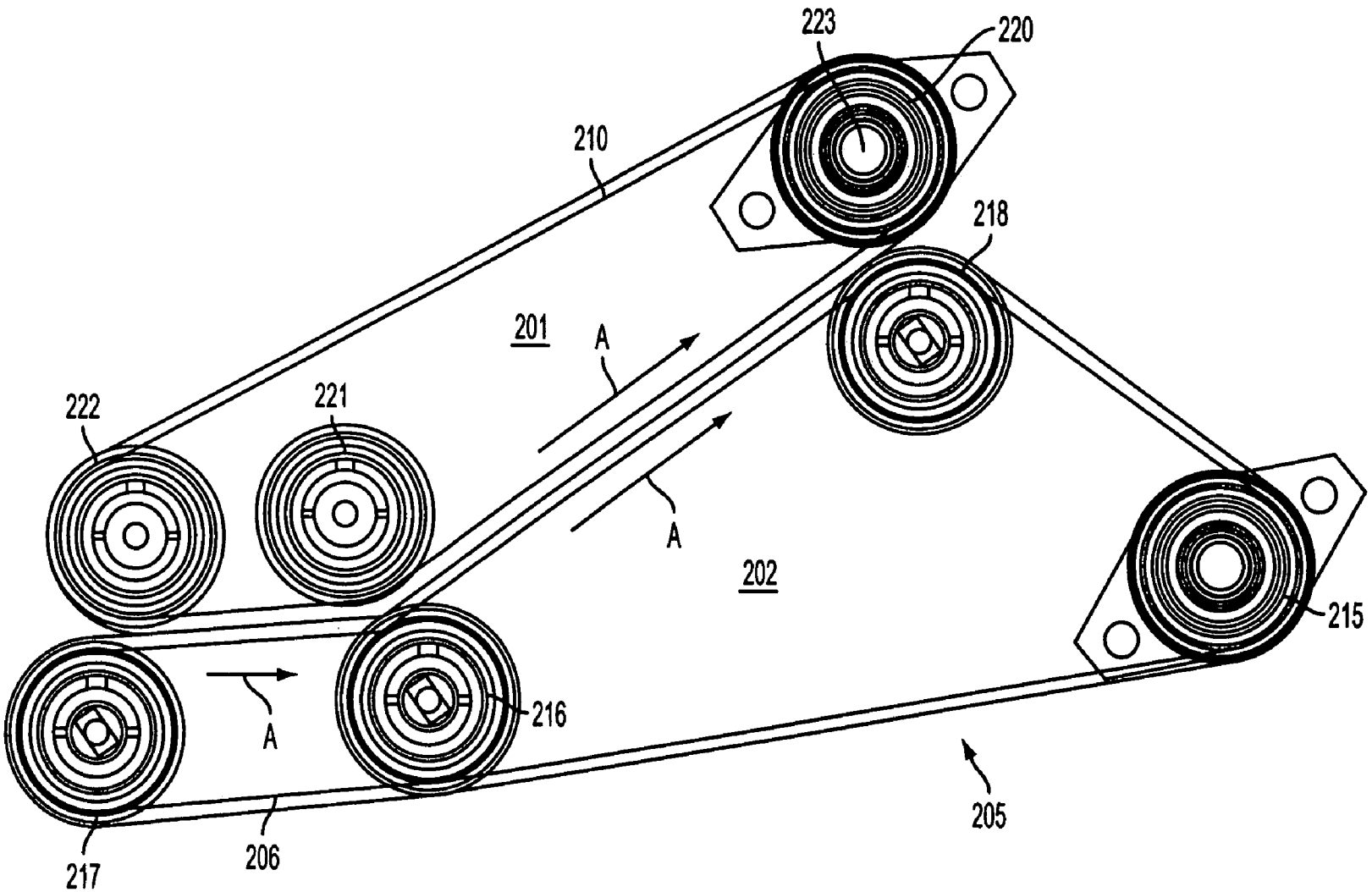
FIG. 26 is a partial side view of a slip-drive in a closed and operational position in accord with the present concepts.
Figure 27:
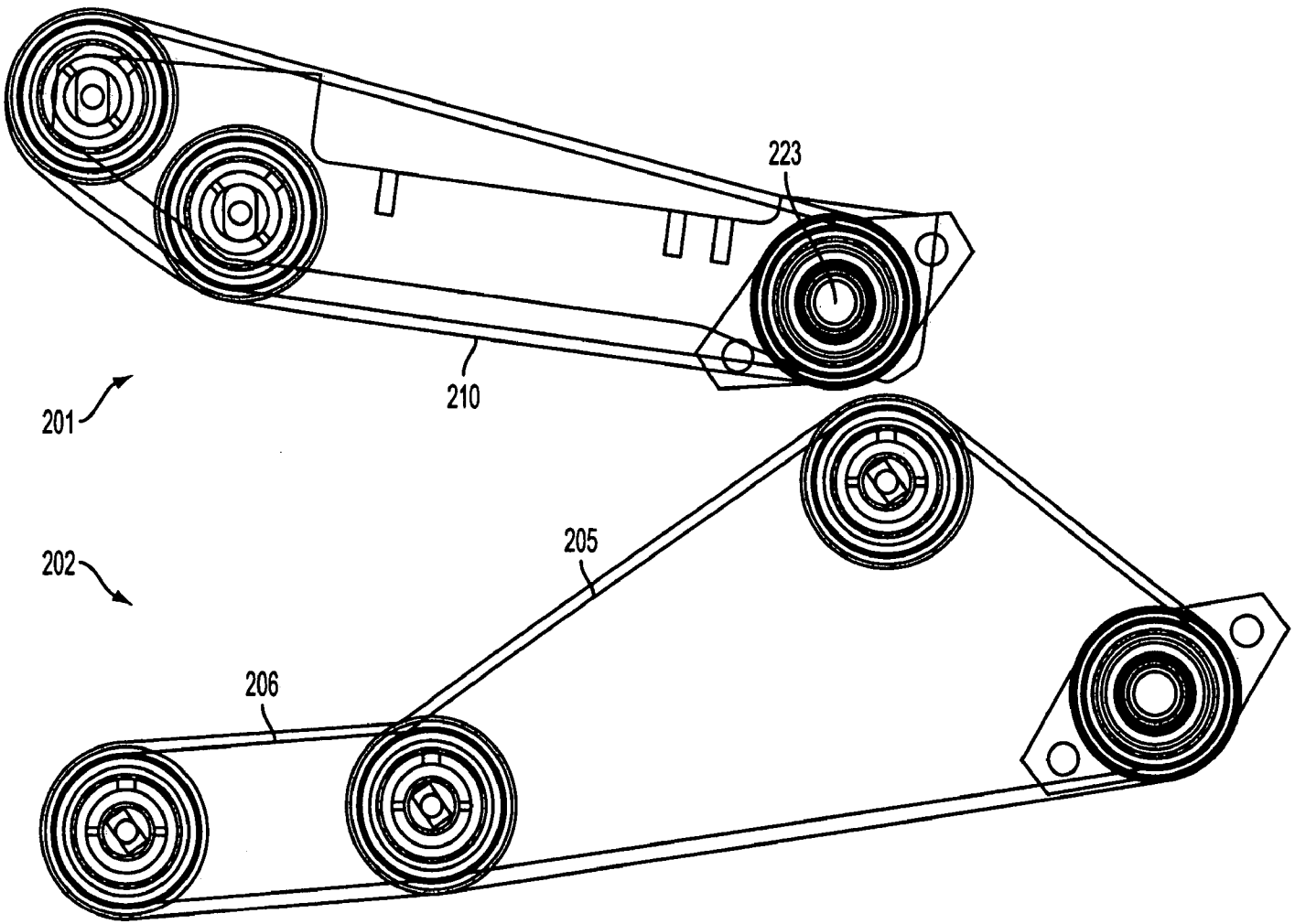
FIG. 27 is a partial side view of a slip-drive in an open and non-operational position accord with the present concepts.

As shown in FIGS. 23–30, slip drive 200 comprises an upper portion 201 and a lower portion 202. FIG. 27 shows that the upper portion 201 may be advantageously hinged relative to lower portion 202 by means of a pivot shaft 223 to provide access to an interior of the slip drive 200. In the example provided, the shaft 223 about which drive rollers or pulleys 220 are disposed is selected as the pivot point. Upper portion 201 comprises drive rollers 220 and idler rollers 221, 222, about which a plurality of belts 210 are arranged. The number of belts 210 and the spacing of the belts may be varied. Belts 210 may comprise urethane belts. Lower portion 202 comprises drive rollers 215 and idler rollers 216, 217 and 218, about which a plurality of belts 205, 206 are arranged as shown, for example, in FIGS. 24 and 27. The number of belts 205, 206 and the spacing thereof may also be varied. Belts 205, 206 may also comprise urethane belts. Additionally, the vertical overlap of the belts 210 to the belts 205, 206 may be varied. In one aspect of the present concepts, there is approximately 0.5 mm of overlap between the upper and lower belt on the slip drive. Since the belts 205, 206, 210 are spaced apart (e.g., as viewed from above) the envelope is allowed to slip. If an envelope enters the slip drive slightly skewed, it will be carried to the gripping members 250 in a skewed condition. At the moment that the leading edge of the envelope hits the gripping member 250 envelope stop member 990, the skew would be instantly corrected, as the envelope pivots into proper registration against the two backstop elements. Since some "slip" is allowed, the differential velocities of the gripper and the belts won't crush the envelope against envelope stop member 990.

In one aspect, a central drive roller or pulley 220 on shaft 223 comprises a 7-groove pulley (see FIG. 24), made of a 6061-T6 aluminum, having an overall length of 82.0 mm and having grooves disposed therein with center-lines spaced 4.0 mm, 11.0 mm, 34.0 mm, 41.0 mm, 48.0 mm, 71.0 mm, and 78.0 mm from one end thereof. The grooves are 60° grooves having a radius of 1.55 mm. A diameter of the central drive pulley 220 is 37.0 mm. The shorter drive rollers or pulleys disposed on outside ends of shaft 223 are, in one aspect, 3-groove pulleys, made of a 6061-T6 aluminum, having an overall length of 29.0 mm and having grooves disposed therein with center-lines spaced 11.0 mm, 18.0 mm, and 25.0 mm from one end thereof. The grooves are also 60° grooves having a radius of 1.55 mm and a diameter of these drive pulleys are also 37.0 mm. The drive pulleys may comprise any arrangement of these, or other, pulley configurations (and materials) and these examples are by no means exhaustive. Idler rollers or pulleys (e.g., 216, 217, 221, 222) may comprise 2-groove pulleys, made of a 6061-T6 aluminum, having an overall length of 15.0 mm and having grooves disposed therein with center-lines inwardly spaced from either end by 4.0 mm. The grooves are 60° grooves having a radius of 1.55 mm and the idler pulleys have a diameter of 37.0 mm. AST bearings may be provided in combination with the idler pulleys (Model No. S5PP2).

Figure 24:
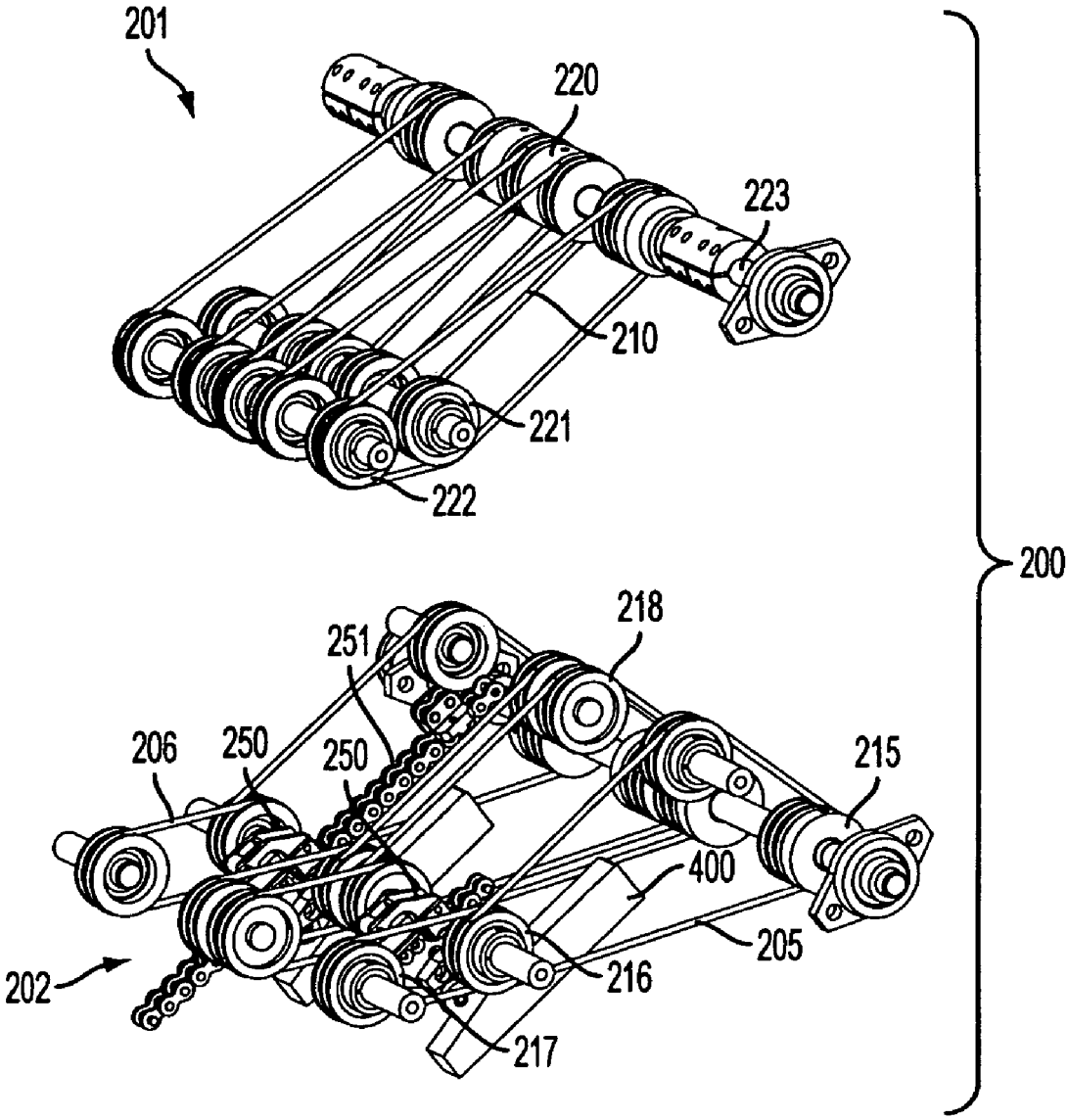
FIG. 24 is another front perspective disassembled view of a slip-drive in accord with the present concepts.

Whereas FIG. 24 shows a general relation of the gripping members 250, drive chain 251, and ramps 400 in relation to the slip drive 200, the view of FIG. 25 shows the assembled unit, wherein the chain and gripping members 250 are largely obscured. In FIG. 25, an envelope E is shown in the orientation in which it is inserted into the input of the slip-drive, between idler rollers 217, 222. FIG. 26 shows, via arrows A, the direction in which each of the belts rotates. The envelope inserted between idler rollers 217, 222 is thus passed toward idler rollers 221, 216 and then upwardly toward drive roller 220 and idler roller 218. The present example of the slip drive 200 drives envelopes between the upper set of belts 210 and the lower sets of belts 205, 206 at a speed about 2.8 times faster than the speed of the gripping members 250 through the slip drive 200. The relative speed of the belts 210, 205, 206 could range from about 1.5 to 4.0 times the speed of the gripping members 250. The belts 210, 205, 206 may comprise, for example, urethane and are provided to transmit a constant drive force, while allowing the envelopes borne thereby to slip sufficiently to overcome any skewing. The belts 210, 205, 206 continue driving the envelope until it is registered in both gripping members 250. Registration of the envelope in the gripping members 250 occurs as the gripping member idler bearings 265 drop from the back-side of ramp 400, thereby enabling spring 285 to force the gripping member jaws 255 closed on the envelope.

The current example, as noted above, is able to provide speeds of at least 300 inches per second and can easily handle 18000 envelopes per hour. If an envelope is slightly skewed prior to entering the belts 210, 205, 206, the belts will allow the envelope to register squarely in both gripping members 250 without buckling or damaging the envelope. The design provides constant drive but allows the envelope to slip into the gripping members 250 until it is properly registered.

Figure 28:
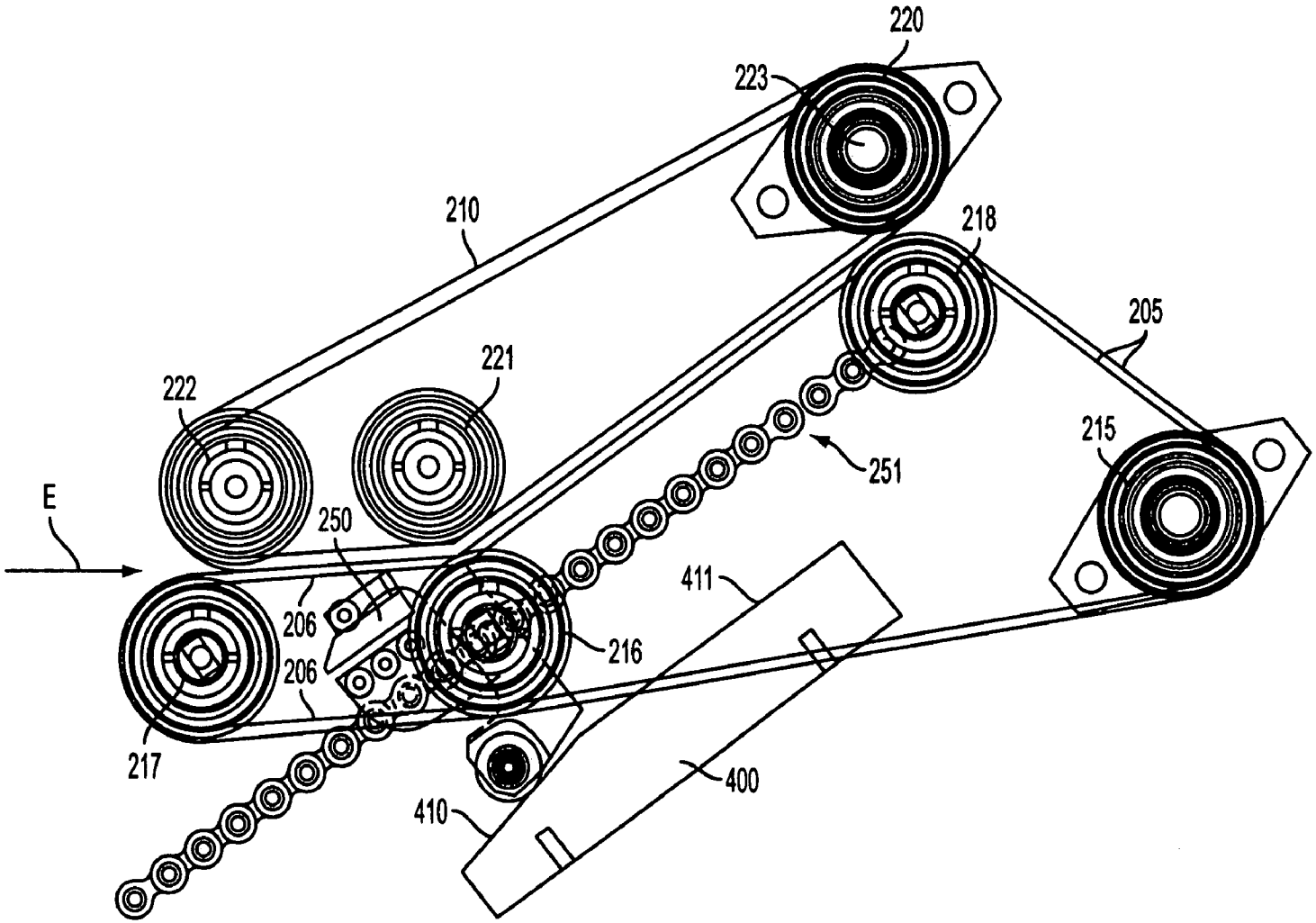
FIGS. 28–30 are time lapse partial side views of a slip-drive with a gripping member in sequential positions in accord with the present concepts.
Figure 29:
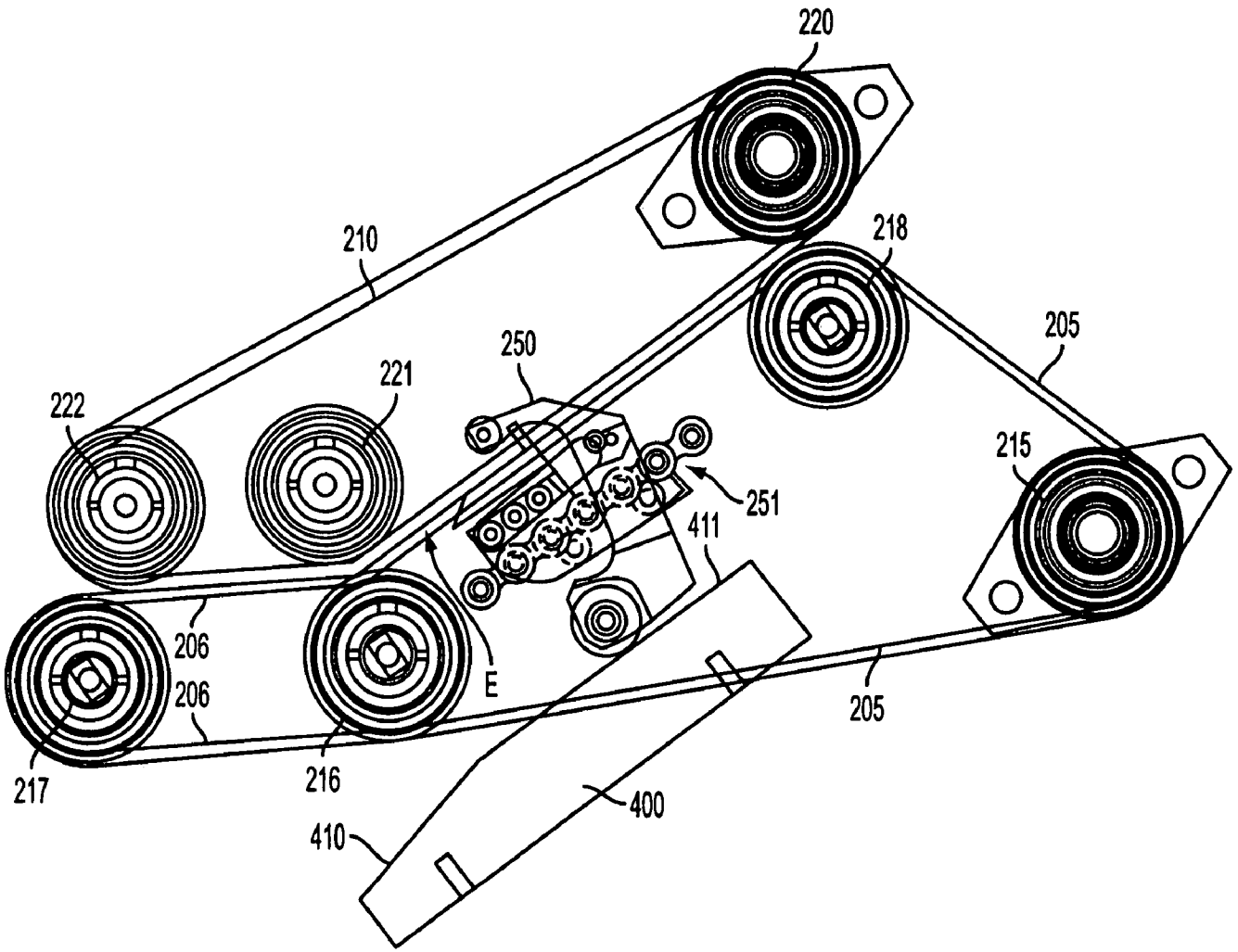
Figure 30:
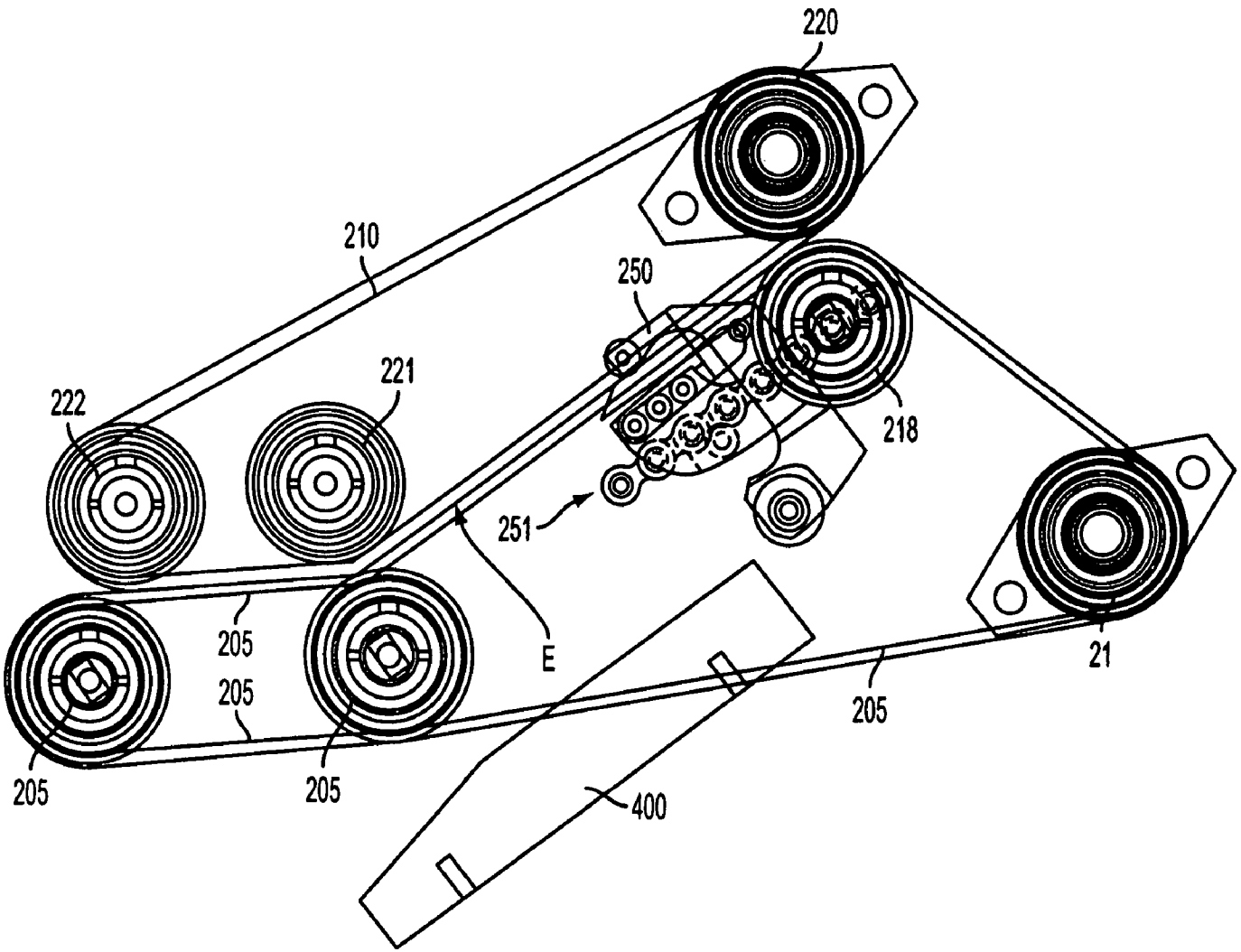

FIGS. 28–30 show, sequentially, the movement of drive chain 251, gripping members 250 and an envelope E through the slip drive. In FIG. 28, a gripping member 250 idler bearing 265 is shown encountering an inclined slope 410 of ramp 400. In one aspect, ramp 401 has a forward edge height of 13.5 mm, a bottom length of 115.0 mm, and a plateau or upper length 411 (see FIG. 29) of 75.0 mm and height of 22.0 mm. The x-axis or lengthwise distance of the front inclined portion 421 (see FIG. 33) is 40.0 mm and of the rear declined portion is 24.5 mm. Ramp 400 has a width of 15.0 mm. Ramp 400 may comprise a material such as, but not limited to, a steel (e.g., AISI-C4140). However, the configuration of the ramp 400 surfaces may be freely configured to achieve any desired motion characteristics of the gripping member jaw 255. For example, the angles and lengths of surfaces 410, 411 may be freely varied. Additionally, curvilinear surfaces could be used to the same effect. In accord with the above example, the gripping member 250 is able to function at significantly higher speeds than previous designs and can open and close while in motion instead of coming to a stop to open.

At the point depicted in FIG. 28, contact between idler bearing 265 and slope 410 has just been made and the gripping member jaw 255 has not yet been displaced away from seat 280 at the time that envelope E is entering the input of the slip drive 200 between drive rollers 217, 222. FIG. 29 shows that the gripping member 250 idler bearing 265 has encountered and is traveling on a top portion or plateau 411 of ramp 400, wherein the gripping member jaw 255 is rotated away from the seat 280 against the force of spring 285. At this moment, the envelope E is moving via drive belts 205, 206, 210 at a speed faster than the speed at which drive chain 251 is moving gripping member 250 through the slip drive. In this respect, the envelope E may in fact be accelerating into the open gripping element or may be moving at an already realized constant velocity. As the envelope E passes between the gripping member jaw 255 and gripping member seat 280, the forward motion of the envelope is stopped by envelope stop member 990. Lastly, FIG. 30 shows that the gripping member 250 has passed beyond ramp 400 and spring 285 has again driven gripping member jaw 255 back toward seat 280 to grip registered envelope E.

From the slip drive, the gripping members 250 bearing envelopes E are transported up to registration stops 350 of the stuffing area 150, as shown in FIGS. 7–9. In accord with the present concepts, it was desired to provide an apparatus and a method by which envelope registration stops 350 could be activated at a rate of at least several times per second that does not require cams, solenoids or other electrical devises or software control, as do conventional systems.

Figure 31:
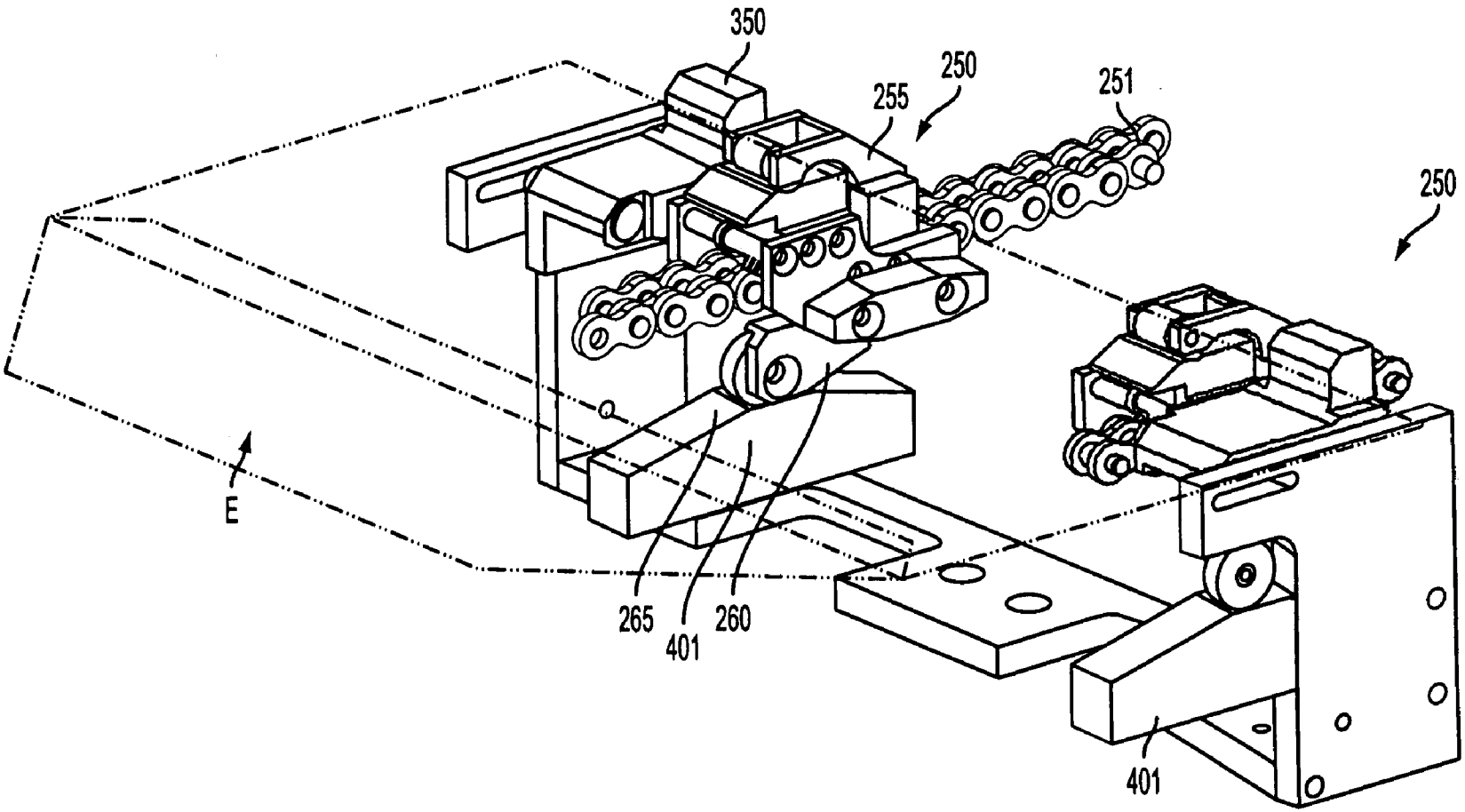
FIG. 31 is a partial front perspective view of a registration stop in accord with the present concepts.
Figure 32:
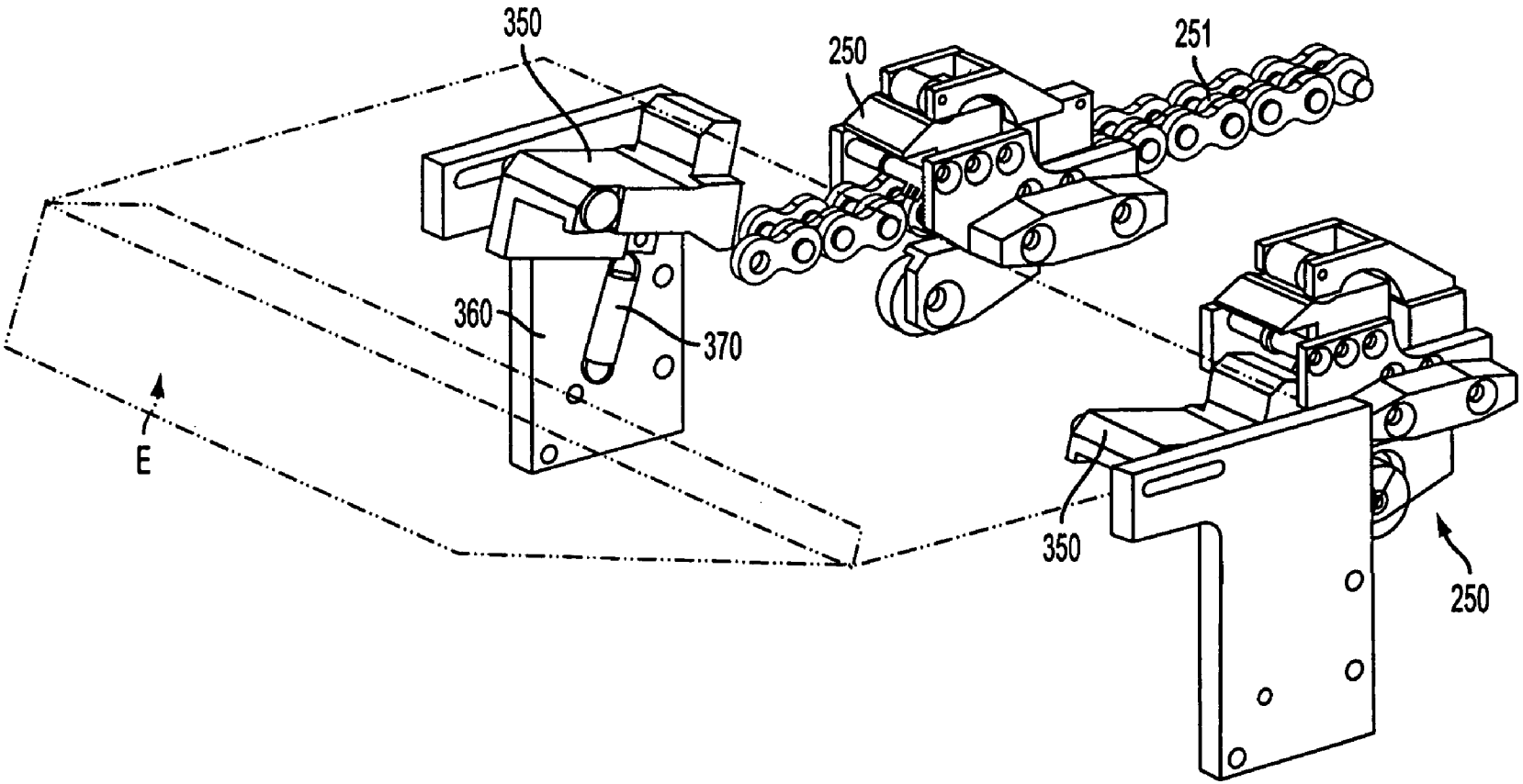
FIG. 32 is another partial front perspective view of a registration stop in accord with the present concepts.

FIGS. 31 and 32, which are described more fully below, respectively show an envelope E at the moment the envelope is registered against registration stops 350 and following registration and deposition of the envelope at the registration stops.

Figure 35:
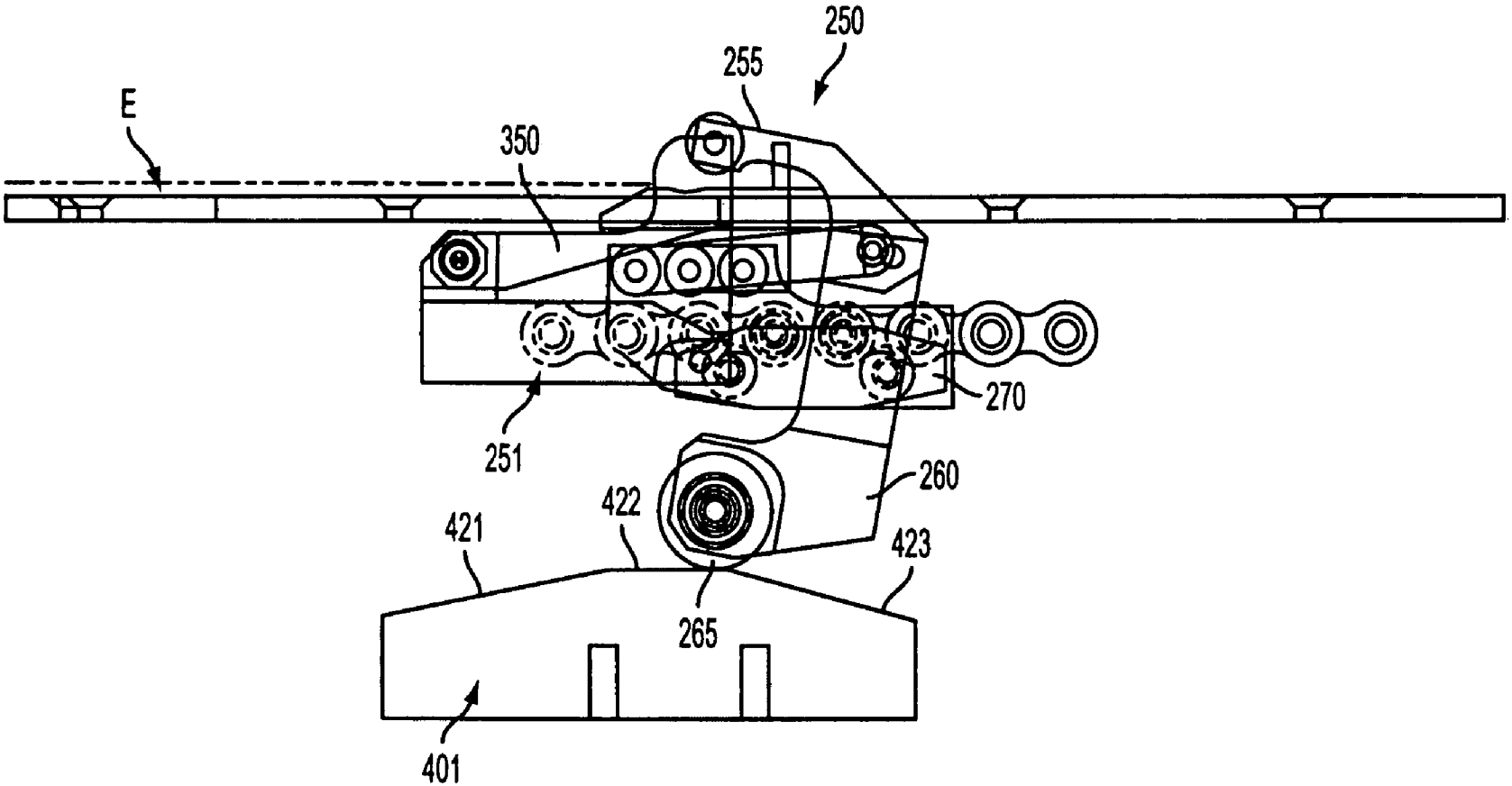
FIGS. 35–36 are side views of a registration stop in an upwardly biased position to register an envelope in accord with the present concepts.

FIG. 31 shows, at the depicted instant, the idler bearing 265 is traveling over central portion 422 of ramp 401, which deflects idler bearing 265 upwards sufficiently to bias gripping member jaw 255 open against the force of spring 285 to thereby permit deposition of the envelope against the registration stops 350 (FIG. 31 inadvertently does not show movement of gripping member jaw 255, as is clearly shown in FIG. 35).

Figure 33:
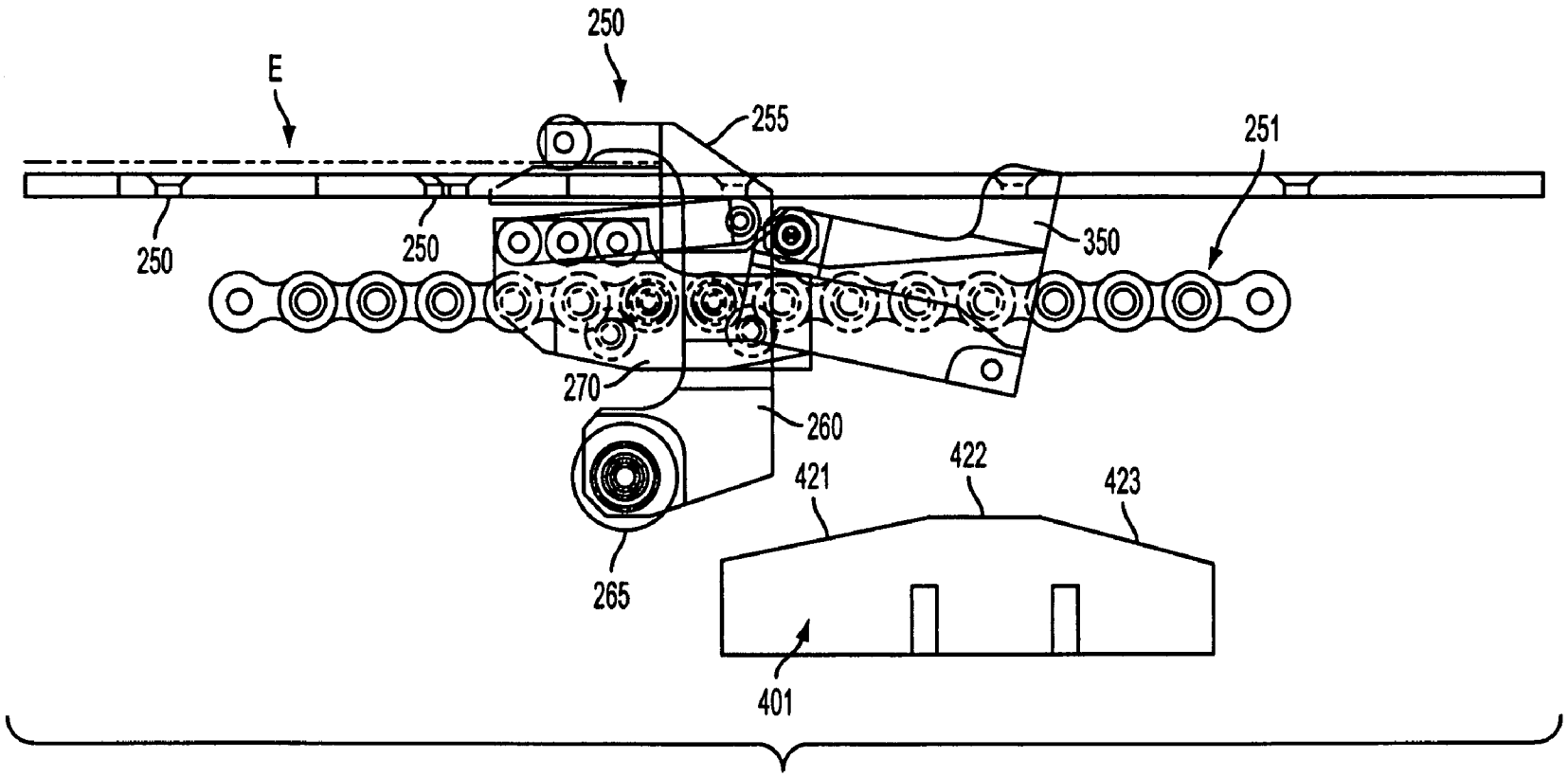
FIGS. 33–34 are side views of a registration stop in a downwardly biased position in accord with the present concepts.

FIG. 33 shows the approach of a gripping member 250 bearing an envelope E toward ramp 401 and registration stops 350. Registration stop 350 is in an initial or equilibrium state in which it is deflected downward by spring 370 about pivot shaft 362 (see FIG. 34). In one aspect, spring 370 is manufactured by Lee Spring Co. (Model No. LE-022C-5) and is 1.125 inches in length with a spring constant of 0.94 lb/in. When registration stop 350 is in the initial (down) position, the spring is extended 0.215 inches, yielding a force of 0.20 lbs and when registration stop 350 is displaced upwardly by gripping member 250, the spring is extended 0.60 inches, yielding a force of 0.57 lbs.

Figure 34:
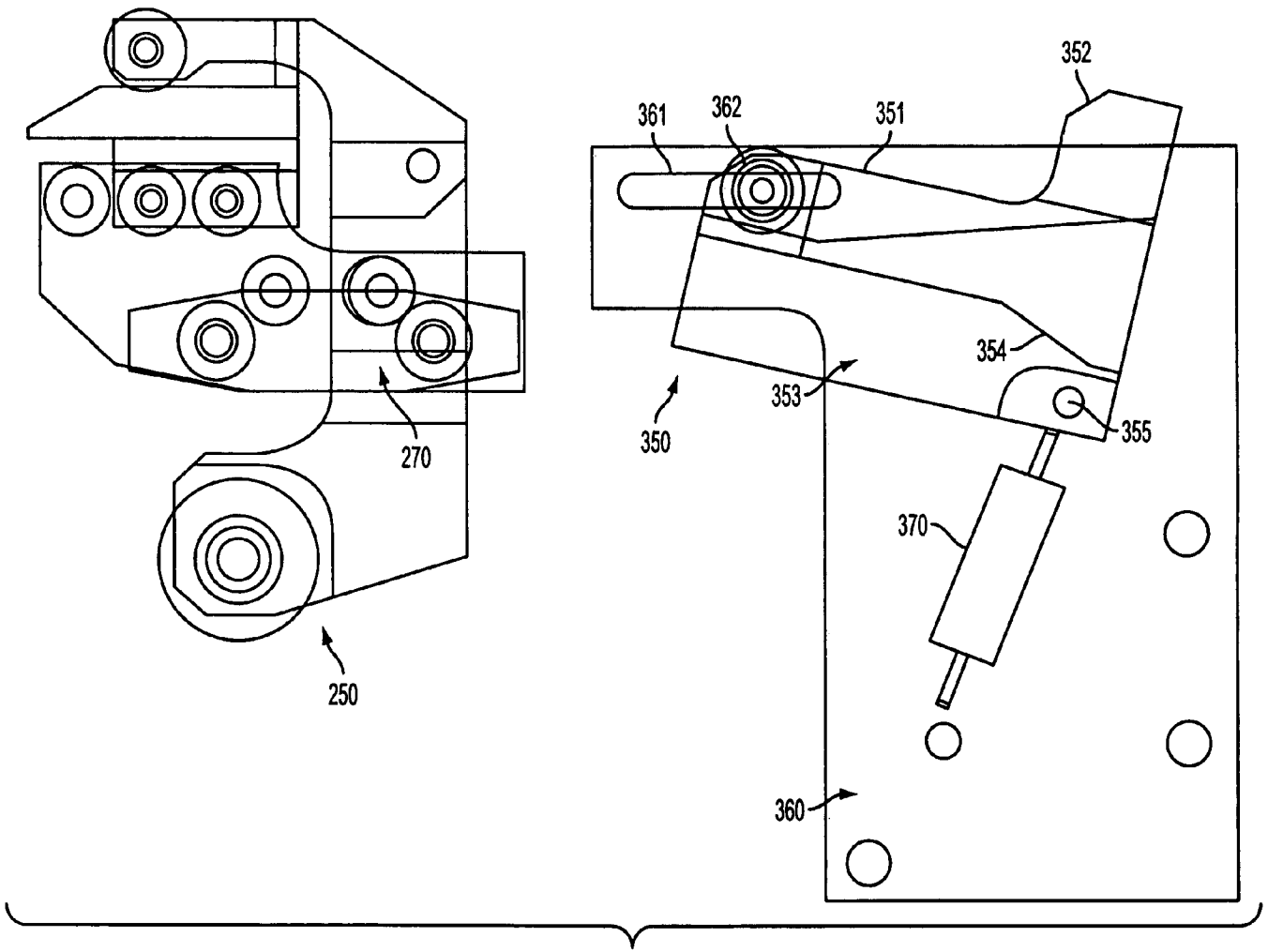
Figure 36:
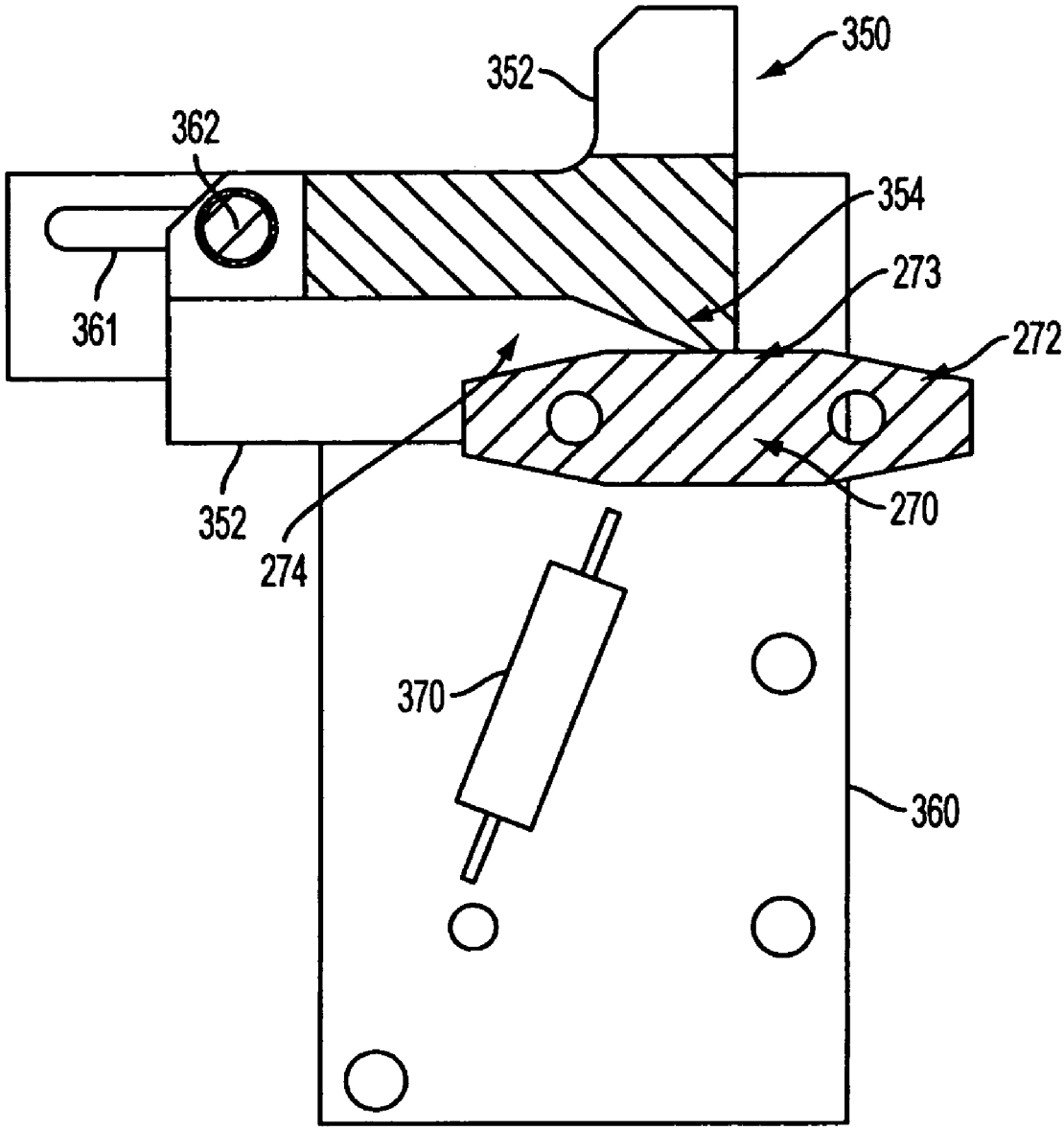

As can be appreciated with reference to FIGS. 34 and 36, the gripping member 250 guide blocks 270, which may comprise Nylatron NSM, are configured (see FIG. 17) to pass within an internal channel 353 of registration stop 350 and impact lower protrusion 354 thereof to force registration stop 350 to rotate upwardly about pivot shaft 362 against the downward bias of spring 370 about such pivot shaft. The location of pivot shaft 362 may be adjusted, as necessary, by translation of the shaft within track 361. During operation, the position of pivot shaft 362 is fixed. FIG. 36 shows lower protrusion 354 riding on top of the central portion 273 of guide block 270. Guide block 270 maintains the registration stop 350 in an upwardly displaced position (e.g., FIGS. 35–36) so that an envelope may be registered against upper protrusion 352.

Vacuum passages which may be provided in a vacuum manifold provided in the envelope stuffing or insertion area 150. The use of a vacuum on an underside of the face-down envelope provide, in one aspect of the present concepts, enhanced control over envelope E. Although not shown in FIG. 7, the vacuum openings may be centrally provided in a vacuum manifold disposed along the centrally disposed long, thin gap in the plate disposed between the registration stops 350.

Figure 37:
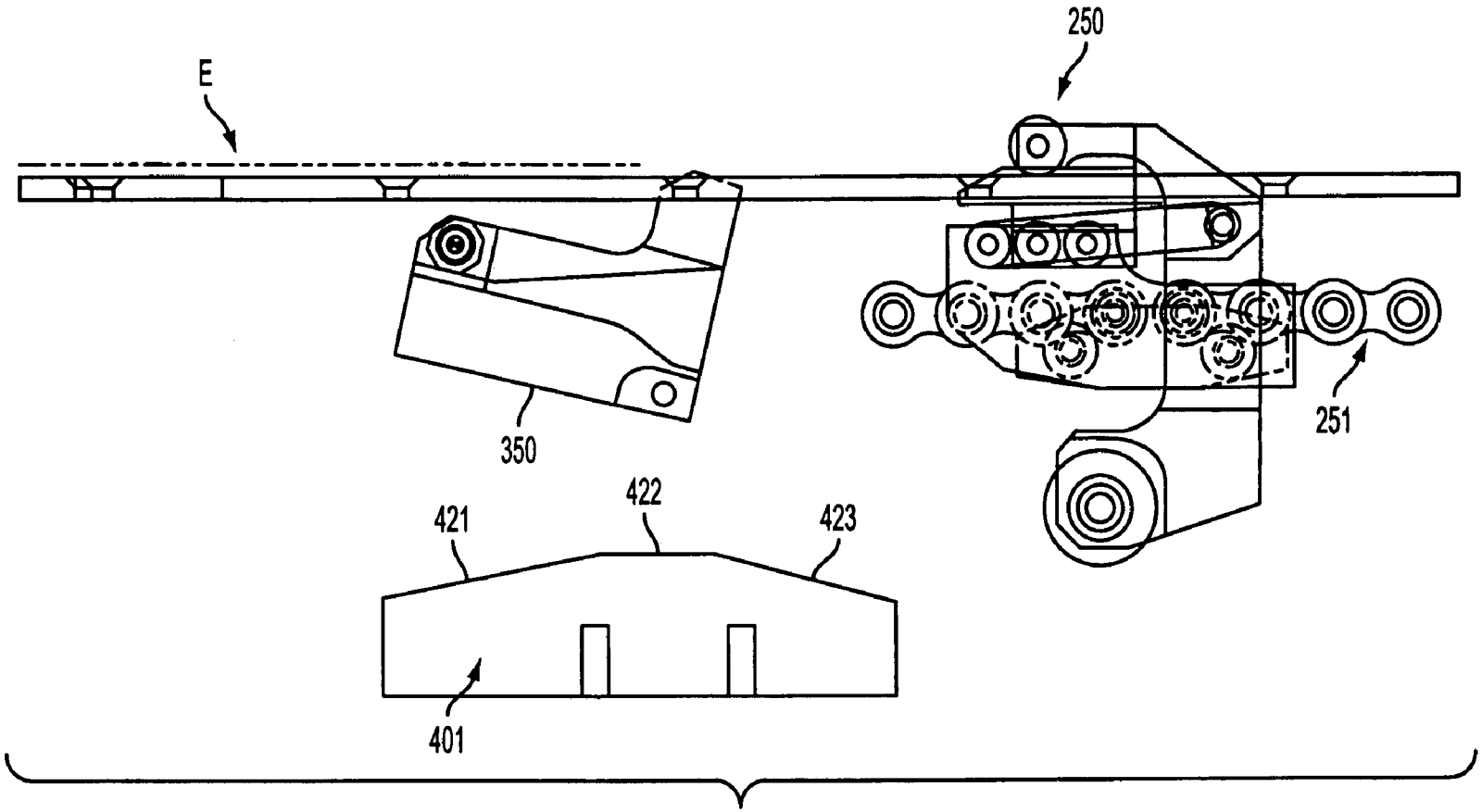
FIG. 37 is a side view of a registration stop in a downwardly biased position after having registered an envelope in accord with the present concepts.

FIGS. 32 and 37 show an envelope E following registration and deposition thereof against registration stops 350. Idler bearing 265 has disengaged from a rearward exit surface 423 of ramp 401, which relieves the bias imposed against gripping member spring 285, which correspondingly permits spring 285 to contract and force gripping member jaw 255 closed against seat 280. Similarly, passage of gripping member 250 guide block 270 past lower protrusion 273 of registration stop 350 relieves the bias imposed against registration stop 350 spring 370, which correspondingly permits spring 370 to contract and force registration stop 350 back to its initial position, out of the path of the envelope E. In this position, other system components may pick up or translate the envelope downstream in the stuffing area without impinging against the registration block 350.

Thus, in accord with the present concepts, the same gripping member guide blocks 270 that are used to stabilize the gripping members 250 in guide members 300 (see FIGS. 8 and 9)(discussed more filly below) are used to pivot the envelope registration stops 350 up into position to stop and register the envelopes. No other mechanical or electrical devices, or corresponding control systems or software, are required. In accord with the aforementioned apparatus, a method is provided whereby, absent cams, solenoids or other electrical devises or software control, the envelope registration stops 350 are spring loaded and pivot into position for a few milliseconds, at least several times a second (i.e., several envelopes per second), to stop the envelopes and register the leading edge of the envelopes. The stops then pivot down out of the path of the envelope. The speed at which the registration stop 350 moves and/or timing at which the registration stop 350 moves may be adjusted by altering, for example, spring rate 370, channel 352 profile, guide block 270 profile, and/or lower protrusion 354 profile.

In accord with still further aspects of the present concepts, FIGS. 38–42 depict guide members 310, 320, 330, 340, and

Figure 38:
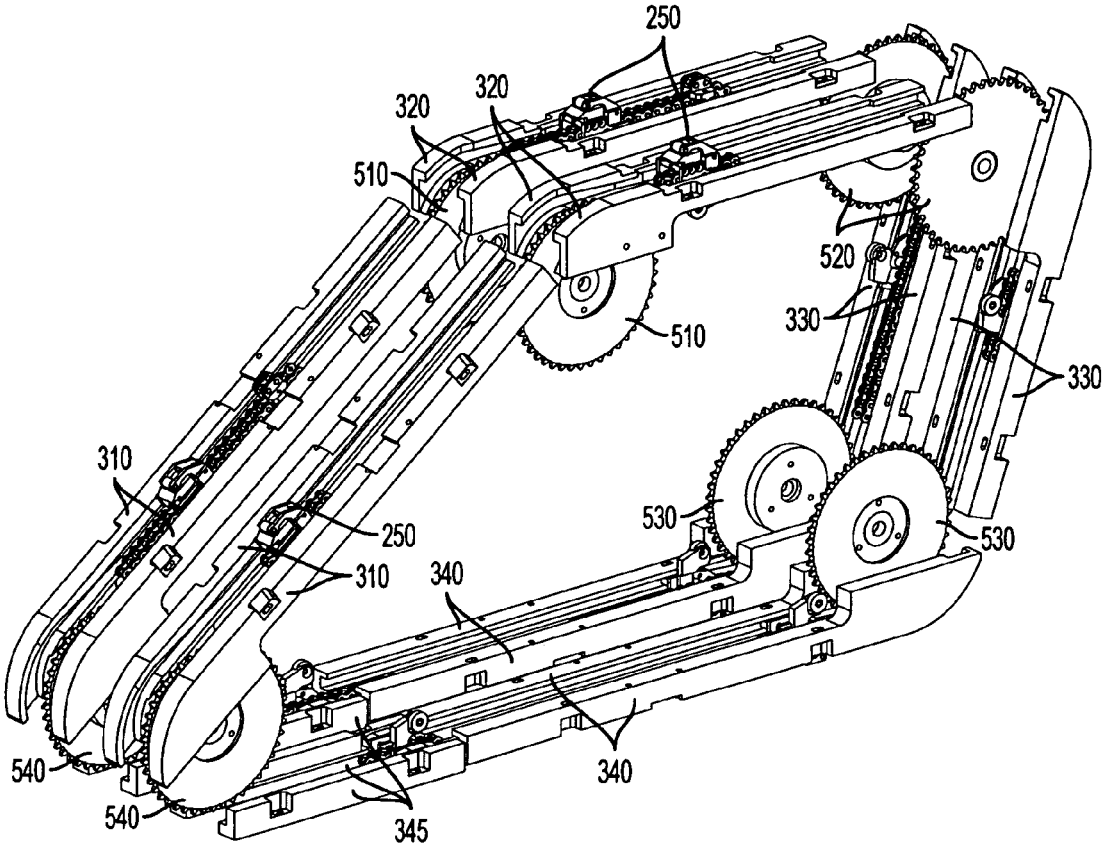
FIG. 38 is a front perspective view of guide members in accord with the present concepts.

345 (shown generally as guide members 300 in FIGS. 8–9). These guide members 310, 320, 330, 340, and 345 are, in one aspect, made of Delrin, although other durable low-friction materials, inclusive of coatings, may be used singly or in combination with other materials to provide guide members in accord with the present concepts. Moreover, the present concepts provided by the disclosed guide members are not limited to the material, but extend also to the shape of the guide members, particularly guide members 310, 320, 330, 340. These guide members extend to provide support for the envelope gripping members 250 as they travel around the sprockets at a rate up to 100 inches per second, as well as to provide support for the gripping members when they open and close (i.e., guide members 310, 320). The additional support around the sprockets was required in order to ensure that the envelope gripping members 250 remain stable at higher velocities while they travel around the sprockets as well as during straight runs. The extension of the guide member 310 over sprocket 540 on one side and sprocket 510 on the other side, as shown in FIG. 38 (and similar configurations regarding guide members 320, 330, and 340) is in marked contrast to conventional designs which provide metal guides supporting the envelope grippers in straight areas between sprockets but do not support the grippers as they travel around the sprockets, a configuration which is not capable of running at the higher speed and constant velocity addressed by the present concepts.

Figure 39:
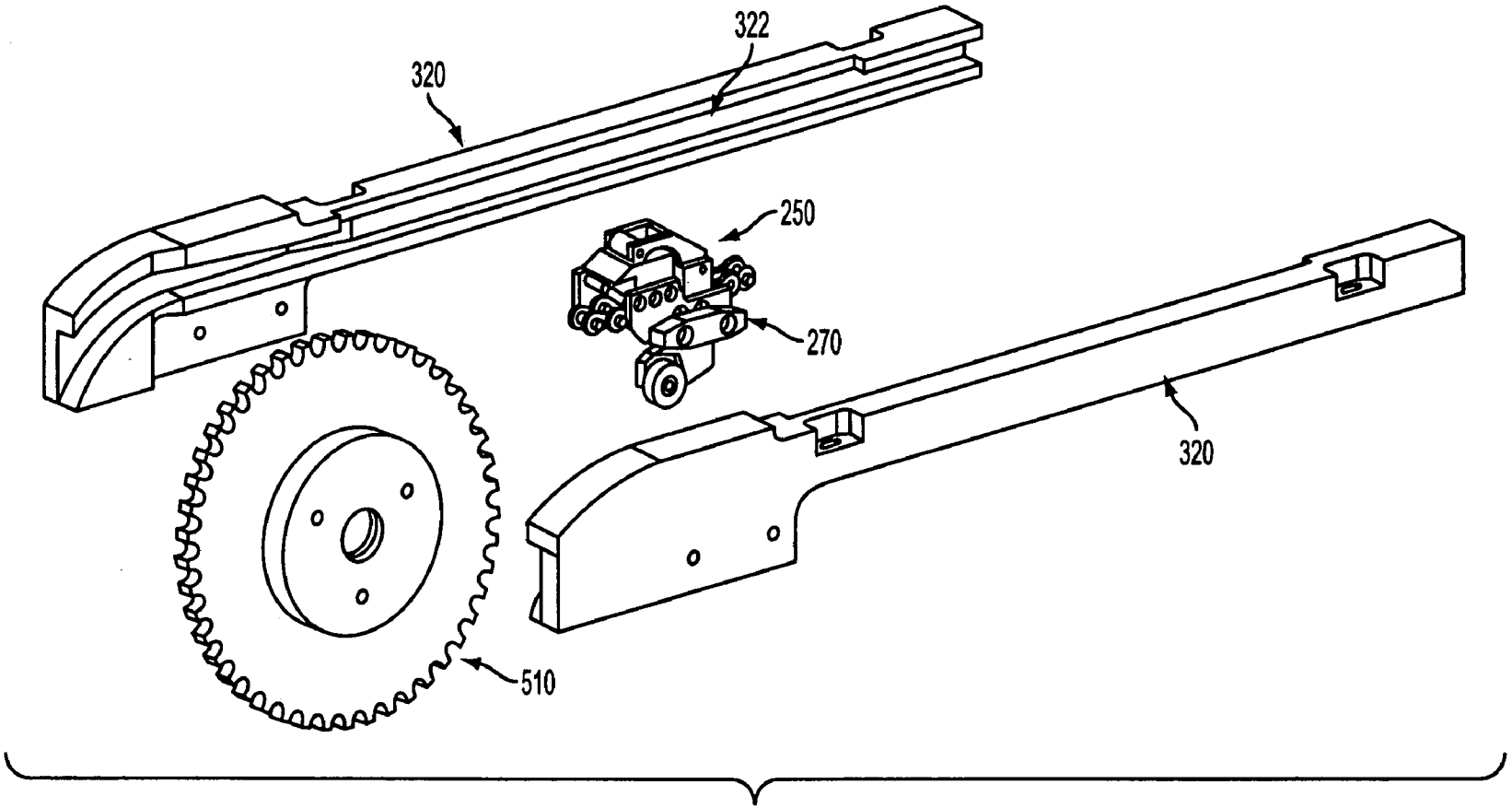
FIG. 39 is a front perspective disassembled view of an aspect of an embodiment of the present concepts showing a relation between a guide member set, a gripping device, and a sprocket in accord with the present concepts.
Figure 40:
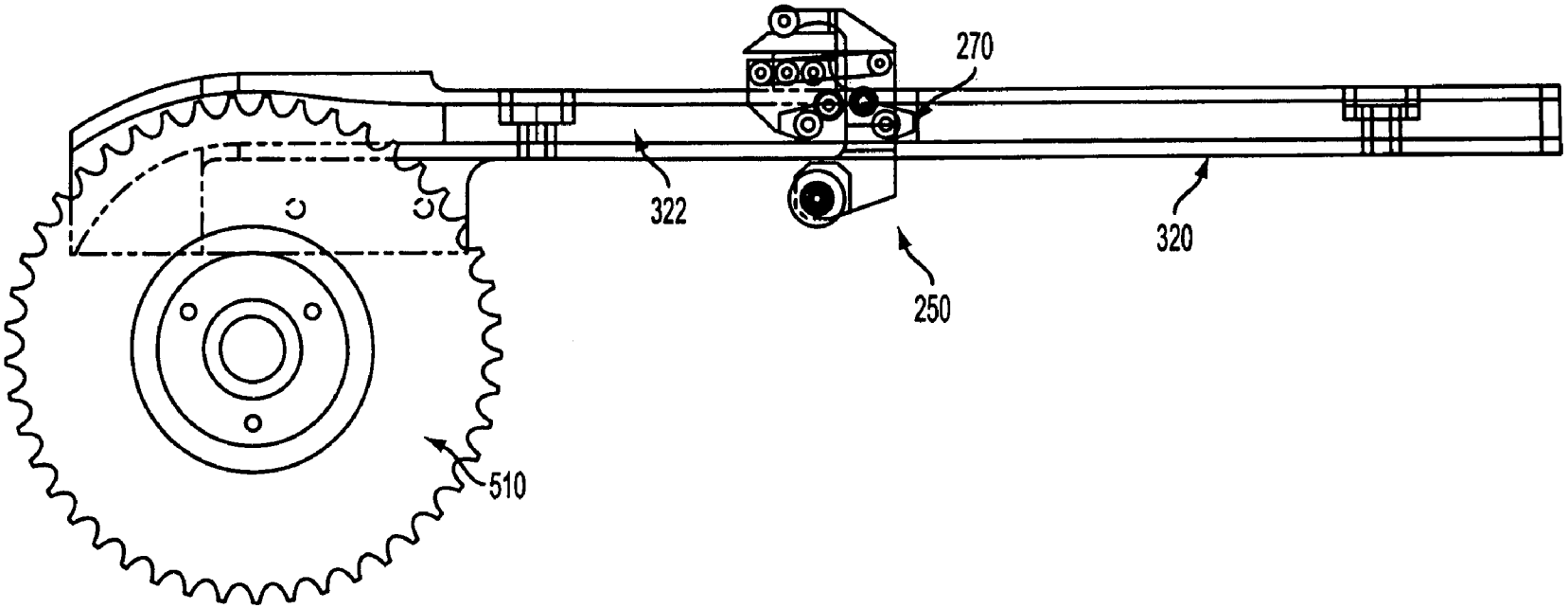
FIG. 40 shows a view of a sprocket, gripper, and guide member in accord with the present concepts.
Figure 41:
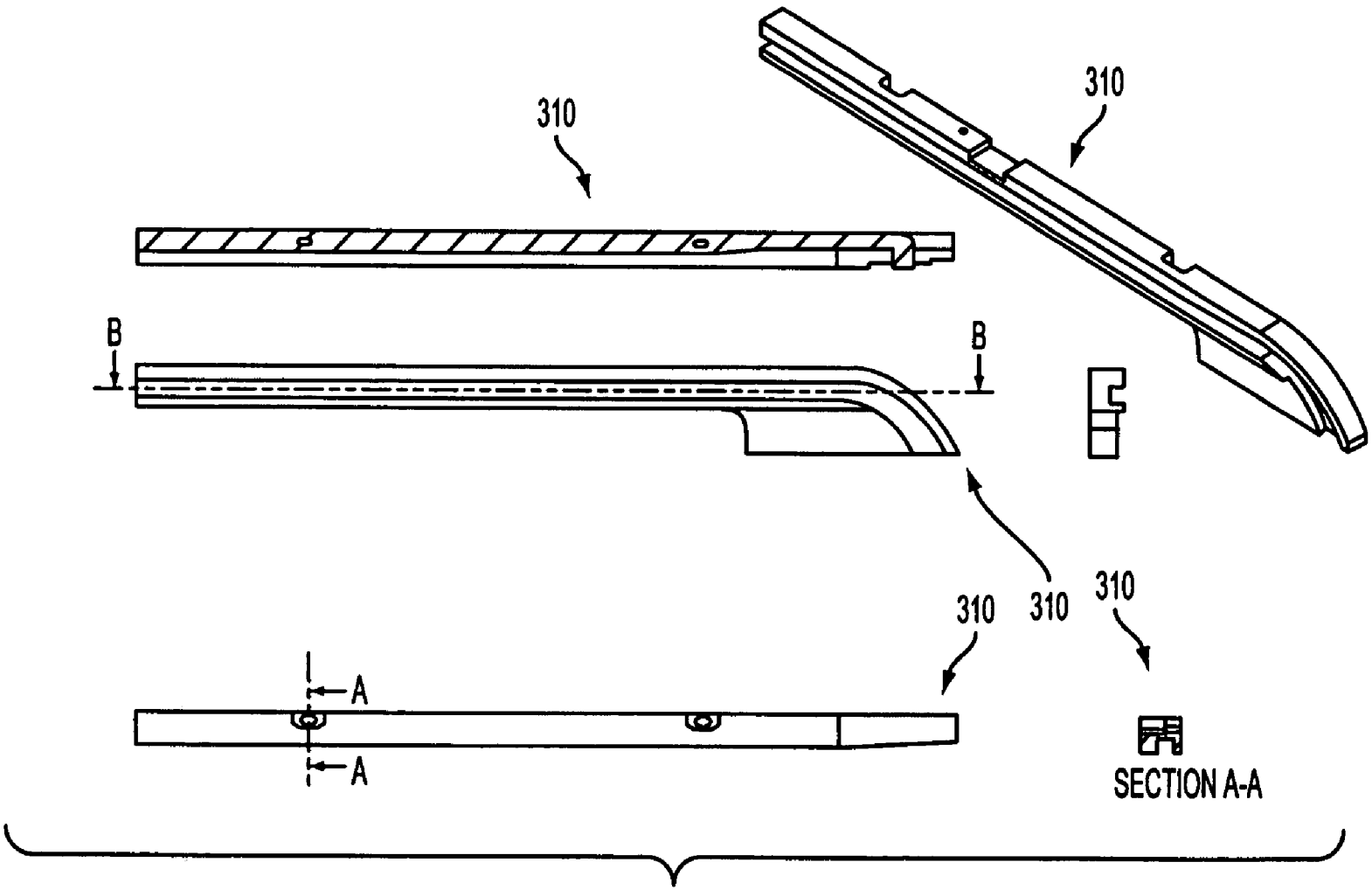
FIG. 41 shows perspective, top, side, front, lateral cross-sectional, and longitudinal cross-sectional views of another guide member shown in FIG. 38 in accord with the present concepts.
Figure 42:
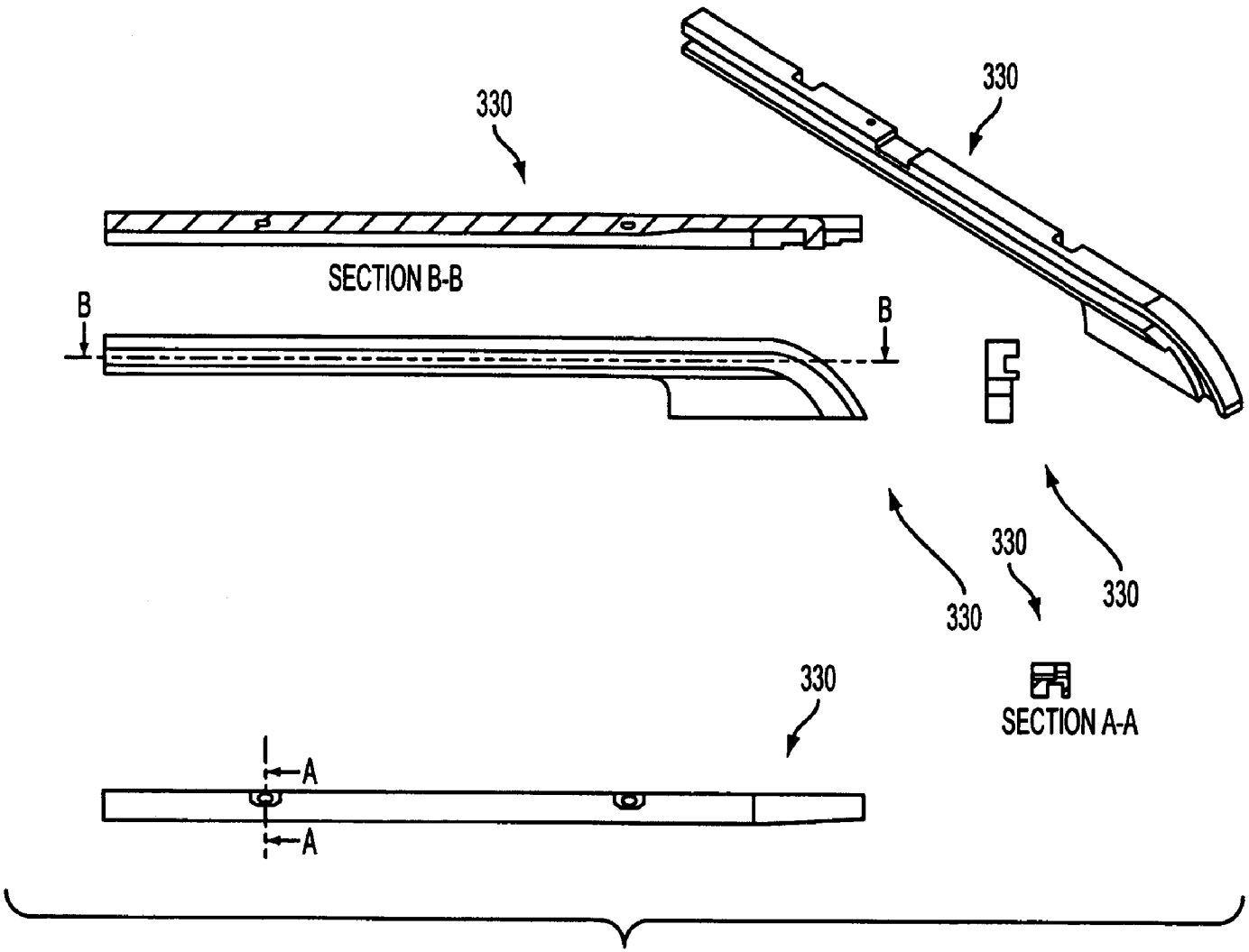
FIG. 42 shows perspective, top, side, front, lateral cross-sectional views of yet another guide member shown in FIG. 38 in accord with the present concepts.

FIG. 39 shows left and right portions of a guide member 320 in relation to the front sprocket 510 and gripper member 250. Gripper member 250 possesses, as noted above, guide blocks 270 which are configured to travel within guide member 320 grooves 322, as shown in FIG. 40. Guide member 320 has a height of about 24.0 mm and a groove 322 height of about 10.2 mm and groove depth of about 8.0 mm along a straight-away section extending from the far right end of FIG. 39 and extending toward the left (i.e., toward the sprocket 510) about 224.0 mm. In the vicinity of sprocket 510, the groove 322 increases in height and depth. In one aspect thereof, as shown in related FIGS. 41–42, the increase in height and depth of the guide member groove (e.g., 322) is progressive, continuing to increase in height (but not depth, which plateaus after about 25.0 mm). In one aspect, this is achieved by using plural radii of curvature having a corresponding plurality of radii center points.

Figure 43:
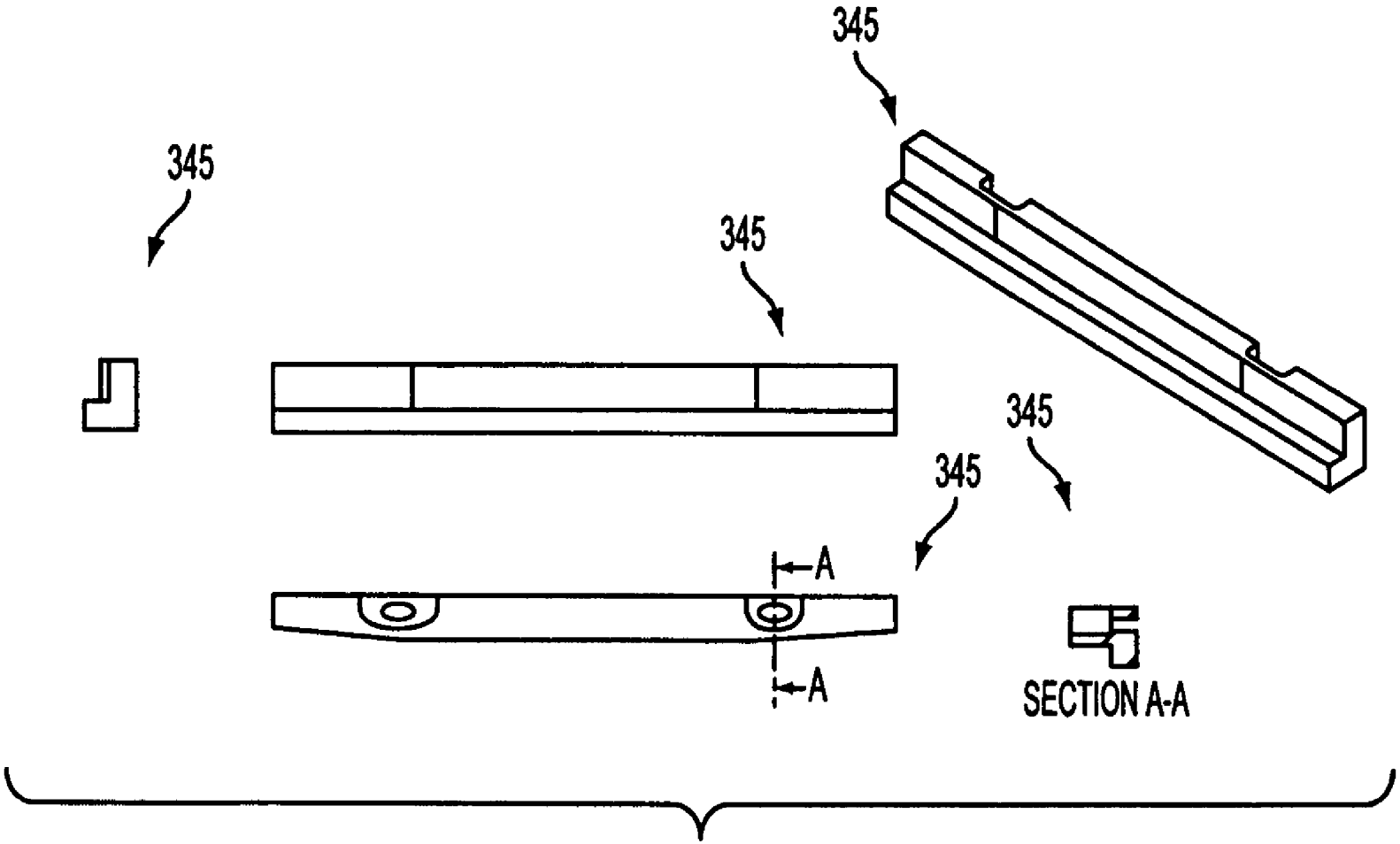
FIG. 43 shows views of a guide member for a gripper in accord with the present concepts.

For example, the portion of the groove 322 adjacent sprocket 510 shown in FIG. 39 may be successively defined by a first entry portion having a radii centered about a point that is 274 mm from said far right end and 90.0 mm down from a top surface thereof (i.e., a top surface in the straight-away portion), a second mid-portion having a radii centered about a point that is 274 mm from said far right end and 78.0 mm down from a top surface thereof, and a third exit portion (i.e., exiting into the straight-away) having a radii centered about a point that is 273 mm from said far right end (see FIG. 39) and 62.5 mm down from a top surface thereof. Similar aspects are shown with regard to guide members 310 and 330 in FIGS. 41–42. Guide member 345 comprises a straight run, as shown in FIGS. 38 and 43, even though it does overlap sprocket 540, albeit to a lesser degree than the other guide members.

The paired, grooved guides thus support the envelope gripping members 250 by means of guide blocks 270 on the gripping members 250 and corresponding grooves (e.g., 322) in the guide members 310, 320, 330, 340, 345, as the gripping members 250 travel around sprockets 510, 520, 530, and 540 and through the straight areas between the sprockets. The grooves in the guides members are configured to closely match the profile of the sprockets to maintain control of the high-speed gripping members 250 as they pass around the sprockets. Guide members 310, 320, 330, 340, 345 thus maintain control of the gripping members during selected portions of the gripping members path. In an area corresponding to the envelope registration stops 350, one gripping member 250 guide block (e.g., a guide block 270 as shown in FIGS. 35–36) is used to activate a registration stop 350, while the opposing gripping member 250 guide block 270 (not shown in FIGS. 35–36) is guided by, for example, groove 322.

In the aspects described above, the materials used (Delrin for guide members 310–340 and Nylatron for guide blocks 270) do not require any additional lubrication. Conventional guide means and lubricated guide means could also advantageously be combined with the present concepts disclosed herein to maintain control of high-speed gripping members 250 as they pass around the sprockets.

Figure 44:
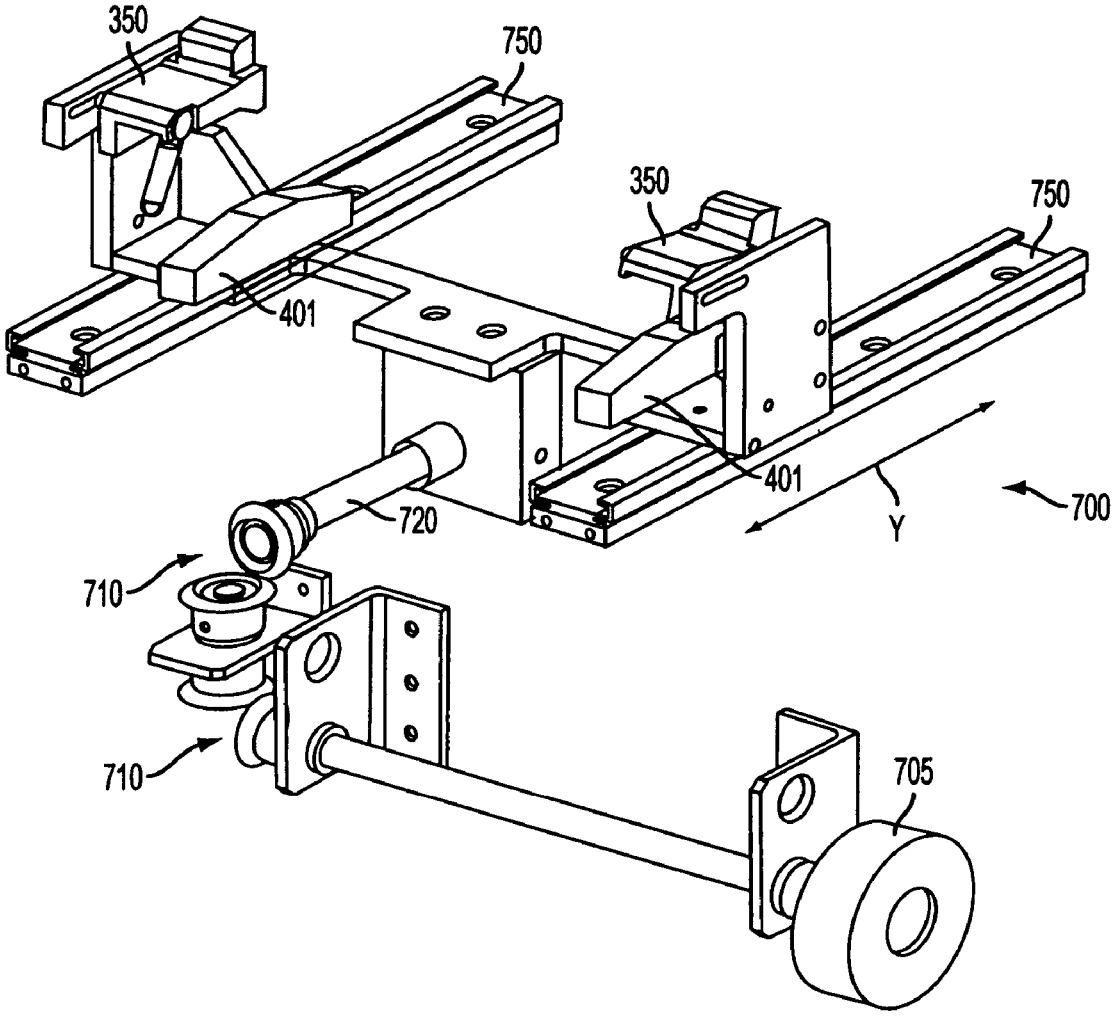
FIG. 44 shows an adjustment device by which a relative position of the envelope registration stops and the gripping member ramps may be simultaneously adjusted.

Another of the present concepts includes an adjustment means by which a relative position of the envelope registration stops 350 and the gripping member ramps 401 may be maintained, as shown in FIG. 44. Moreover, there is shown in FIG. 44 a "tool-less" method and apparatus for effecting changes to a relative position of the envelope registration stops 350 and the ramps 401 to permit optimized utilization of the above concepts for a variety of different length envelopes.

As shown in FIGS. 31 and 44, the envelope registration stops 350 and the ramps 401 that are configured to open the envelope gripping members 250 in the manner described above are both mounted on an assembly that maintains the position of registration stops 350 and ramps 401 relative to each other. This assembly is mounted to translate back and forth along a direction Y, as indicated by the arrow, upon a pair of linear slides 750. By turning one knob 705, an operator is able to adjust the position of the entire assembly or, in other words, is able to simply adjust the position of both the registration stops 350 and the ramps 401 that open the envelope gripping members 250, while maintaining the relative position of the registration stops 350 and ramps 401.

In one aspect, rotation of knob 705 rotates a shaft disposed along an x-direction that is connected via gearing to another shaft 720 disposed 90° thereto along a y-direction (in the direction of the linear slides 750) so as to permit an operator to easily access knob 705 and effect perpendicular translation of the assembly bearing the registration stops 350 and ramps 401. The gearing may be selected, in a manner known to those skilled in the art, to achieve any desired degree of force advantage for the operator or refinement of movement of the assembly on the linear slides 750 and may comprise any conventional gears including, but not limited to spur gears, helical gears, bevel gears (e.g., straight-tooth, spiral, hypoid, etc.), and worm gears. Additionally, gearing may be selected to achieve any angular placement of the knob 705 relative to the above-noted assembly.

Moreover, the concept of configuring envelope registration stops 350 and ramps 401 ramp as a single or ganged assembly to permit simultaneous adjustment of both stops and ramps and corresponding re-configuration the system to accept envelopes of different sizes may be advantageously coupled with an electronic control means, such as but not limited to a conventional motor adapted to drive the assembly back and forth along the Y-axis and push-button controls controlling such translation.

Various aspects of the present concepts are shown to illustrate the versatility and import of the present disclosure. As will be realized, the present concepts are capable of other and different embodiments, and its several details are capable of modifications in various respects, all without departing from the concepts disclosed herein by the illustrative examples.

What is claimed:

1. A high-speed envelope transport and insertion machine comprising:

a slip-drive system comprising an upper drive portion and a lower drive portion, each of the upper drive portion and the lower drive portion comprising a plurality of laterally spaced apart belts disposed about a plurality of pulley elements and at least one driving member to move the plurality of belts of the upper drive portion and lower drive portion at a first speed;

an envelope transmission device disposed to input envelopes into the slip-drive between the plurality of belts of the upper drive portion and lower drive portion;

a plurality of gripping members disposed on and at intervals along a first drive member comprising a chain or belt disposed to pass between the plurality of laterally spaced apart belts and between the upper drive portion and lower drive portion, the first drive member being driven at a second speed lower than the first speed;

wherein envelopes input into the slip-drive are moved at a speed greater than a speed of the gripping members so that an envelope borne by the slip-drive overtakes a corresponding one of the plurality of gripping members and is registered therein, wherein, upon registration of an envelope within a gripping member, the gripping member closes to retain the envelope.

2. A high-speed envelope transport and insertion machine according to claim 1, further comprising:

a plurality of gripping members disposed on and at intervals along a second drive member comprising a chain or belt disposed to pass between the plurality of laterally spaced apart belts and between the upper drive portion and lower drive portion, the second drive member being driven at the second speed, wherein the first drive member and second drive member are disposed substantially laterally equidistant from a center of an envelope path in the slip-drive.

3. A high-speed envelope transport and insertion machine according to claim 2, wherein the gripping members of the first drive member and second drive member are configured to open slightly while travelling within the slip-drive to receive an envelope carried by the slip-drive belts, and wherein the gripping members of the first drive member and second drive member are configured to close following registration of the envelope within the gripping members.

4. A high-speed envelope transport and insertion machine according to claim 2, wherein the first drive member bearing a plurality of gripping members and the second drive member bearing a plurality of gripping members are continuously in motion during operation of the high-speed envelope transport and insertion machine, and wherein a plurality of sets of gripping members, one gripping member from each set being disposed on a respective one of the first drive member and the second drive member, are disposed to pass between the plurality of laterally spaced apart belts and between the upper drive portion and lower drive portion to permit a plurality of envelopes to be transported at the same time.

5. A high-speed envelope transport and insertion machine according to claim 4, wherein the gripping members are configured to open and close while in motion.

6. A high-speed envelope transport and insertion machine according to claim 5, further comprising:

a sensor element provided on at least one of the first drive member and the second drive member; and a control system configured to determine a position of the sensor element.

7. A high-speed envelope transport and insertion machine according to claim 6, wherein the control system is configured to determine a position of at least one of the plurality of gripping members based on a known position of the sensor element and a known relation between the sensor element the respective one of the first drive member and the second drive member, and positions of the gripping elements borne thereby.

8. A high-speed envelope transport and insertion machine according to claim 5, further comprising:

a stationary sensor;

wherein the stationary sensor is configured to detect a predetermined portion of a gripping member passing the sensor.

9. A high-speed envelope transport and insertion machine according to claim 8, wherein the predetermined portion of a gripping member comprises at least one of a gripping member leading edge and trailing edge.

10. A high-speed envelope transport and insertion machine according to claim 2, wherein the belts of the upper drive portion and lower drive portion are driven at a speed between about 1.5 and 4.0 times the speed at which the first drive member and second drive member are driven.

11. A high-speed envelope transport and insertion machine according to claim 10, wherein the upper drive portion and lower drive portion are rotatable relative to one another.

12. A high-speed envelope transport and insertion machine according to claim 1, further comprising:

an envelope stuffing device;

wherein the gripping members transport the envelope to a stuffing device.

13. A high-speed envelope transport and insertion machine according to claim 1, further comprising:

at least one envelope registration stop biased by at least one of a spring and a resilient element out of a path of travel of an envelope, wherein the gripping members activate the envelope registration stop by biasing the envelope registration stop into the path of the envelope as the gripping members open to release the envelope, and wherein the envelope registration stop is configured to register the envelope.

14. A high-speed envelope transport and insertion machine according to claim 13, wherein the envelope registration stop comprises two envelope registration stops disposed substantially laterally equidistant from a center of an envelope path.

15. A high-speed envelope transport and insertion machine according to claim 14, wherein the envelope registration stops are configured to drop out of the path of the envelope under the bias of the spring or resilient element following envelope registration to allow continued movement of the envelope along the path of the envelope in the envelope stuffing device.

16. A high-speed envelope transport and insertion machine according to claim 1, wherein the gripping members comprise a gripping member jaw rotatably disposed relative to a gripping member seat, and wherein the gripping member jaw is spring-loaded to assume a normally closed position.

17. A high-speed envelope transport and insertion machine according to claim 16, wherein the gripping member seat comprises at least one of a hardened steel seat and a non-metallic seat material having a Shore hardness of about 85D.

18. A high-speed envelope transport and insertion machine according to claim 16, wherein a leading edge of the top-most surface of the gripping member seat is chamfered or rounded.

19. A high-speed envelope transport and insertion machine according to claim 18, wherein a top-most surface of the gripping member seat is at least one of substantially planar and substantially planar with a forwardly placed lateral depression corresponding substantially in size and placement with a gripping member jaw shaft.

20. A high-speed envelope transport and insertion machine according to claim 19, wherein the gripping member seat comprises, at a rearward portion thereof, an upwardly protruding envelope stop member provided to ensure proper registration of an envelope with respect to the gripping member.

21. A high-speed envelope transport and insertion machine according to claim 20, wherein:

the gripping member seat comprises lateral side plates attached thereto, each of the lateral side plates comprising a guide block protruding outwardly therefrom, and the guide block comprising a tapered or rounded leading edge, a tapered or rounded trailing edge, and a substantially planar upper and lower surface therebetween.

22. A high-speed envelope transport and insertion machine according to claim 21, wherein;

the gripping member jaw comprises two lateral side members rotatably affixed to inner surfaces of the lateral side plates by a rotatable shaft, upper portions of the gripping member jaw extend forwardly to clamp against the gripping member seat under a spring bias, a lower portion of at least one of the two lateral side members comprises a lower idler portion having an idler bearing, and upward displacement of the idler bearing causes rotation of the gripping member jaw upper portion away from the gripping member seat against a spring bias.

23. A high-speed envelope transport and insertion machine according to claim 22, further comprising:

a plurality of guide members disposed adjacent sprockets about which the first drive member and the second drive member are disposed to travel, wherein the guide members are provided to receive and guide the gripping member guide blocks over at least a portion of an arc of travel of the gripping members about the sprockets.

24. A high-speed envelope transport and insertion machine according to claim 23, wherein the guide members are disposed to guide the gripping members over an arc of travel of about 140° around at least one of the sprockets.

25. A high-speed envelope transport and insertion machine according to claim 24, further comprising:

a ramp provided along a path of travel of the gripping member to upwardly displace the gripping member idler bearing to cause rotation of the gripping member jaw upper portion away from the gripping member seat against a spring bias.

26. A high-speed envelope transport and insertion machine according to claim 25, wherein:

the ramp is provided in the slip-drive system, the ramp leading edge and plateau respectively cause and maintain an upward displacement of the gripping member jaw idler bearing to open the gripping member jaw and permit receipt of an envelope within the opening defined between the top-most surface of the gripping member seat and the forwardly extending upper portions of the gripping member jaw, substantially concurrently with the opening of the gripping member jaw, an envelope carried by the slip-drive system overtakes and is inserted into the opening, and the ramp trailing edge permits a controlled downward movement of the gripping member jaw idler bearing to close the gripping member jaw and hold the envelope between the top-most surface of the gripping member seat and the forwardly extending upper portions of the gripping member jaw.

27. A high-speed envelope transport and insertion machine according to claim 24, further comprising:

a ramp provided within the slip-drive unit along a path of travel of the gripping member to upwardly displace the gripping member idler bearing to cause rotation of the gripping member jaw upper portion away from the gripping member seat against a spring bias so as to enable receipt and registration of an envelope.

28. A high-speed envelope transport and insertion machine according to claim 27, wherein the ramp comprises a chamfered or rounded leading edge, a substantially planar plateau, and a chamfered or rounded trailing edge.

29. A high-speed envelope transport and insertion machine according to claim 27, wherein:

another ramp is provided in the envelope stuffing device, the envelope stuffing device ramp leading edge and plateau respectively cause and maintain an upward displacement of the gripping member jaw idler bearing to open the gripping member jaw and permit discharge of the envelope borne thereby, substantially concurrently with the opening of the gripping member jaw, an envelope registration stop is biased into a path of the envelope and decelerates the envelope relative to the gripping member jaw, which travels at a substantially constant speed, to remove the envelope from the gripping member jaw, and following removal of the envelope from the gripping member jaw, a trailing edge of the envelope stuffing device ramp permits a controlled downward movement of the gripping member jaw idler bearing to close the gripping member jaw.

30. A high-speed envelope transport and insertion machine according to claim 21, wherein the envelope registration stop is biased into a path of the envelope by the gripping member guide block leading edge, maintained in the path of the envelope by the gripping member guide block substantially planar upper surface, and permitted to move out of the path of the envelope by the gripping member guide block trailing edge.

31. A high-speed envelope transport and insertion machine comprising:

a slip-drive system comprising an upper drive portion and a lower drive portion, each of the upper drive portion and the lower drive portion comprising a plurality of laterally spaced apart belts disposed about a plurality of pulley elements and at least one driving member to move the plurality of belts of the upper drive portion and lower drive portion at a first speed;

an envelope transmission device disposed to input envelopes into the slip-drive between the plurality of belts of the upper drive portion and lower drive portion;

a plurality of gripping members disposed on and at intervals along a first drive member comprising a chain or belt disposed to pass between the plurality of laterally spaced apart belts and between the upper drive portion and lower drive portion, the first drive member being driven at a second speed lower than the first speed; wherein:

envelopes input into the slip-drive are moved at a speed greater than a speed of the gripping members so that an envelope borne by the slip-drive overtakes a corresponding one of the plurality of gripping members and is registered therein, and upon registration of an envelope within a gripping member, the gripping member closes to retain the envelope, the first drive member is continuously in motion during operation of the high-speed envelope transport and insertion machine and the gripping members are configured to open and close while in motion, each of the gripping members comprises a gripping member jaw rotatably disposed relative to a gripping member seat, and the gripping member jaw is spring-loaded to assume a normally closed position.

32. A high-speed envelope transport and insertion machine comprising:

a slip-drive system having a plurality of belts configured to move envelopes along an envelope path at a first speed;

an envelope transmission device disposed to input envelopes into the slip-drive system;

an envelope stuffing device comprising a registration member; and a drive member having a plurality of spaced-apart gripping members disposed to move continously between the slip-drive system and the envelope stuffing device at a second speed less than the first speed, wherein the path of the gripping members and the envelopes crosses within the slip-drive system to permit the gripping member to engage and grip the envelope, and wherein the gripping member is configured to release the envelope following registration of the envelope against the registration member.

* * * * *